US011118358B2

(12) United States Patent
Hatzinikolas

(10) Patent No.: US 11,118,358 B2
(45) Date of Patent: Sep. 14, 2021

(54) SUPPORT BRACKET ASSEMBLY AND METHOD

(71) Applicant: Michael Hatzinikolas, Edmonton (CA)

(72) Inventor: Michael Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 0 days.

(21) Appl. No.: 16/426,801

(22) Filed: May 30, 2019

(65) Prior Publication Data

US 2020/0378132 A1 Dec. 3, 2020

(51) Int. Cl.

| | |
|---|---|
| ***E04F 13/06*** | (2006.01) |
| ***E04F 13/08*** | (2006.01) |
| ***E04F 13/14*** | (2006.01) |
| ***E04B 1/41*** | (2006.01) |
| *E04B 1/38* | (2006.01) |
| *E04C 3/02* | (2006.01) |

(52) U.S. Cl.

CPC ..... *E04F 13/0805* (2013.01); *E04B 1/4178* (2013.01); *E04F 13/0857* (2013.01); *E04F 13/14* (2013.01); *E04B 2001/405* (2013.01); *E04C 2003/023* (2013.01)

(58) Field of Classification Search

CPC ..... E04B 1/4178; E04B 1/7616; E04B 2002/565; E04F 13/14; E04F 13/147; E04F 13/0805; E04F 13/0857; E04C 2003/023

USPC ..... 52/204.2, 379, 235, 506.05, 508, 513, 52/702, 715

See application file for complete search history.

(56) References Cited

U.S. PATENT DOCUMENTS

| | | | | |
|---|---|---|---|---|
| 779,268 A | | 1/1905 | Elliott | |
| 1,455,712 A | | 5/1923 | Collins | |
| 1,695,909 A | * | 12/1928 | Bauer | E04B 1/4178 52/702 |
| 1,697,003 A | | 1/1929 | Fink | |
| 1,729,935 A | | 10/1929 | Froehlich | |
| 1,764,134 A | | 6/1930 | Young et al. | |
| 1,843,384 A | * | 2/1932 | Done | F27D 1/004 52/506.04 |
| 2,363,156 A | | 11/1944 | Sinner et al. | |
| 3,050,160 A | | 8/1962 | Chesser et al. | |

(Continued)

FOREIGN PATENT DOCUMENTS

| | | | | |
|---|---|---|---|---|
| CA | 2284069 A1 | * | 5/2000 | E04B 1/4178 |
| CA | 2759778 A1 | * | 5/2000 | E04B 1/4178 |

(Continued)

OTHER PUBLICATIONS

International Search Report & Written Opinion dated Mar. 12, 2020 for PCT/CA2019/051727.

*Primary Examiner* — Robert Canfield

(74) *Attorney, Agent, or Firm* — Ridout & Maybee LLP

(57) ABSTRACT

A masonry veneer support assembly for mounting masonry veneer to supporting wall structure. The support assembly has a first shelf angle, a second shelf angle, and a first shelf angle mounting bracket. Each shelf angle mounting bracket has an upwardly extending back that mounts to the supporting wall structure, and a web extending forwardly away from the wall structure. The web has first and second shelf angle mounting seats formed therein. The first shelf angle mounting seat is upwardly spaced from the second shelf angle mounting seat. A second shelf angle mounting bracket may be spaced apart horizontally from the first shelf angle mounting bracket.

26 Claims, 39 Drawing Sheets

(56) References Cited

Figure 1A:
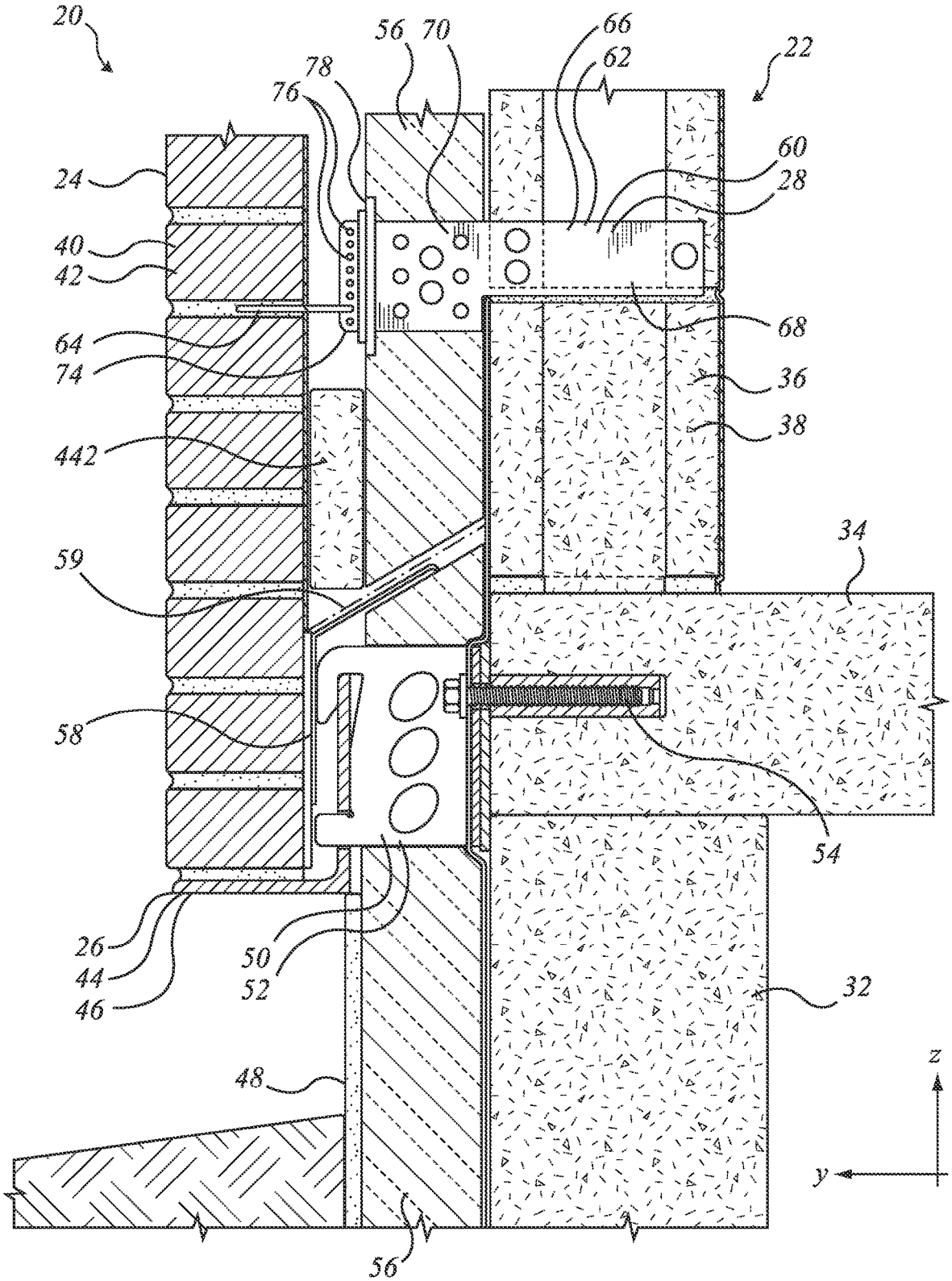
FIG. 1a (Prior Art)

U.S. PATENT DOCUMENTS 3,234,702 A 2/1966 Zibell
3,341,909 A 9/1967 Havener
3,414,224 A 12/1968 Watford et al.
3,450,427 A 6/1969 Fischer et al.
3,666,303 A 5/1972 Huls
3,680,271 A 8/1972 Satchell
3,730,466 A 5/1973 Swanquist
3,942,292 A 3/1976 Robinson
4,013,253 A 3/1977 Perrault et al.
4,094,415 A 6/1978 Larson
4,390,103 A 6/1983 Husband
4,422,610 A 12/1983 Hunt
4,429,850 A 2/1984 Weber et al.
4,447,961 A 5/1984 Valat
4,515,494 A 5/1985 Robilliard et al.
4,805,367 A 2/1989 Smolik
4,827,684 A * 5/1989 Allan ..... E04B 1/4178 52/378
4,869,043 A * 9/1989 Hatzinikolas ..... E04B 1/4185 52/712
D311,858 S 11/1990 Richmond
5,018,323 A * 5/1991 Clausen ..... A47F 5/0846 211/189
5,035,099 A 7/1991 Lapish
5,063,715 A 11/1991 Goodman
5,082,388 A 1/1992 Lauterbach
5,207,043 A * 5/1993 McGee ..... E04B 1/4178 52/379
5,265,396 A 11/1993 Amimoto
5,313,752 A 5/1994 Hatzinikolas
5,392,581 A * 2/1995 Hatzinikolas ..... E04B 1/4185 52/379
5,405,116 A 4/1995 Shepherd et al.
5,456,435 A 10/1995 Sweeney
5,588,537 A 12/1996 Hagopian
5,619,734 A 4/1997 Chen
5,619,834 A 4/1997 Chen
5,794,902 A 8/1998 Henry et al.
5,816,008 A * 10/1998 Hohmann ..... E04B 1/4178 52/565
6,098,942 A 8/2000 Heath
6,128,883 A * 10/2000 Hatzinikolas ..... E04B 1/4178 52/378
6,161,709 A 12/2000 Kluge et al.
6,298,620 B1 10/2001 Hatzinikolas
6,584,741 B1 7/2003 Hatzinikolas
6,817,688 B2 11/2004 O'Halloran
6,973,756 B2 12/2005 Hatzinikolas
7,367,165 B2 5/2008 Hatzinikolas
7,392,911 B2 7/2008 Stitchick et al.
7,415,803 B2 8/2008 Bronner
7,469,659 B2 12/2008 de Jonge et al.
7,614,590 B2 11/2009 Boville
7,654,058 B2 2/2010 Hatzinikolas
7,765,771 B2 8/2010 Serpico et al.
7,908,804 B2 * 3/2011 Vieira ..... E04C 3/02 52/235
8,051,621 B2 11/2011 Hatzinikolas
8,250,827 B2 8/2012 Lin et al.
8,333,048 B2 12/2012 Talpe
8,490,340 B2 7/2013 Hatzinikolas
8,490,341 B2 7/2013 Hatzinikolas
8,555,595 B2 10/2013 Hatzinikolas
8,621,802 B2 1/2014 Spyrou
8,667,763 B2 3/2014 Hatzinikolas
8,893,452 B2 11/2014 Hatzinikolas
8,955,263 B2 2/2015 Hatzinikolas
9,010,050 B2 4/2015 Hatzinikolas
9,010,062 B2 4/2015 Hill
9,027,301 B2 5/2015 Guinn
9,316,004 B1 * 4/2016 Hatzinikolas ..... E04F 13/14
10,294,676 B2 5/2019 Hatzinikolas
10,323,419 B2 * 6/2019 Hatzinikolas ..... F24F 13/20
2006/0156682 A1 7/2006 McAndrew et al.
2006/0272251 A1 12/2006 Hatzinikolas
2008/0098681 A1 * 5/2008 Hatzinikolas ..... E04G 21/185 52/378
2010/0287864 A1 11/2010 Hatzinikolas
2011/0061337 A1 * 3/2011 O'Shea ..... E04F 13/0808 52/747.12
2011/0107711 A1 5/2011 Foley
2014/0150373 A1 * 6/2014 Hatzinikolas ..... E04F 13/0833 52/712
2014/0174014 A1 6/2014 Hatzinikolas
2014/0190110 A1 7/2014 Hatzinikolas
2015/0059259 A1 3/2015 Hatzinikolas
2016/0153198 A1 * 6/2016 Hatzinikolas ..... E04F 13/0805 52/702
2016/0305113 A1 * 10/2016 Hatzinikolas ..... E04F 13/0801
2020/0056378 A1 * 2/2020 Vukelic ..... E04F 13/14

FOREIGN PATENT DOCUMENTS

CA 2526876 A 2/2006
CA 2997356 A1 * 10/2018 ..... E04F 13/0805
DE 3128246 A1 * 2/1983 ..... E04F 13/0821
DE 3128246 A1 2/1983
DE 3602308 A1 * 7/1987 ..... E04B 1/4178
DE 10117199 A1 * 10/2002 ..... E04F 13/0857
DE 102010025135 A1 * 12/2011 ..... E04F 13/0857
EP 1375777 A1 * 1/2004 ..... E04B 1/7046
EP 1375777 A1 1/2004
GB 2395497 A * 5/2004 ..... E04F 13/0855
GB 2417039 A1 2/2006
GB 2426261 A * 11/2006 ..... E04F 13/0857
GB 2448165 A * 10/2008 ..... E04F 13/0857
GB 2505980 A * 3/2014 ..... E04F 13/0857

* cited by examiner

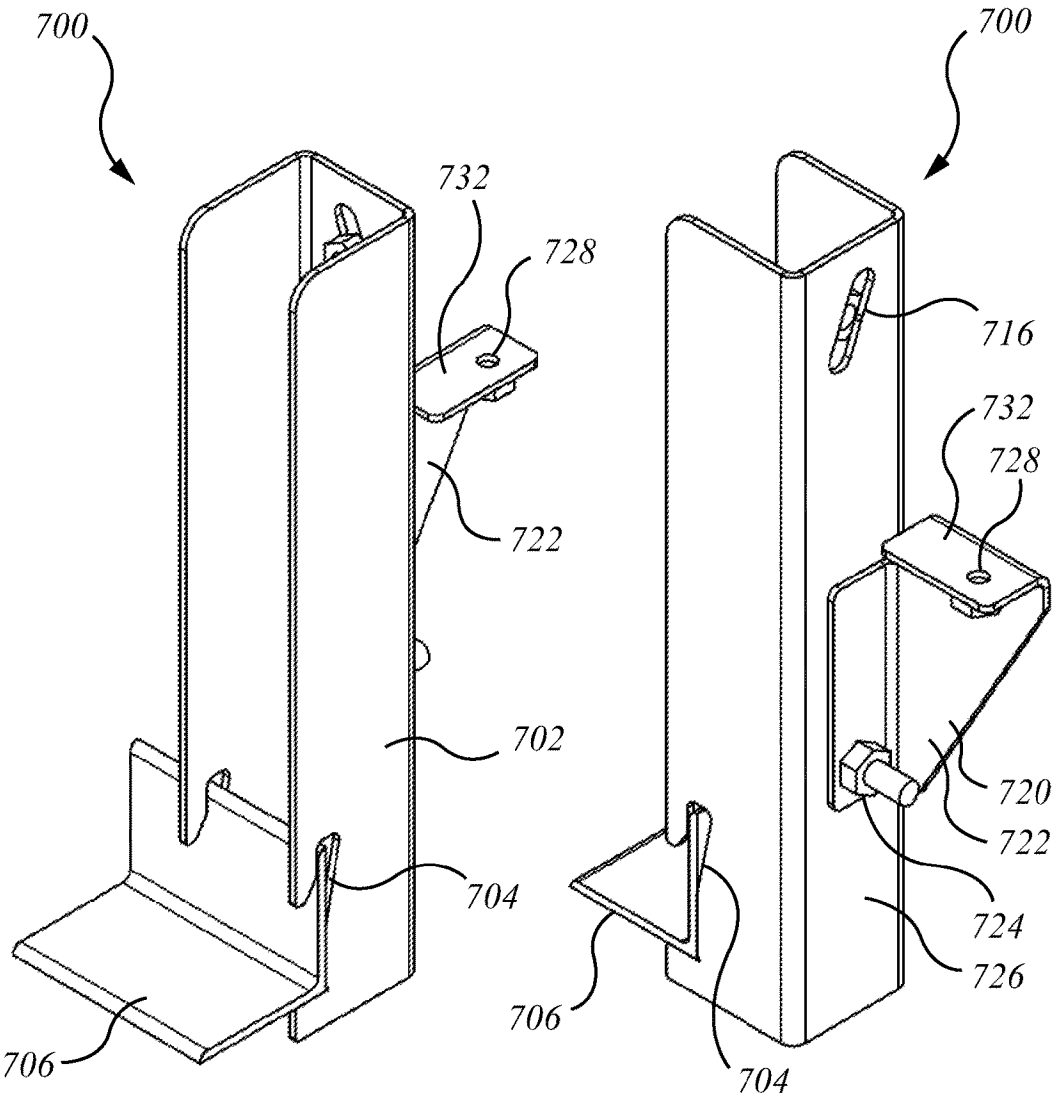
FIG. 16c
FIG. 16b
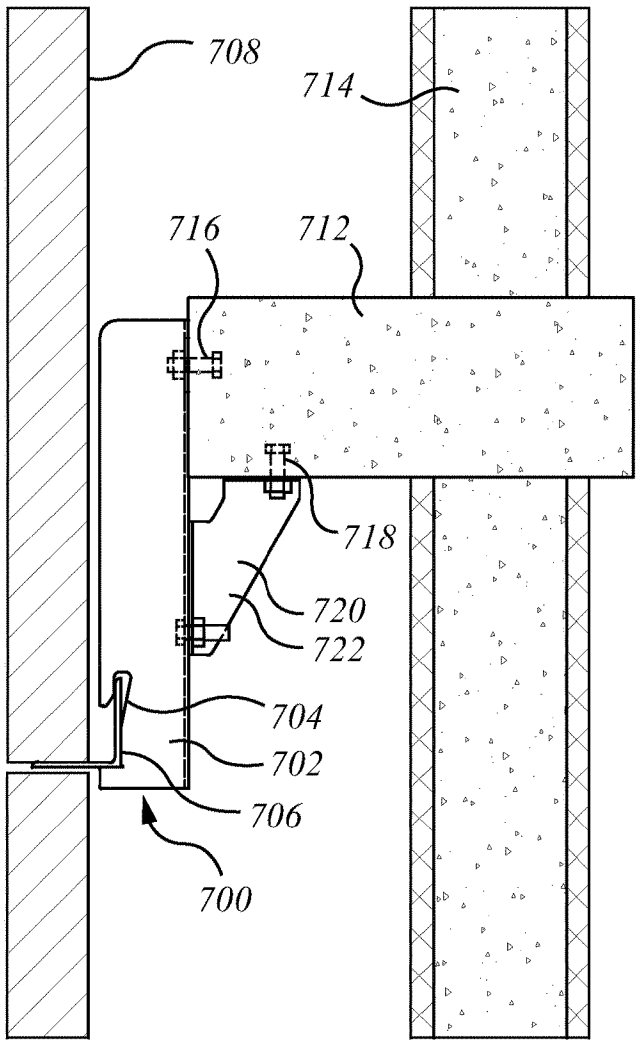
FIG. 16a

SUPPORT BRACKET ASSEMBLY AND METHOD

FIELD OF INVENTION

This specification relates to structural materials for use in the construction of buildings, and, in one context, to support structure for external veneer components.

BACKGROUND OF THE INVENTION

In former times, brick stone, or other masonry walls were load bearing structures. In contemporary building structures bricks, or other masonry elements, or other visible finished surface elements, are rarely load-bearing and tend more often to be employed as surface cladding on the exterior face of load-bearing structure.

When mounting face brick or stone veneer on the face of a wall structure, it is common to support the first row of bricks, or stone, or veneer on a steel support. In the art, the steel support for the masonry veneer may be termed in a "shelf angle". The "shelf angle" extends outward from the wall structure, and runs along, or has a major dimension extending in, a direction that is generally horizontal and cross-wise to the wall. The steel support is mounted to the load-bearing wall, or load-bearing framing, before brick-laying commences.

The steel support may be welded to a steel anchoring system embedded in the wall. Alternatively, the steel support may be carried in spaced-apart brackets that have themselves been mounted to the load bearing wall structure.

In an era of energy conservation, the shelf angle is carried on brackets that stand outwardly from the load bearing structure, outside the vapor barrier and external sheathing (if any), so that the back of the shelf angle is spaced away from the structure. This is intended to leave spacing for insulation to be placed between the external sheathing of the building walls and the back of the shelf angle. Furthermore, in view of the tendency for condensation to form on the outer face of the insulation, it is also now customary to leave an air gap between the insulation and the back of the masonry veneer.

In earlier construction, either when the masonry was load-bearing or when the masonry was placed directly against the sheathing of the building envelope, either there was access to both sides of the masonry as it was laid, or the backing structure abutted the masonry. In either case, the mason could remove excess mortar at the time of brick laying and jointing, or the backing structure formed a barrier to mortar migration. By contrast, in a contemporary a masonry veneer wall, the air gap does not provide room to remove excess mortar with a trowel or provide space to use a jointer afterward. There is a tendency for excess mortar in the inside to fall between the masonry veneer and the insulation. This is not generally helpful, since the mortar that falls downward may block weep holes in the brick or may otherwise obstruct drainage passageways. Further, when a shell angle is used, moisture trapped by fallen mortar on the shelf angle may tend to cause rusting. If the rust leaks, it may then yield staining visible on the outside of the wall.

Shelf angles are used in a variety of contexts in building masonry veneer walls. Where the masonry veneer wall is tall, it is required to use shelf angles as a break in the wall if the wall is over a given height, such as 30 feet. In other circumstances, the shelf angle is used as the datum at the bottom edge of the commencement of the veneer cladding. In still other circumstances a shelf angle is used to establish the upper sill of a window or a door.

For one reason or another, a masonry veneer installation may employ a shelf angle at one height, but may also employ a second shelf angle at another, fairly close height. For example a long shelf angle may be used at or near the level of a floor slab, while another shelf angle may be used to establish a sill height for a door or window below that floor. Alternatively, one style of masonry veneer may be used at and above one shelf angle, while another style may be used above the other, as in circumstances where a change in brickwork pattern is intended by the architect to achieve a desired visual or textural effect. In such an instance, there is a need for shelf angles to be mounted in relatively close proximity.

Furthermore, while the use of channel-shaped brackets may be customary, there is a variety of non-standard circumstances in which more specialized installation arrangements may be required. For example, there may be circumstances where a mounting is required directly to a load bearing member such as a beam, where it is desired for the vertical load to be carried into a flange. It may be desired for the vertical load to be spread or divided into the flange at locations distant from a penetration through the flange. In some circumstances the attachment may be to a vertical web of the structural member. In some circumstances the rearward side of the structural web may not be easily accessible, as when the structural member is a closed-periphery hollow structural section. In some cases it may be desirable locally to reinforce the location of the structural load transfer interface. In other instances, the mounting connection may be to a concrete member, be it a beam or a floor slab, or some other structure. Concrete structures may include reinforcement bars, i.e., re-bar. Concrete structures may also be thinner in one direction than another, such that an anchor placement may be better in one orientation or location than another.

Further still, it may be desired to produce a textured or tiered masonry arrangement. In such an arrangement, the masonry may be above or below the shelf angle, and above or below the anchoring load transfer interface to supporting structure. Furthermore, there may be circumstances when the supporting structure, be it concrete or steel framing, extends outwardly from adjacent structure in a cantilever or overhang. In any of these cases, it may be desired for the masonry facing of the structure to be visible, while the support structure is hidden. This may include arrangements in which the masonry is applied underneath the supporting brackets. In other circumstances, the masonry veneer facing may be applied where there is an overhanging corner.

In all of these circumstances, supporting structure and shelf angles of configurations beyond those suitable merely for a planar, flat, featureless wall may be desired. The inventor addresses a variety of such situations in the embodiments shown and described herein.

SUMMARY OF INVENTION

In an aspect of the invention there is a masonry veneer support assembly for mounting masonry veneer to supporting wall structure. The support assembly has a first shelf angle, a second shelf angle, a first shelf angle mounting bracket, and a second shelf angle mounting bracket. The first and second shelf angle mounting brackets are spaced apart horizontally. The first and second shelf angle mounting brackets each have an upwardly extending back that mounts to the supporting wall structure, and a web extending forwardly away from the wall structure. The web has first and second shelf angle mounting seats formed therein. The first shelf angle mounting seat is upwardly spaced from the second shelf angle mounting seat.

In a feature of that aspect, the first shelf angle mounting seat is rearwardly recessed relative to the second shelf angle mounting seat. In another feature, the first shelf angle mounting seat is vertically inverted relative to the second shelf angle mounting seat. In a further feature, the assembly includes mortar netting mounted to at least one of the first and second shelf angles. In still another feature, the second shelf angle seat includes a protruding toe. The second shelf angle has a back having an aperture formed therein. The toe seats in the aperture when the second shelf angle is mounted to the second shelf angle seat.

In another aspect, there is an external facing support assembly. That assembly has at least a mounting bracket, a first shelf angle and a second shelf angle. Each shelf angle is engageable with the mounting bracket for support thereby. The mounting bracket has a first portion with a mounting fitting by which to secure the assembly to a load-bearing wall structure. The mounting bracket has a second portion defining a leg standing outwardly from the first portion. The leg includes a first seat and a second seat. Each seat is located distant from the mounting fitting. As installed each seat is spaced away from the load-bearing wall structure. The first seat is vertically spaced apart from the second seat. Each seat includes a vertical reaction interface, and a moment restraint. The moment restraint includes a vertically extending slot. Each shelf angle has an external facing carrier and a seat engagement. The carrier is connected to the seat engagement. The external facing carrier includes a horizontally extending foot upon which to mount at least one masonry veneer member forwardly of the mounting bracket. The seat engagement includes a vertically extending web to which the foot is joined. As installed, the seat engagement of the first shelf angle engages the first seat with the web of the first shelf angle seated in the slot of the first seat. The seat engagement of the second shelf angle engages the second seat with the web of the second shelf angle seated in the slot of the second seat.

In a feature of that aspect, the first seat includes a first protruding toe of the leg; and the web of the first shelf angle has a first accommodation formed therein, in which to admit the first protruding toe of the leg. In another feature, the web of the second shelf angle is a continuous web. In another feature, the moment restraint of the second seat includes a first retainer, and when the second shelf angle is mounted to the second seat, the first retainer is located forwardly of the web of the second shelf angle. In another feature, the moment restraint of the first seat includes a second retainer, and when the first shelf angle is mounted to the first seat, the second retainer is located forwardly of the web of the first shelf angle.

In a still further feature, the first seat includes a first protruding toe of the leg. The web of the first shelf angle has a first accommodation formed therein, in which to admit the first protruding toe of the leg. The moment restraint of the second seat includes a first retainer, and when the second shelf angle is mounted to the second seat, the first retainer is located forwardly of the web of the second shelf angle. The moment restraint of the first seat includes a second retainer. When the first shelf angle is mounted to the first seat, the second retainer is located forwardly of the web of the first shelf angle. The web of the second shelf angle is a continuous web.

In another feature, the leg has a first section including the first seat, a second section including the second seat, and an intermediate section including a web extending vertically between the first and second sections. In another feature, the first section has a first peripheral edge spaced outwardly from the load-bearing structure. The second section has a second peripheral edge spaced outwardly from the load-bearing structure. The web defines an intermediate peripheral edge that extends between the first section and the second section aligned with the first peripheral edge and the second peripheral edge. In another feature, the intermediate section has an intermediate vertical extent at least twice a first vertical extent of the first section and at least twice a second vertical extent of the second section.

In a further feature, the mounting bracket is a channel member having a web and a pair of first and second legs extending away from the web. The first portion of the mounting bracket includes the web of the channel member. The first leg of the channel member defines one the second portion of the mounting bracket. The second leg of the channel defines the second portion of the mounting bracket. As installed, each shelf angle engages the first leg and the second leg of the mounting bracket. In another feature, the seat engagement of the second seat extends rearwardly and downwardly of the carrier of the second seat. In a further feature, the seat engagement of the first seat extends rearwardly and upwardly of the carrier of the first seat. In a still further feature, the moment restraint of the second seat includes a retainer, and when the second shelf angle is mounted to the second seat, the retainer is located forwardly of the web of the second shelf angle; and the retainer has an upper edge, and the carrier of the second seat is upwardly of the upper edge. In another feature the carrier of the first seat extends forwardly of the carrier of the second seat whereby, on assembly, an external face of a first masonry veneer member mounted on the carrier of the first seat is located forwardly of an external face of a second masonry veneer member mounted on the carrier of the second seat. In yet another feature, the leg extends downwardly of the first protruding toe. In a still further feature, on assembly, the carrier of the first shelf angle is flush with a lowermost portion of the leg.

In another feature, the assembly includes a plurality of the mounting brackets spaced apart along the first shelf angle and the second shelf angle. In a further feature, the mounting bracket has a vertical first section including the first seat, a second vertical section including the second seat, and an intermediate vertical section including a web extending vertically between the first section and the second section. The vertical first section includes the mounting fitting.

In another feature, the mounting fitting includes a first mounting fitting and a second mounting fitting. In a further feature, the mounting bracket has a vertical first section tat includes the first seat, a second vertical section including the second seat, and an intermediate vertical section including a web extending vertically between the first section and the second section. The vertical first section includes the first mounting fitting and the second mounting fitting. In another feature, on assembly, the at least one masonry veneer member is mounted on the foot forwardly of the mounting bracket defining a cavity between the at least one masonry veneer member and the mounting bracket. The assembly further comprises a mortar netting positioned in the cavity.

In another aspect, there is an external facing support assembly. It has at least a mounting bracket, a first shelf angle and a second shelf angle. Each shelf angle is engageable with the mounting bracket for support thereby. The mounting bracket has a first portion with a mounting fitting by which to secure the assembly to a load-bearing wall structure. The mounting bracket has a second portion defining a leg standing outwardly from the first portion. The leg includes a first seat and a second seat. Each seat is located distant from the mounting fitting. As installed the first seat is spaced away from the load-bearing wall structure by a first distance and the second seat is spaced away from the load-bearing wall structure by a second distance. The second distance is greater than the first distance. The first seat is vertically spaced apart from the second seat. Each seat includes a vertical reaction interface, and a moment restraint. Each shelf angle has an external facing carrier and a seat engagement. The carrier is connected to the seat engagement. The external facing carrier includes a horizontally extending foot upon which to mount at least one masonry veneer member forwardly of the mounting bracket. The seat engagement includes a vertically extending web to which the foot is joined. As installed, the seat engagement of the first shelf angle engages the first seat and the seat engagement of the second shelf angle engaging the second seat.

In a feature of that aspect, on assembly, the at least one masonry veneer member mounted on the foot of the first seat has a first external face that is spaced away from the load-bearing wall structure by a first veneer distance. The at least one masonry veneer member mounted on the foot of the second seat has a second external face that is spaced away from the load-bearing wall structure by a second veneer distance that is greater than the first veneer distance.

In another aspect there is an external facing support assembly. It has at least a mounting bracket, a first shelf angle and a second shelf angle. Each shelf angle is engageable with the mounting bracket for support thereby. The mounting bracket has a first portion with a mounting fitting by which to secure the assembly to a load-bearing wall structure. The mounting bracket having a second portion defining a leg standing outwardly from the first portion. The leg includes a first seat and a second seat. Each seat is located distantly from the mounting fitting. As installed each seat is spaced away from the load-bearing wall structure. The first seat is vertically spaced apart from the second seat. Each seat has a vertical reaction interface, and a moment restraint. The moment restraint includes a vertically extending slot. Each shelf angle has an external facing carrier and a seat engagement. The carrier is connected to the seat engagement. The external facing carrier includes a horizontally extending foot upon which to mount at least one masonry veneer member forwardly of the mounting bracket. The seat engagement includes a vertically extending web to which the foot is joined. As installed, the seat engagement of the first shelf angle engages the first seat with the web of the first shelf angle seated in the slot of the first seat. The seat engagement of the second shelf angle engages the second seat with the web of the second shelf angle seated in the slot of the second seat. The web of the second shelf angle extends downwardly of the foot of the second shelf angle.

In another aspect, an external facing support assembly has at least a mounting bracket, a first shelf angle and a second shelf angle. Each shelf angle is engageable with the mounting bracket for support thereby. The mounting bracket has a first portion with a mounting fitting by which to secure the assembly to a load-bearing wall structure. The mounting bracket has a second portion defining a leg standing outwardly from the first portion, the leg including a first seat and a second seat. Each seat is located distantly from the mounting fitting. As installed each the seat is spaced away from the load-bearing wall structure. The first seat is vertically spaced apart from the second seat. Each seat includes a vertical reaction interface, and a moment restraint. Each shelf angle has an external facing carrier and a seat engagement. The carrier is connected to the seat engagement. The external facing carrier includes a horizontally extending foot upon which to mount at least one masonry veneer member forwardly of the mounting bracket. The seat engagement includes a vertically extending web to which the foot is joined. On assembly, the seat engagement of the first shelf angle engages the first seat and the seat engagement of the second shelf angle engages the second seat. The at least one masonry veneer member is mounted on the foot forwardly of the mounting bracket defining a cavity between the at least one masonry veneer member and the mounting bracket. Mortar netting is positioned in the cavity.

In another aspect there is a mounting bracket for a shelf angle. It has a structural section has a back and a web. The back has a rearwardly facing surface. The leg stands forwardly away from the back. The back has a mounting fitting by which to secure the mounting bracket to supporting structure. The web has a forward margin distant from the back. The forward margin has a first portion located a datum distance away from the back. The forward margin includes a second portion defining a shelf angle seat. The shelf angle seat is located forwardly more distant from the back than the datum distance.

In a feature of that aspect, the mounting bracket defines a mortar net seat forwardly of the first portion. In another feature, the shelf angle seat has a portion lying in a vertical plane, against which a rearwardly-facing surface of an upright leg of a shelf angle abuts in use, and the portion of the shelf angle seat lies in a vertical plane that is forward of the first portion of the forward margin of the leg of the mounting bracket. In another feature, the shelf angle seat includes a vertically extending slot, and the vertically extending slot is located forwardly of the first portion of the forward margin of the leg. In still another feature, the leg includes a finger extending forwardly of the first portion of the margin. The finger defines a retainer that, in use, locates forwardly of an upright leg of the shelf angle. In an additional feature, the finger has a forward margin most distant from the back, and the mounting bracket defines a mortar net seat in a space forwardly of the first portion of the forward margin, between the first portion of the first margin and the forward margin of the finger. In yet another feature, the leg of the mounting bracket includes a retainer that extends forwardly of the first portion of the forward margin. The forward margin has a second portion that is tapered from the first portion to the retainer. In another feature the mounting bracket is more than twice as tall as the shelf angle seat. In another feature, the first portion of the forward margin of the leg has a greater vertical extent than does the shelf angle seat. In a further feature, in combination with a shelf angle and a support structure to which the mounting bracket is secured, the support structure is a floor slab, the mounting bracket extends at least one of (a) upwardly proud of the floor slab; and (b) downwardly proud of the floor slab. In still another feature, the shelf angle seat is located one of (a) upwardly of the floor slab; and (b) downwardly of the floor slab.

In another feature, the shelf angle is mounted to the bracket and has masonry veneer installed on the shelf angle. A mortar net is trapped between the masonry veneer and the first portion of the forward margin of the leg. In another feature, the mounting bracket has the form of a channel section in has two the legs extending away from the back in mutual opposition. In a further feature, the mounting bracket both upper and lower shelf angle mounting seats. In an additional feature, both the upper and lower shelf angle seats are located forwardly of the first portion of the margin of the first leg.

In another aspect, there is a shelf angle mounting bracket. It has a channel-shaped section that has a back, a first leg extending away from the back, and a second leg extending away from the back. The first and second legs are mutually opposed. The first leg and the second leg have respective feet bent to form respective first and second tabs by which to secure the shelf angle mounting bracket to supporting structure. The channel-shaped section has at least a first portion of a first shelf angle mounting seat formed in at least the first leg distant from the back.

In a feature, the respective first sand second tabs are bent to be co-planar. In another feature, the tabs have mounting fittings therein. In a further feature, the back is truncated shy of the tabs. In still another feature, the shelf angle mounting bracket includes only one of (a) a vertical load receiving interface; and (b) a moment couple resisting interface. In another feature the first leg and the second leg stand in opposed vertical planes. The first leg has a profile formed therein to define an upwardly extending slot in which to receive an end of an upright leg of the shelf angle. The second leg has a profile formed therein to define an upwardly extending slot in which to receive an end of an upright leg of the shelf angle. The tabs of the first and second legs are coplanar and have respective mounting fittings. The back is truncated shy of the tabs. In another feature, when seated on a flat surface, part of the shelf angle locates within the portion of the shelf angle mounting seat, and another part of the shelf angle engages the flat surface. In another feature, when mounted in in combination with a shelf angle and a beam, the mounting bracket forms the first portion of the self angle seat, and the beam forms a second portion of the shelf angle seat.

In another aspect, there is a shim for a shelf angle bracket. The shelf angle bracket has a back and a pair of legs extending forwardly of the back in mutual opposition. The back has a mounting fitting slot defined therein. The slot extends on an oblique angle. The shim has a plan form conforming to the back, and has a corresponding slot formed therein. The slot has an open end. In a feature of that aspect, the shim is made of a thermal insulator, or is coated in a thermally insulating coating.

In another aspect there is a shelf angle bracket, a shelf angle, a shim, and a locking bar. The shelf angle bracket has channel-shape having a back, a first leg extending away from the back, and a second leg extending away from the back. The first and second legs are mutually opposed. The legs have respective arrays of apertures and diagonal struts. The first and second legs have respective shelf angle seats defined therein. The shelf angle has a horizontal leg extending forwardly of the mounting bracket, upon which to install masonry veneer, and a vertical leg. The vertical leg is located in the respective shelf angle seat or seats. The respective seat or seats of the shelf angle seat include an installation lobe. The locking bar is inserted in the installation lobe. The back is rectangular. The back has an oblique slot formed therein to define a mounting fitting. The shim conforms to the rectangular form of the back. The shim has an oblique slot formed therein. The oblique slot in the shim is open at one end.

In another aspect, there is a structural beam and a shelf-angle support bracket for co-operation therewith, and one of (a) the structural beam has a first vertical web; the first vertical web has a relief defined therein, the relief has a wide portion and a narrow portion adjoining the wide portion; the shelf angle support bracket has a mounting fitting and mounting hardware; the mounting hardware has a head, the wide portion of the relief admitting entry of the head, and the narrow portion preventing passage of the head; (b) the structural beam has a first vertical web and a second vertical web spaced apart therefrom; the first vertical web has a first opening defined therein; the second vertical web has a second opening defined therein, the second opening is aligned with the first opening and is larger than the first opening; the shelf angle support bracket mounts to the first vertical web and the shelf angle support bracket has a mounting fitting co-operable with the opening in the first vertical web; there is a mechanical fastener has a shaft and a nut or head; the first opening admits the shaft and obstructs the nut or head; the second opening admits the shaft and the nut or head; and (c) the structural beam has a first vertical web; a load spreader is mounted to the first vertical web; a mounting fitting is secured to the load spreader; and the shelf angle support bracket is mounted to the mounting fitting of the load spreader.

In another aspect there is a shelf angle support mounting bracket. The mounting bracket has a channel-shaped structural member that has a back, a first leg and a second leg. The first leg and the second leg extend forwardly away from the back and are mutually opposed. The first and second legs have respective shelf angle seats defined therein. The shelf angle seats are distant from the back. The back has an extending member. The extending member is bent rearwardly away from the back. The rearwardly extending member has an attachment fitting. The attachment fitting is more distant from the back than are the shelf angle seats.

In a feature of that aspect, the legs have respective arrays of lightening openings and struts defined therein. In another feature, the shelf angle support mounting bracket is combined with a reinforced concrete structural member. The shelf angle mounting bracket mounts to the reinforced concrete structural member. The reinforced concrete structural member has at least a first reinforcement bar therewithin. The back of the channel shaped structural member faces the reinforced concrete member. The attachment fitting engages the reinforced concrete member at a location that is more distant from the back of the channel shaped member than is the first reinforcement bar.

Another feature combines a shelf angle mounting bracket and a reinforced concrete structural member as above in which the shelf angle mounting bracket extends one of (a) upwardly proud of the reinforced concrete structural member; and (b) downwardly product of the reinforced concrete structural member; and the respective shelf angle seats of the legs are located correspondingly one of (a) downwardly of and (b) upwardly of, the reinforced concrete structural member, and a shelf angle mounted in the respective shelf angle seats presents a supporting surface for masonry veneer that is also correspondingly one of (a) upwardly of, and (b) downwardly of, the reinforced concrete structural member.

Another feature combines the shelf angle mounting bracket and a beam member by which the shelf angle mounting bracket is supported. The beam member has a vertical web and a flange surmounting the vertical web. The rearwardly extending member overlies the flange. The mounting fitting of the shelf angle mounting bracket engages the flange. In another feature, a mechanical fastener engages the mounting fitting and penetrates the flange. In another feature, the mounting fitting engages the flange at a location that is more distant from the back of the channel shaped section than is the web of the beam member.

In another aspect there is a shelf angle support bracket. It has a channel-shaped structural member that has a back, a first leg and a second leg. The first leg and the second leg extend forwardly away from the back and are mutually opposed. The first and second legs have respective shelf angle seats defined therein. The shelf angle seat is distant from the back. The back has an extending member. The extending member of the back is bent rearwardly away from the back. The rearwardly extending member has an attachment fitting. At least the first leg has a first rearwardly extending abutment that stands rearwardly proud of the back, and that defines a vertical shear load transfer interface.

In a feature, the rearwardly extending attachment fitting defines a moment couple reaction interface. The second leg has a second the rearwardly extending abutment. The rearwardly extending abutments are located in respective regions of the legs that are upwardly of the shelf angle seats. The abutments stand upwardly proud of the extending member of the back. In another feature, the beam has an upwardly facing surface. The first abutment transfers shear into the upwardly facing surface of the beam. The attachment fitting of the rearwardly extending member of the back defines a retainer attached to the upwardly facing surface of the beam. The retainer is operable to prevent the first abutment from disengaging from the upwardly facing surface. In an additional feature, the beam has a web and a flange. The flange defines the upwardly facing surface. The second leg has a second abutment space apart from the first abutment. The first and second abutments transfer shear load into the flange at a margin of the flange. The attachment fitting of the extension of the back of the channel-shaped section is attached to the flange. The extension of the back over-reaches the flange more distantly from the back of the channel-shaped section than do the first and second abutments. In a still further feature, the beam has an upper flange and a lower flange. The abutments seat upon the upper flange. The mounting bracket has at least one abutment that reacts against the lower flange of the beam.

In another aspect, there is a structural support assembly upon which to mount masonry veneer. The structural support assembly includes a shelf angle; a shelf angle mounting bracket; and a brace. The shelf angle mounting bracket has a back and a leg extending forwardly away from the back. The leg has a shelf angle seat defined therein, the shelf angle locating in the shelf angle seat on installation. The back has a rearwardly facing surface has a first mounting fitting by which to secure the shelf angle support bracket to supporting structure. The back has a second mounting fitting by which the brace is secured to the shelf angle support bracket. The second mounting fitting is separated from the first mounting fitting be a moment arm distance. The brace has a footing by which the brace is secured to the supporting structure distantly from the first fitting.

In a feature of that aspect, the brace defines a diagonal strut. In another feature, the supporting structure defines an overhang; the first fitting secures to an end of the overhang; and the first footing of the brace secures under the overhang. In an additional feature, the shelf angle support bracket extends downwardly proud of the overhang, and the shelf angle seat depends from the overhang.

In another aspect there is a masonry veneer shelf angle support bracket assembly. It includes a channel-shaped member that has a back and first and second legs extending forwardly from the back in mutual opposition. The first and second legs have a shelf angle seat defined therein distant from the back. A load spreader has a first member and a second member. The first member defining a transversely extending vertical load output interface. The second member defining an upwardly extending vertical load input interface. The channel-shaped member has an output fitting co-operably engaged to the vertical load input interface of the load spreader.

In a feature of that aspect, the channel-shaped member has a width measured across the legs, and the load spreader has a length transverse to the channel-shaped member that is greater than the width. In another feature, the load spreader is an angle iron has an upright leg and a horizontal leg, the horizontal leg is welded to a supporting beam, and the back of the channel-shaped member is releasably attached to the upright leg.

In another aspect there is a support bracket for use in the mounting of masonry veneer. It has a structural member that has a back and a first leg extending forwardly from the back. The back has a fitting by which to secure the back to supporting structure located rearwardly thereof. The leg has a shelf angle seat defined therein distant from the back. The leg has a portion thereof has at least two apertures formed therethrough. In use, the apertures accommodate rods that pass through an array of bricks.

In a feature, the apertures are spaced in a horizontal array. In an alternate feature, the apertures are spaced in a vertical array. In another feature, the apertures are located upwardly of the shelf angle seat. In another alternate feature, the apertures are located downwardly of the shelf angle seat. In another feature, there is a first array of the apertures lower than the shelf angle seat, and a second array of apertures higher than the shelf angle seat. In a further feature, the structural member includes a second leg extending forwardly of the back. The first and second legs are mutually opposed. The first and second legs are asymmetric. In an additional feature, the first leg includes an extension has the array of apertures formed therein. In another feature, the extension has a profile that is smaller than three sides of a brick mounted thereto, whereby bricks mounted to the extension hide the extension. In still another feature, including another support bracket of opposite hand, those support brackets being spaced apart sideways, a shelf angle is mounted to span the respective shelf angle seats of the support brackets. A set of rods extends between, and through, the respective apertures of the support brackets. Brickwork is mounted to the shelf angle, and brickwork is mounted to the rods. In another feature, the brickwork mounted to the shelf angle has a different orientation from brickwork mounted to the rods. In another feature, the brickwork mounted to the shelf angle and the brickwork mounted to the rods is positioned at least partially to conceal the support brackets from at least one of (a) above; and (b) below. In a further feature, the extension is a separate part from the structural member, and is mechanically mounted to the structural member.

BRIEF DESCRIPTION OF THE ILLUSTRATIONS

Figure 1B:
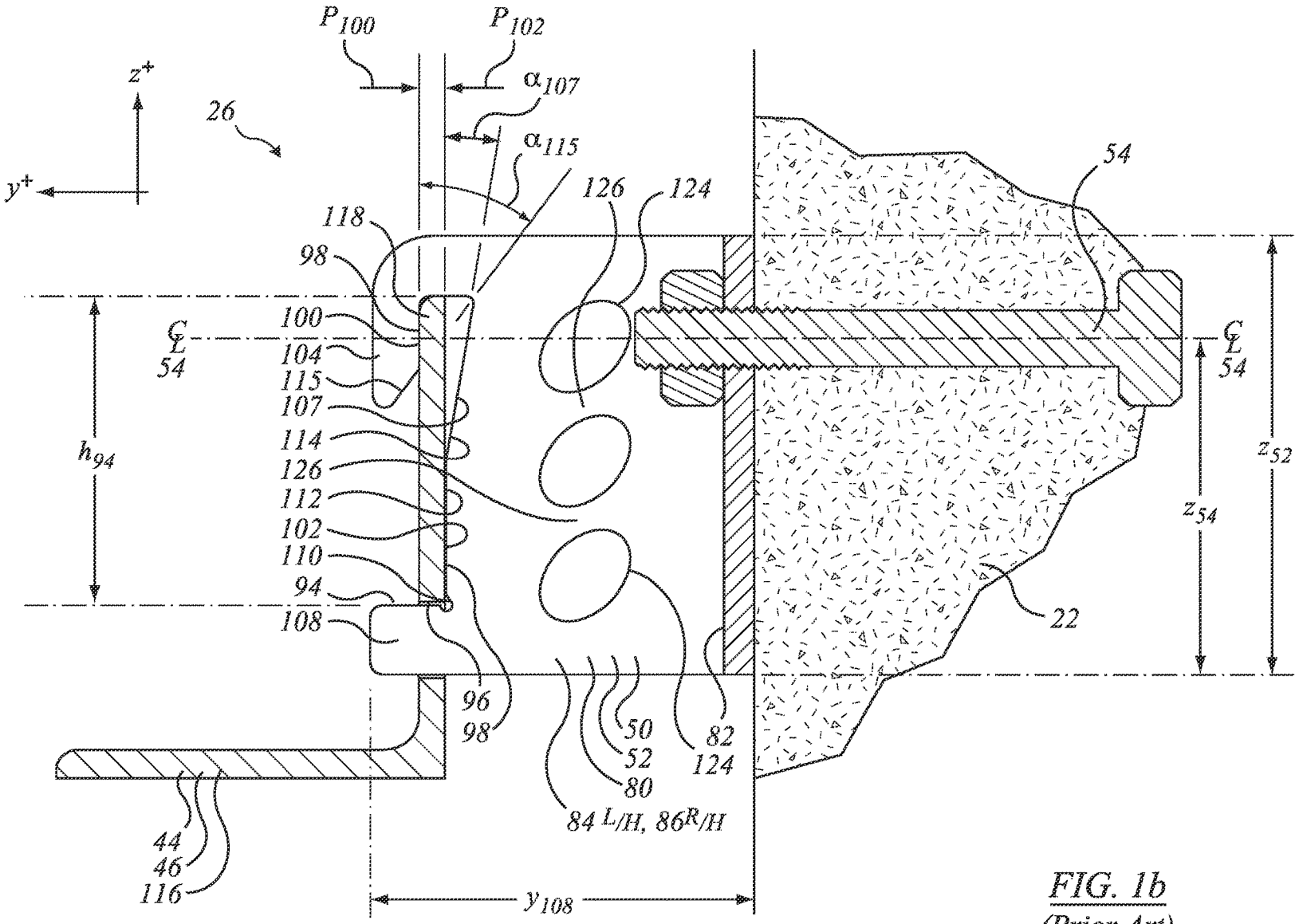
FIG. 1b (Prior Art)

The foregoing aspects and features of the invention may be explained and understood with the aid of the accompanying illustrations, in which:

FIG. 1*a* is a side view in section of a general arrangement of an assembly of wall elements according to an embodiment;

FIG. 1*b* is an enlarged detail of an arrangement similar to the general arrangement of FIG. 1*a;*

Figure 1C:
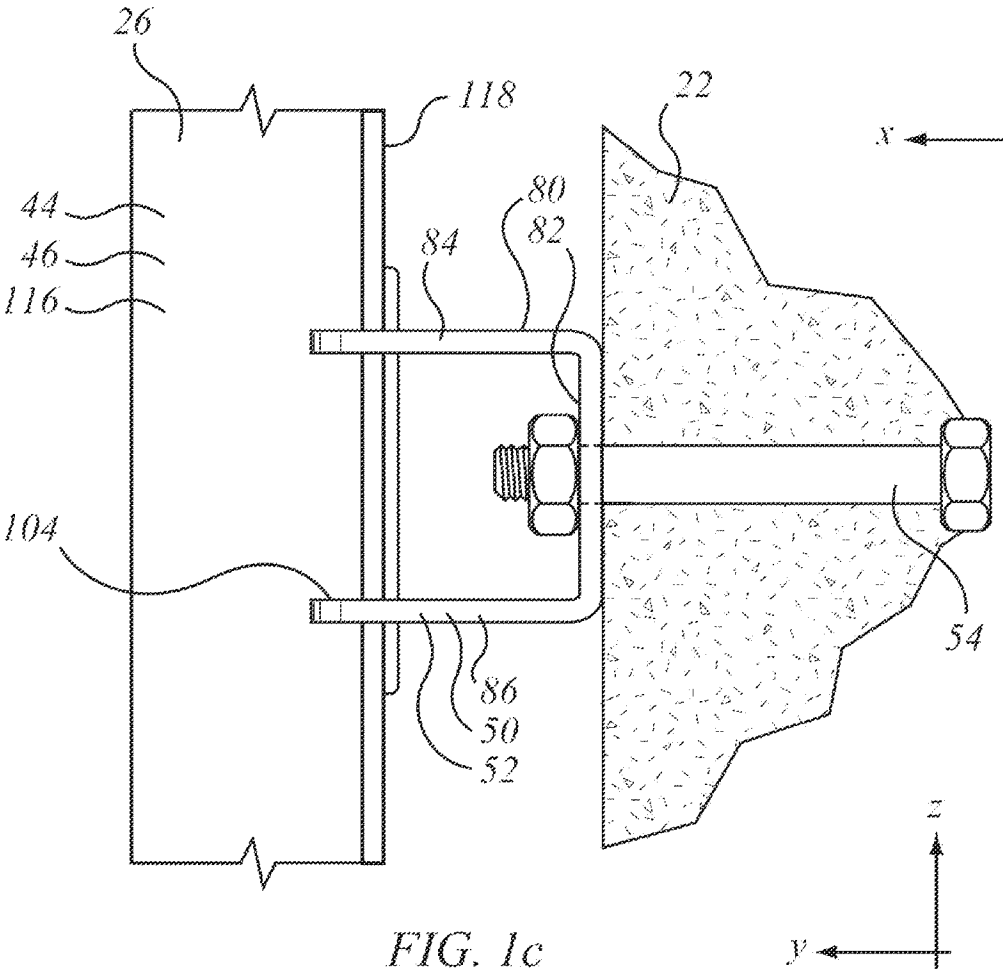
FIG. 1c (Prior Art)

FIG. 1*c* is a top view of the elements of the enlarged detail of FIG. 1*b;*

Figure 2C:
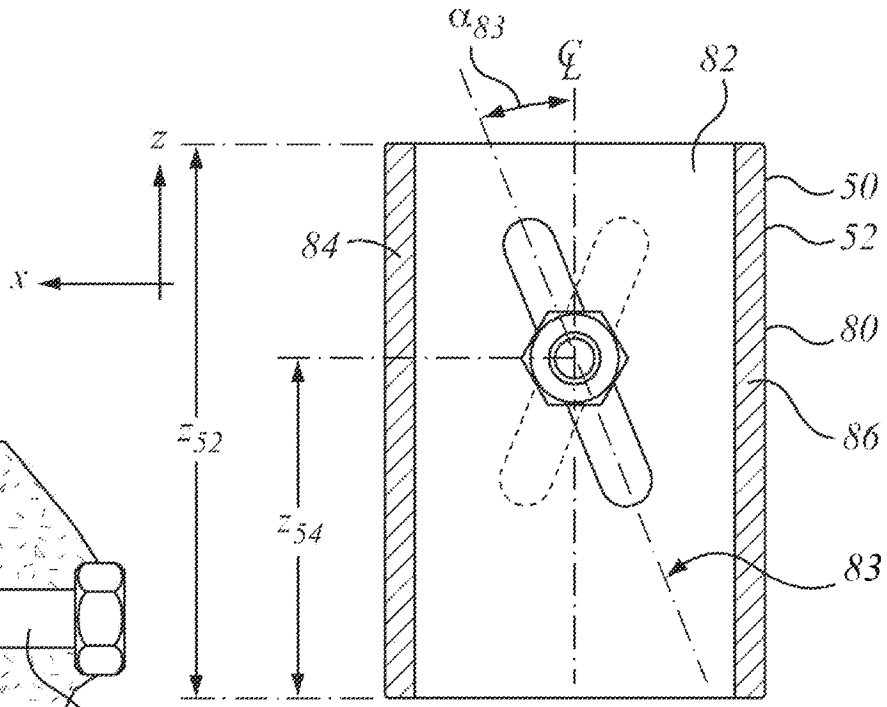
FIG. 2c (Prior Art)
Figure 2B:
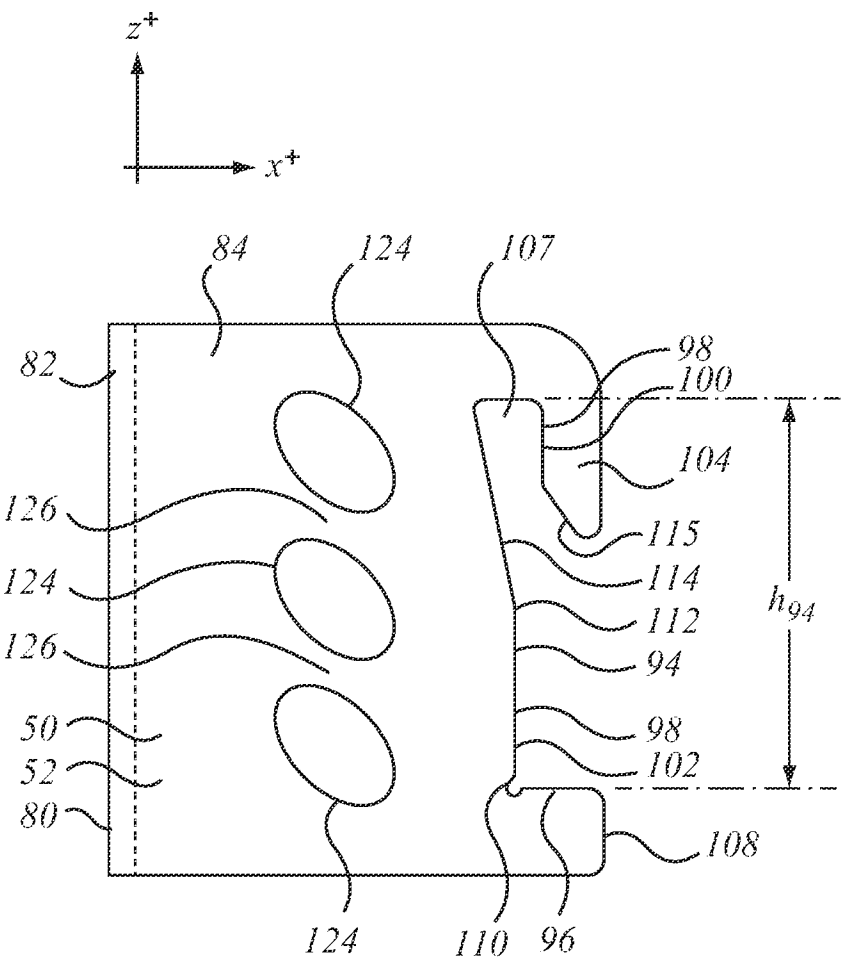
FIG. 2b (Prior Art)
Figure 2A:
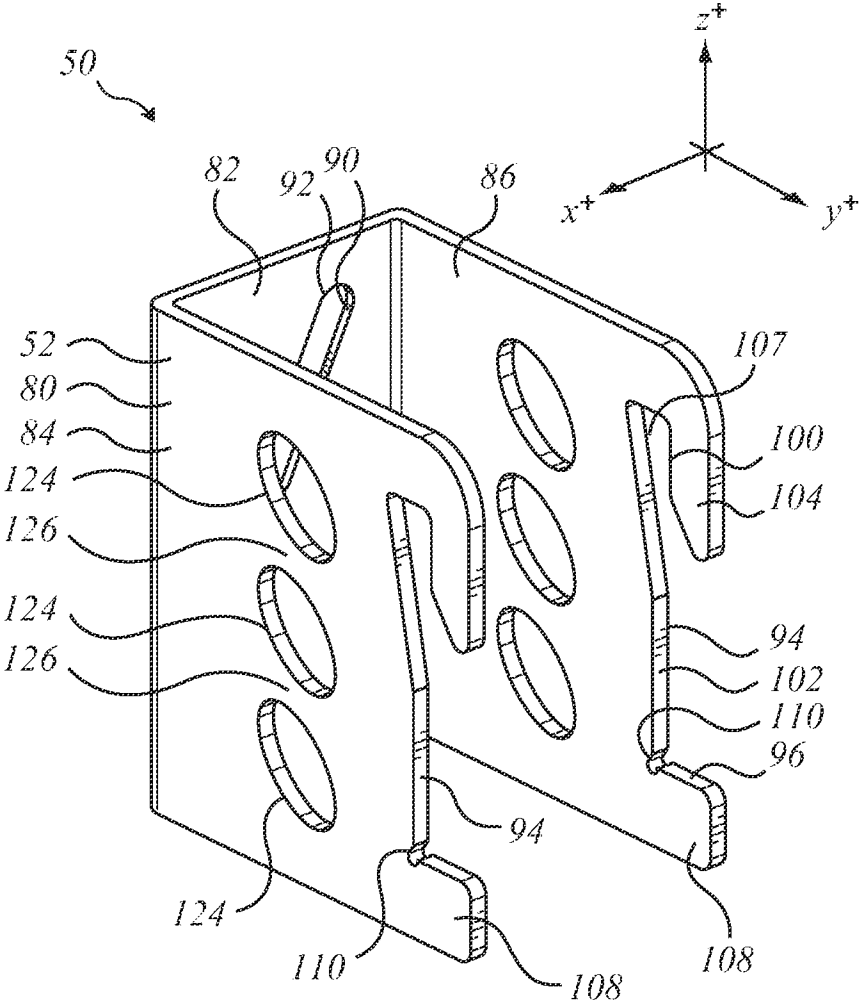
FIG. 2a (Prior Art)

FIG. 2*a* is an isometric view of structure of the assembly of FIG. 1*a;*

FIG. 2*b* is a side view of the structural element of FIG. 2*a;*

FIG. 2*c* is a front view of structural element of FIG. 2*a;*

Figures 3A, 3B, 3C:
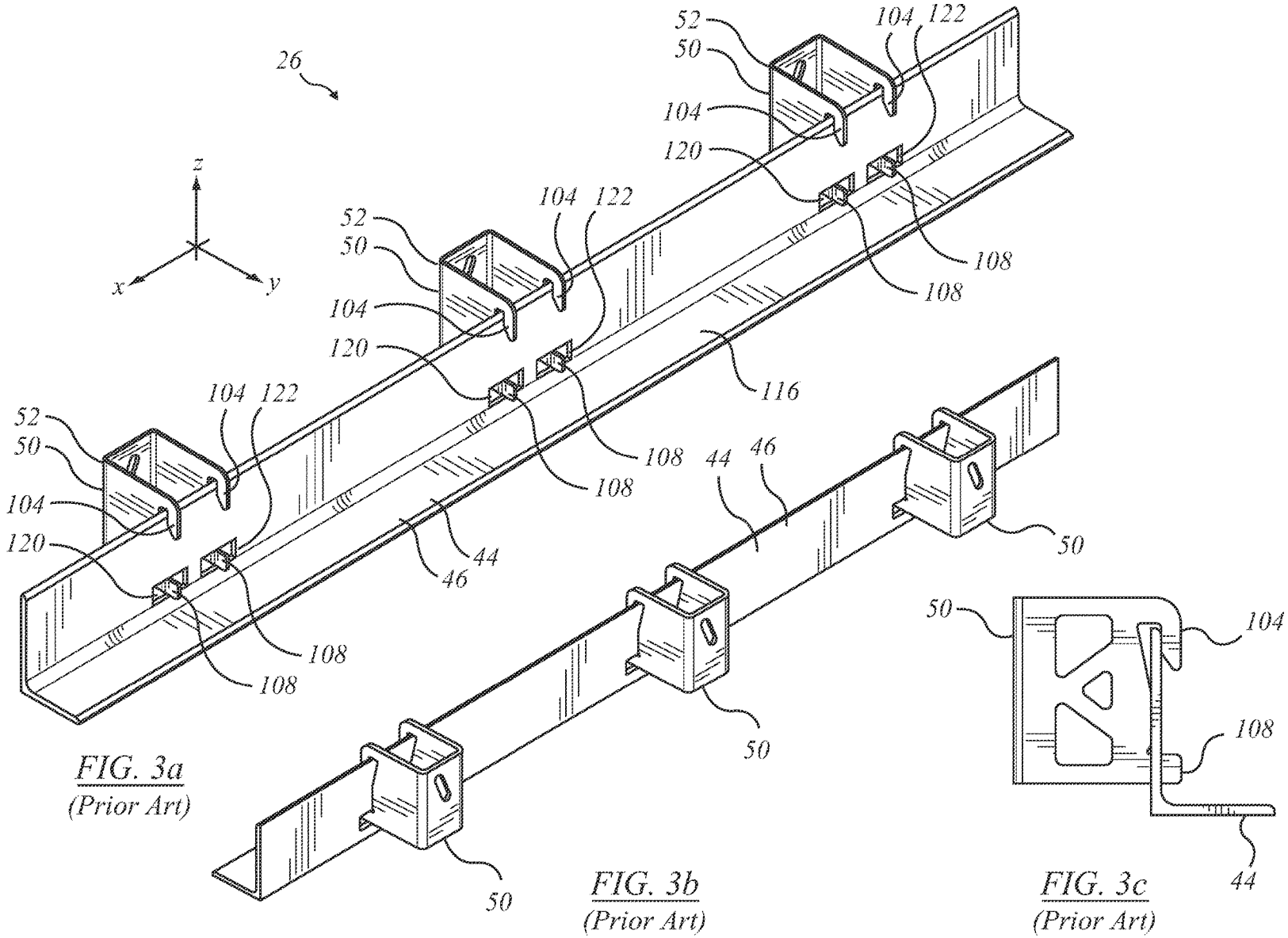
FIG. 3a (Prior Art)
FIG. 3b (Prior Art)
FIG. 3c (Prior Art)

FIG. 3*a* is an isometric view of structure of the assembly of FIG. 1*a*, without associated wall members from in front, to one side, and above;

FIG. 3*b* is an isometric view of the structural elements of FIG. 3*a* viewed from behind, to the other side, and above;

FIG. 3*c* is an end view of elements of FIG. 3*a;*

Figure 3D:
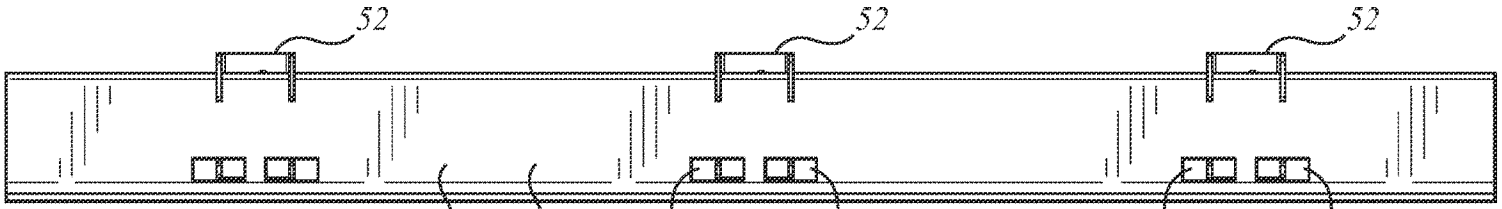
FIG. 3d (Prior Art)

FIG. 3*d* is a front view of the assembly of FIG. 3*a;*

Figure 3E:
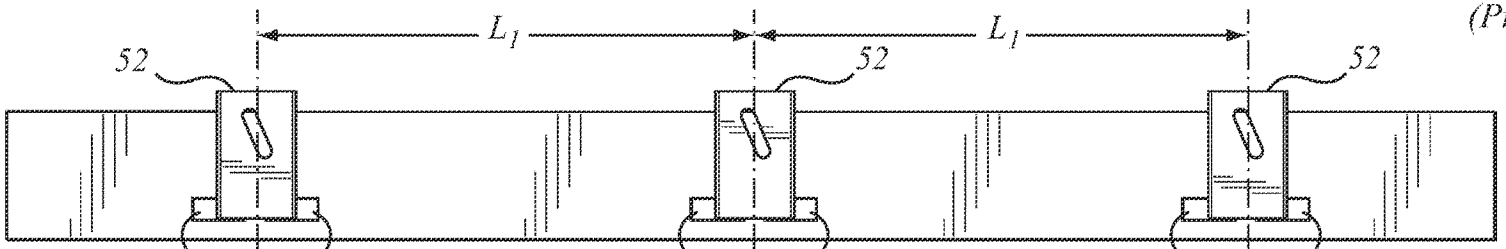
FIG. 3e (Prior Art)

FIG. 3*e* is a rear view of the assembly of FIG. 3*a;*

Figure 4A:
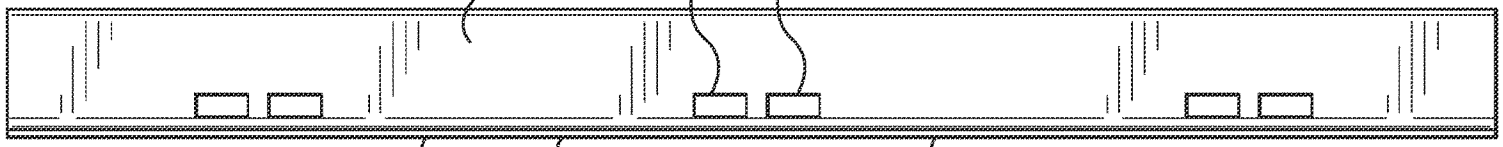
FIG. 4a (Prior Art)

FIG. 4*a* is a front view of a structural element of the assembly of FIG. 1*a;*

Figure 4B:
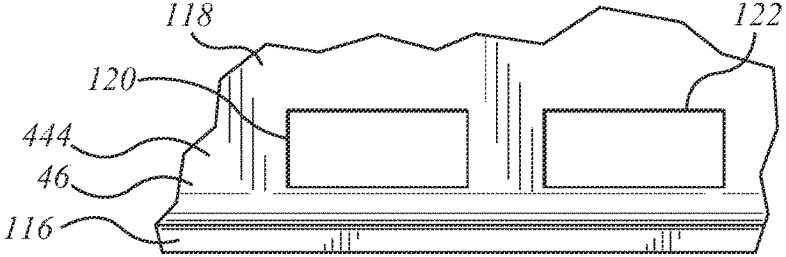
FIG. 4b (Prior Art)

FIG. 4*b* is an enlarged detail of the structural element of FIG. 4*a.*

Figure 5B:
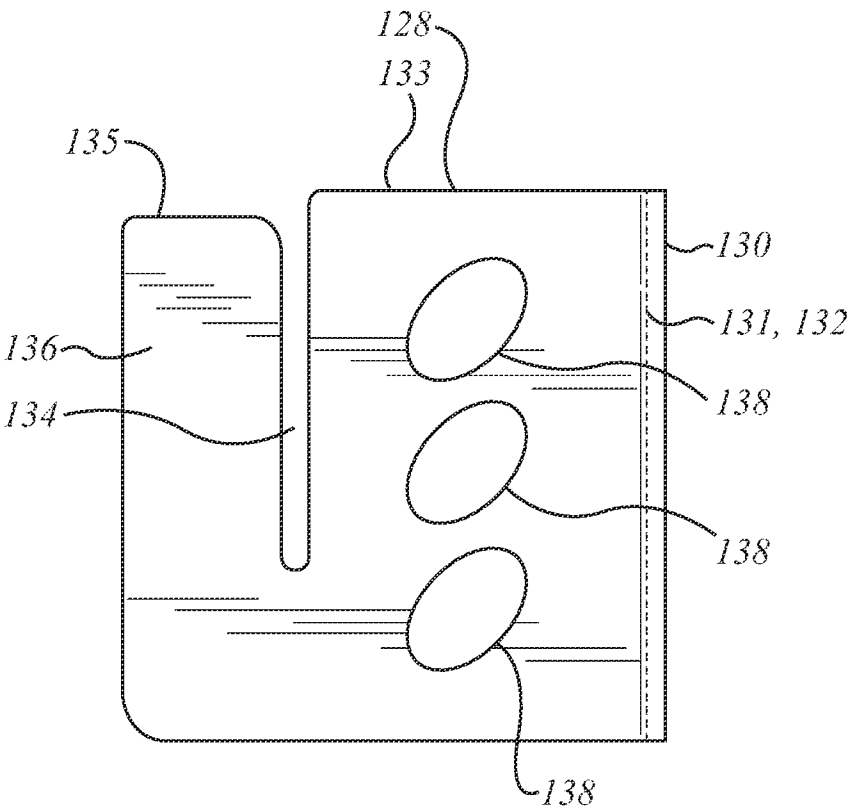
FIG. 5b (Prior Art)
Figure 5A:
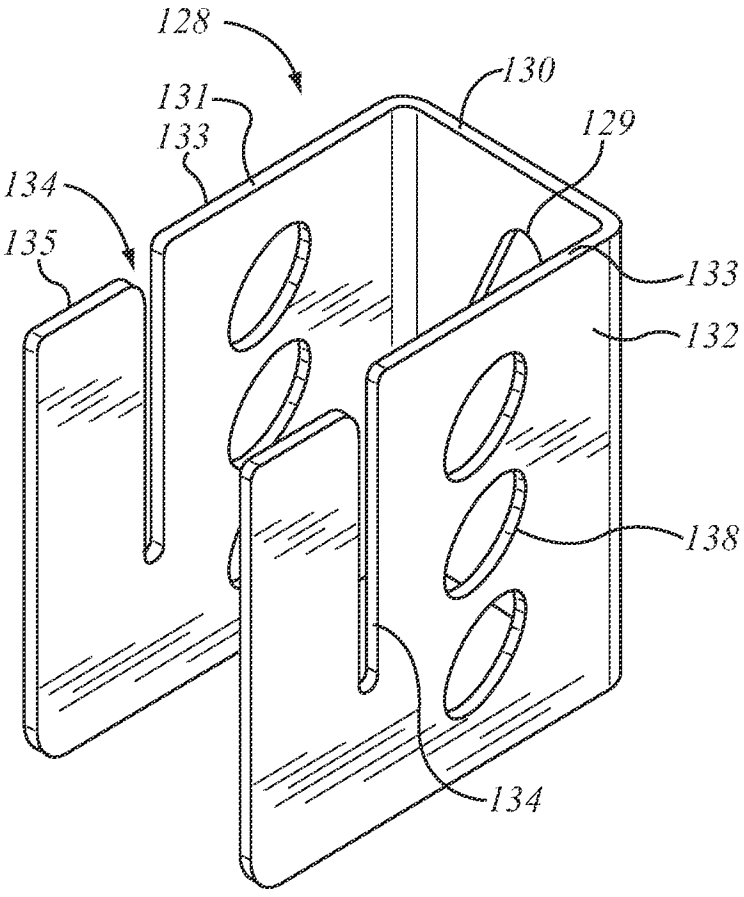
FIG. 5a (Prior Art)

FIG. 5*a* is an isometric view of an alternate embodiment of support bracket to that of FIG. 2*a;*

FIG. 5*b* is a side view of the support bracket of FIG. 5*a;*

Figure 6B:
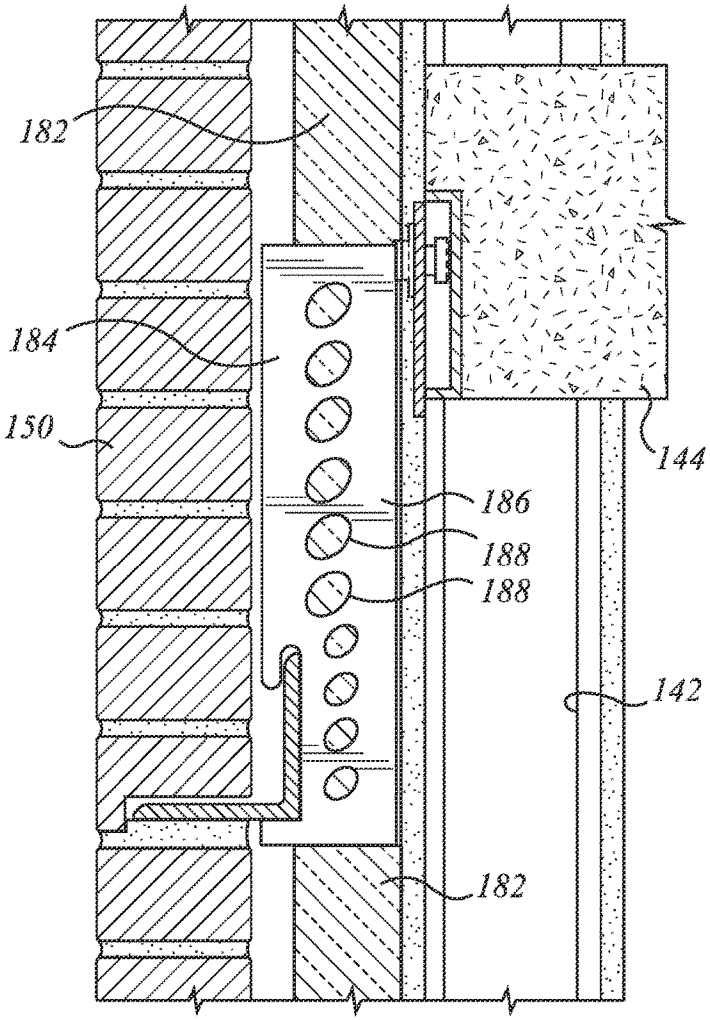
FIG. 6b (Prior Art)
Figure 6A:
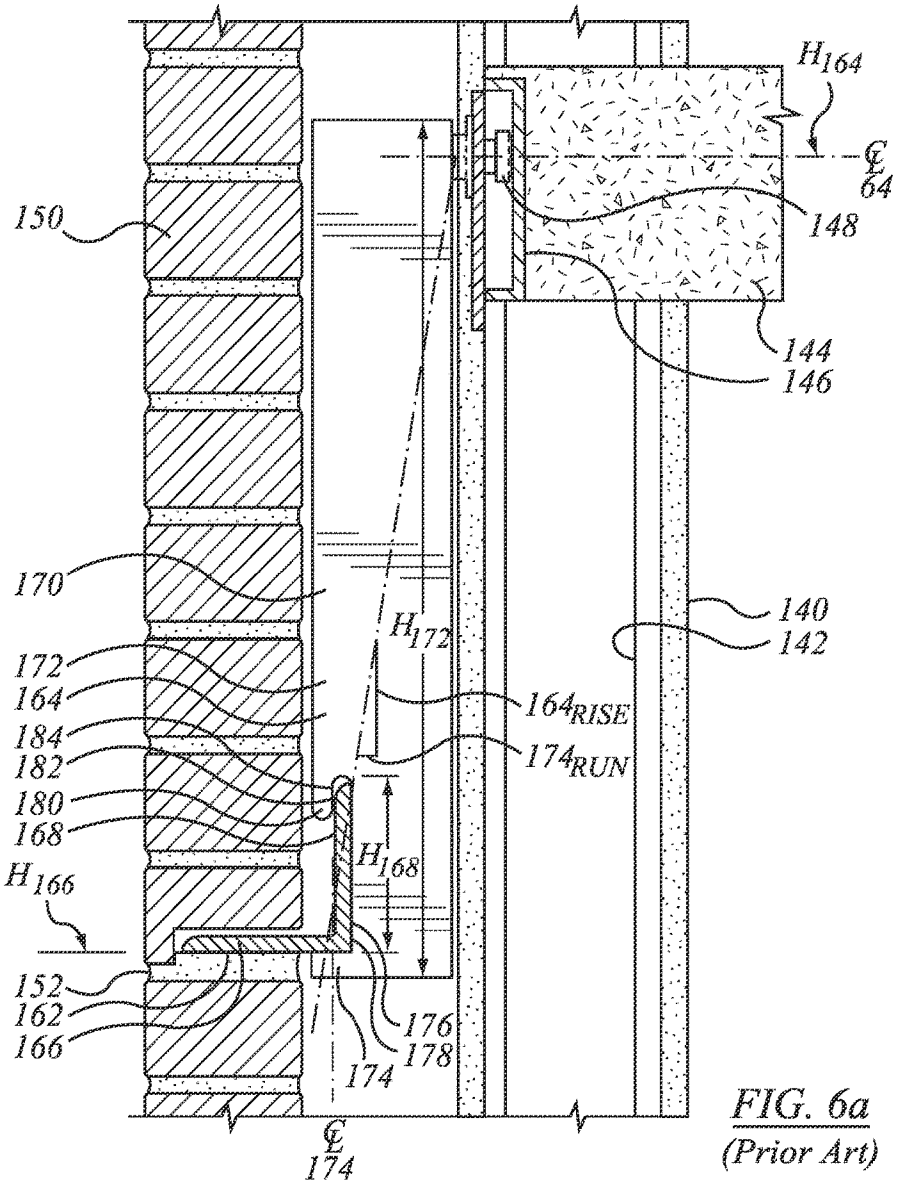
FIG. 6a (Prior Art)

FIG. 6*a* is a side view of an alternate assembly to that of FIG. 1*a;*

FIG. 6*b* is a side view of an alternate assembly to that of FIG. 6*a;*

Figure 6D:
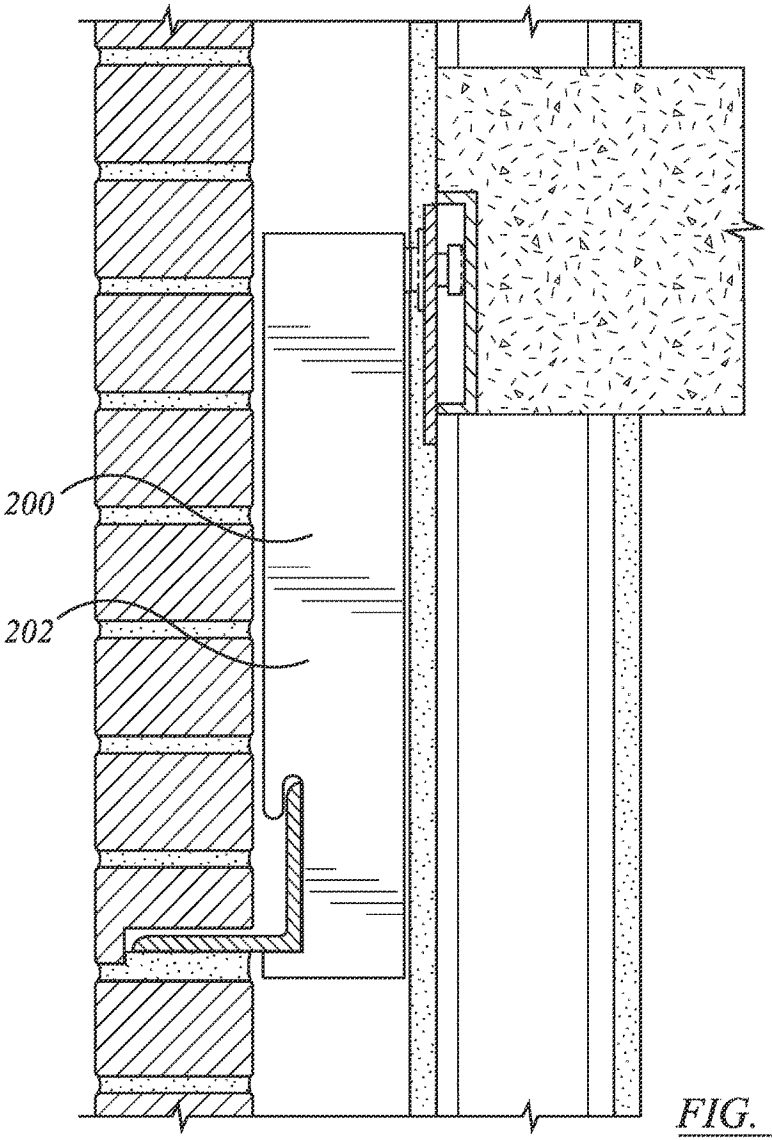
FIG. 6d (Prior Art)
Figure 6C:
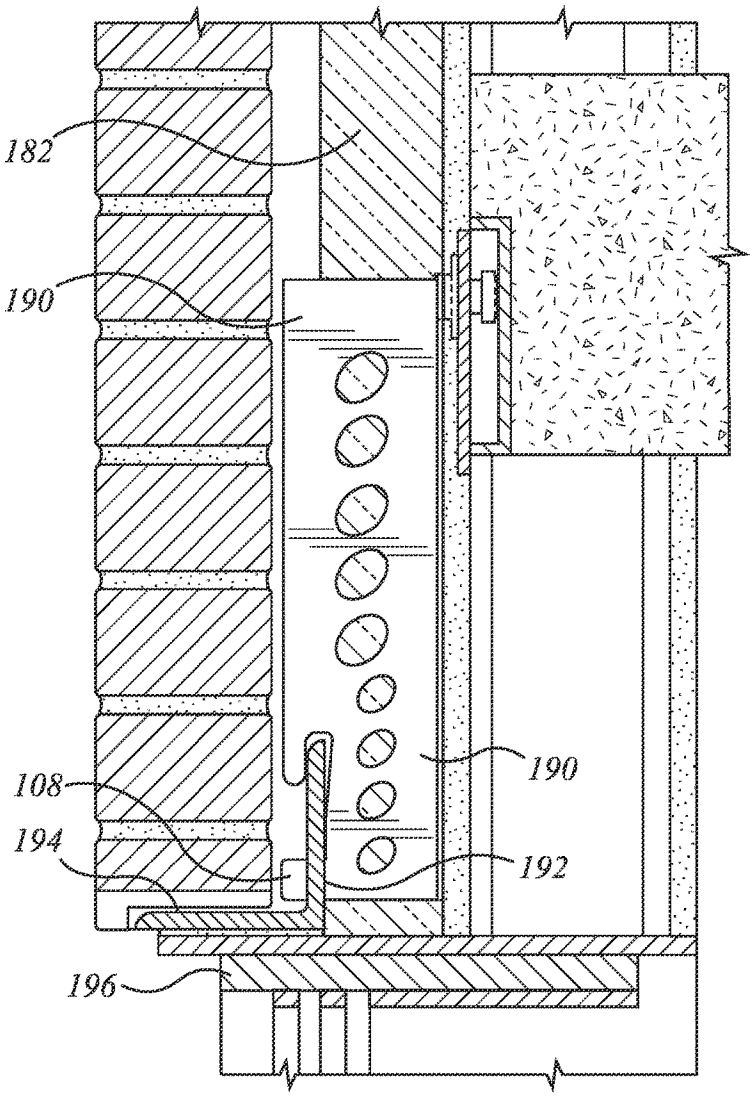
FIG. 6c (Prior Art)

FIG. 6*c* is a side view of another alternate assembly to that of FIG. 6*a;*

FIG. 6*d* is a side view of a further alternate assembly to that of FIG. 6*a;*

Figures 7A, 7B, 7C:
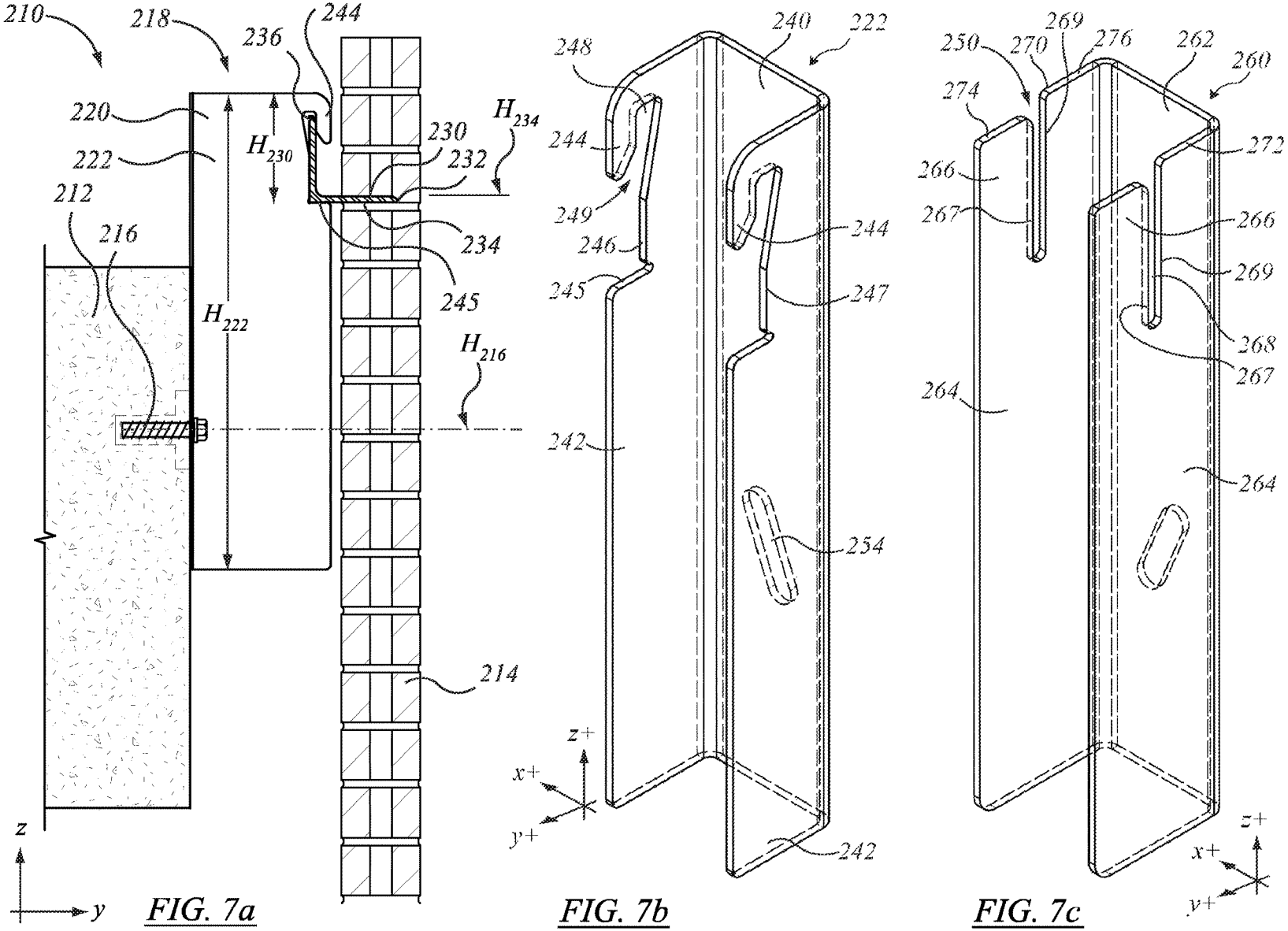

FIG. 7*a* is a side view in section of a general arrangement of an assembly of wall elements different from the arrangement of FIG. 6*a;*

FIG. 7*b* is an isometric view of structure of the assembly of FIG. 7*a;*

FIG. 7*c* is an isometric view of alternate structure to that of FIG. 7*b;*

Figure 8A:
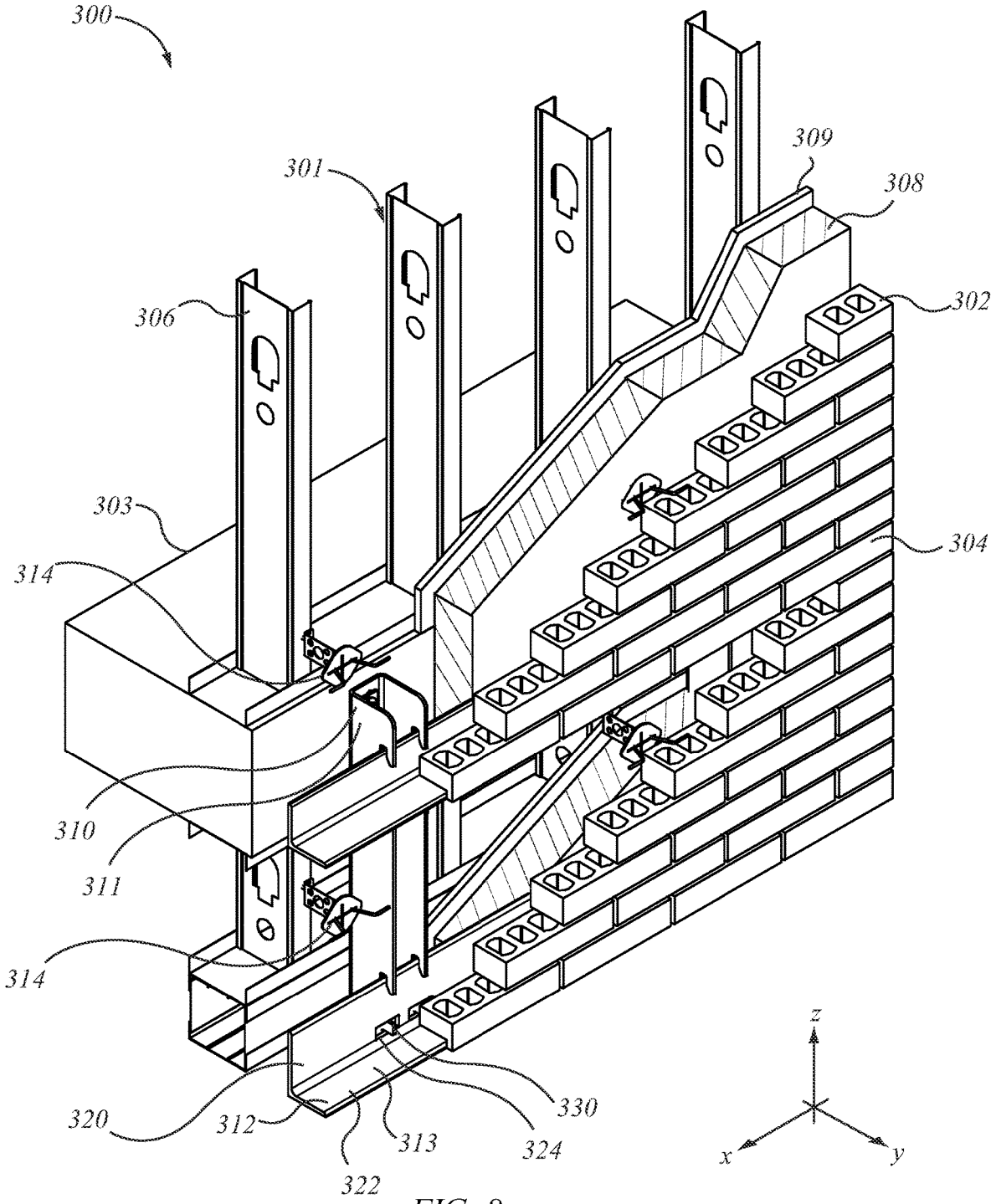

FIG. 8*a* is an isometric general arrangement scab view of an assembly of wall elements different from the arrangement of FIG. 1*a;*

Figure 8B:
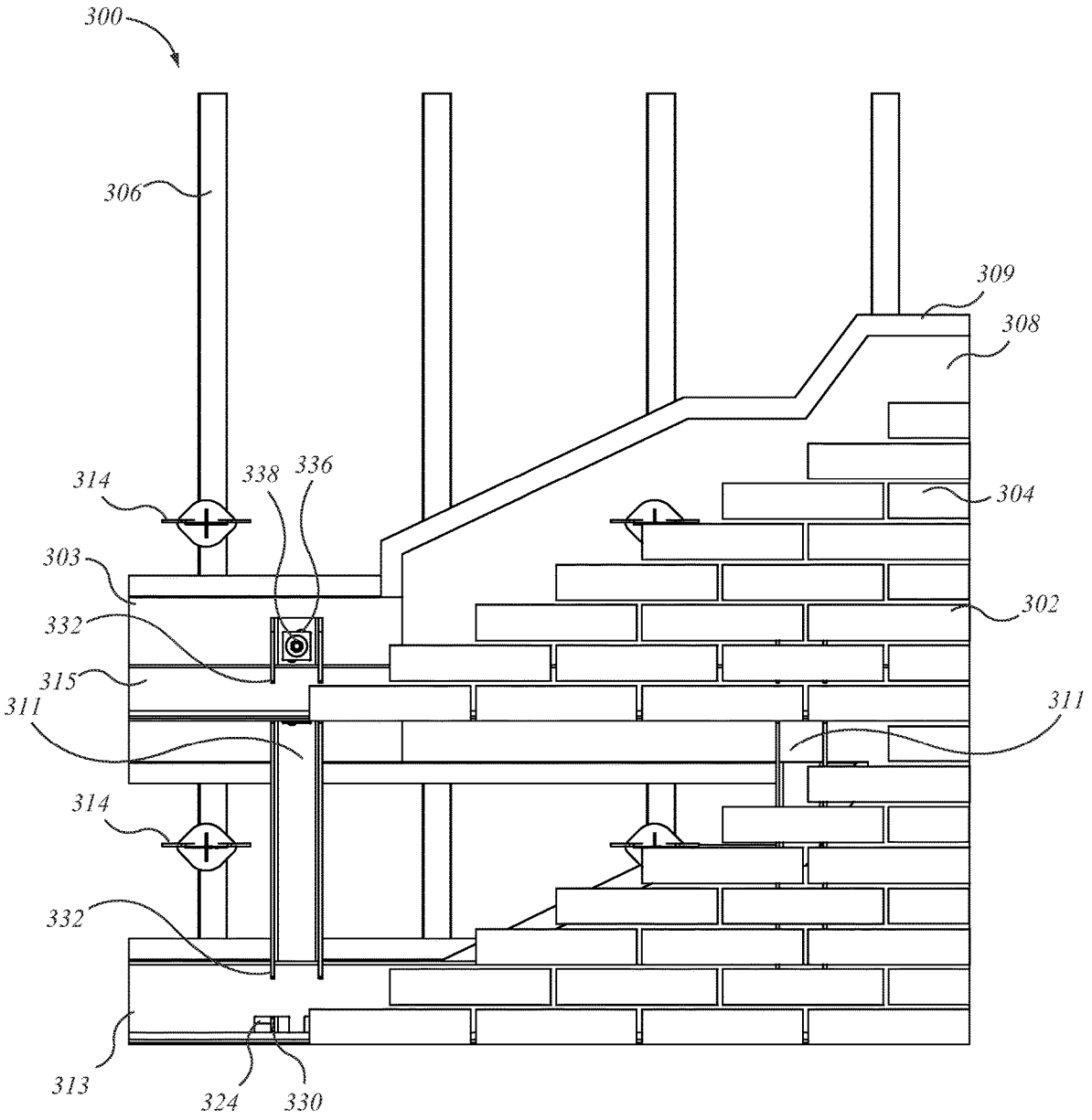

FIG. 8*b* is a front view of the assembly of FIG. 8*a;*

Figure 8C:
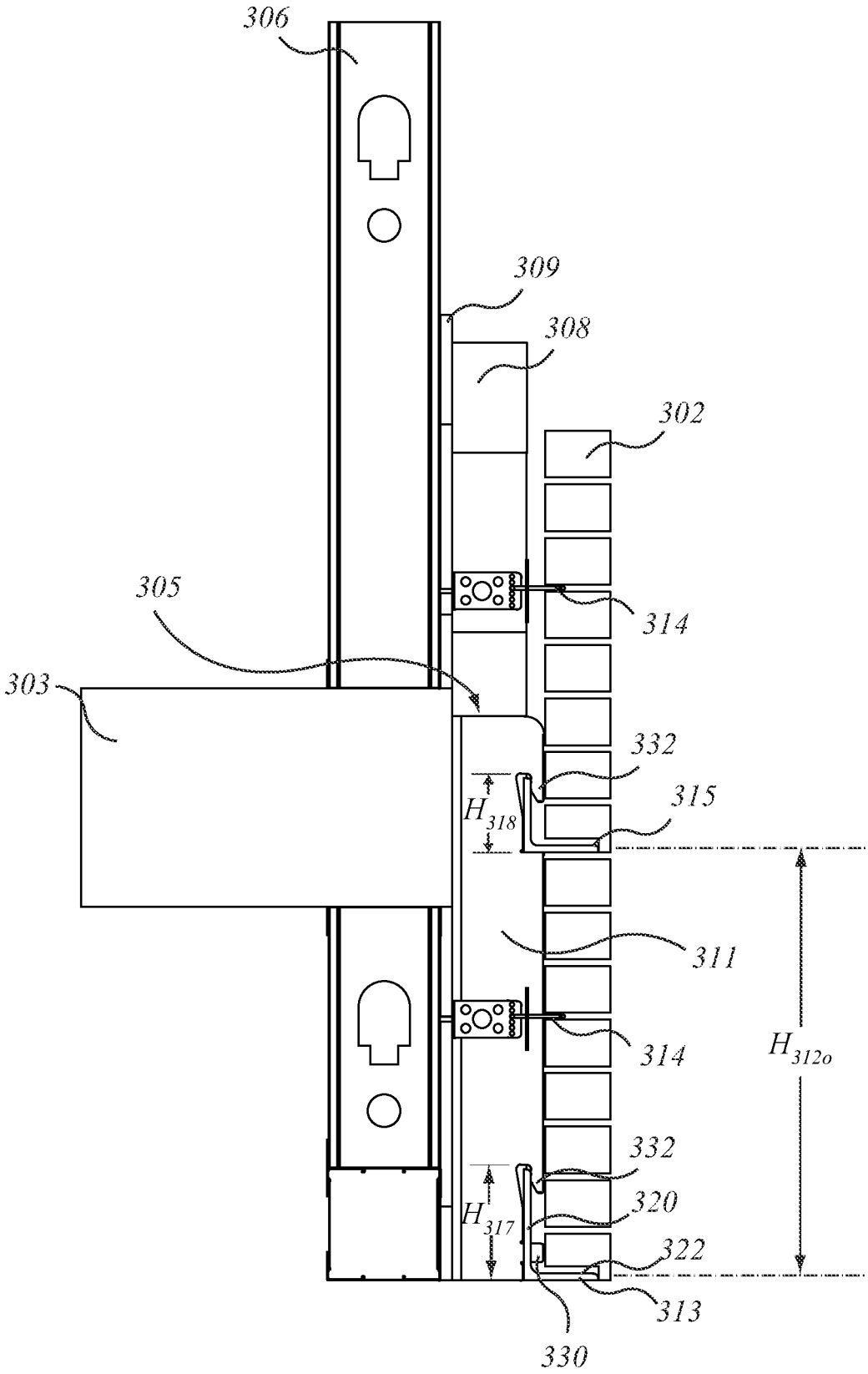

FIG. 8*c* is a side view in section of the assembly of FIG. 8*a;*

Figure 8E:
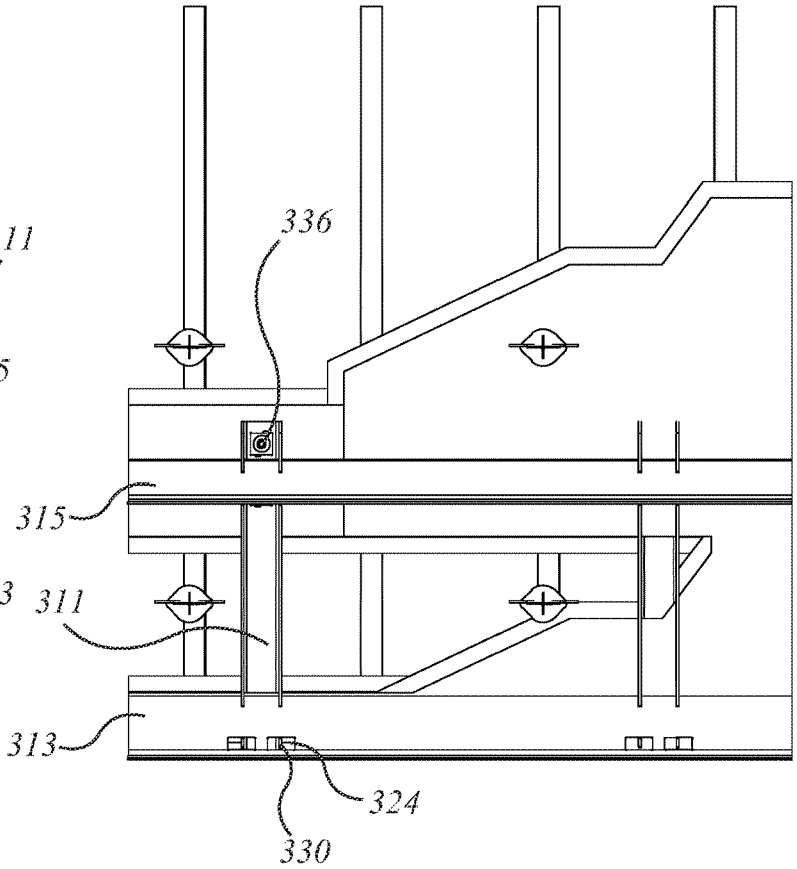
Figure 8D:
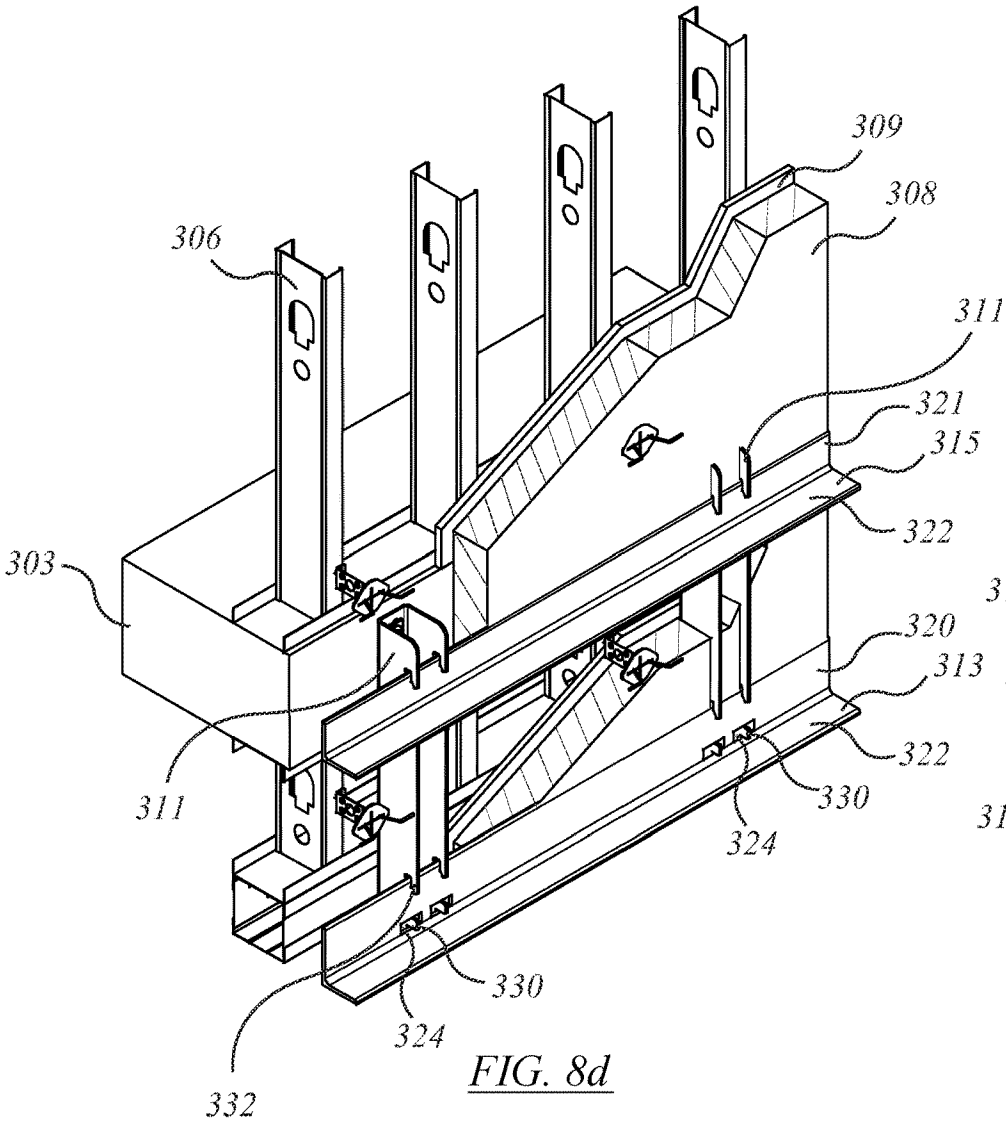
Figure 8G:
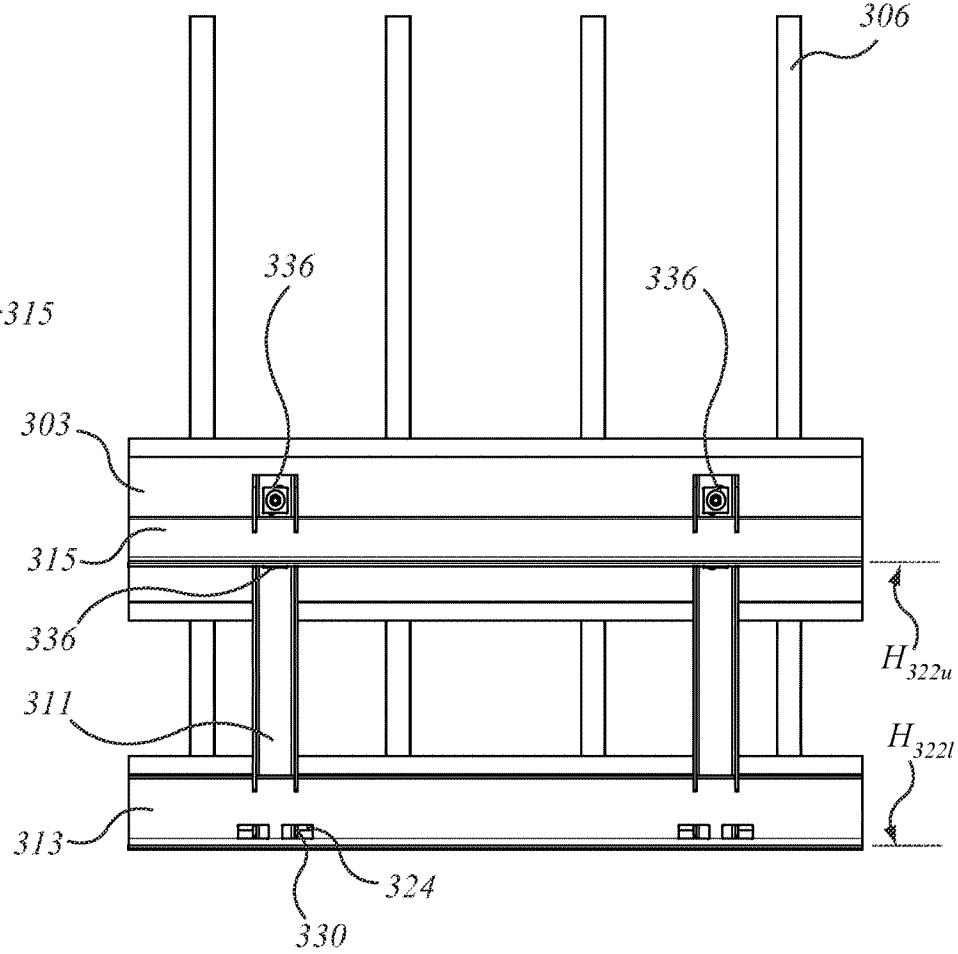
Figure 8F:
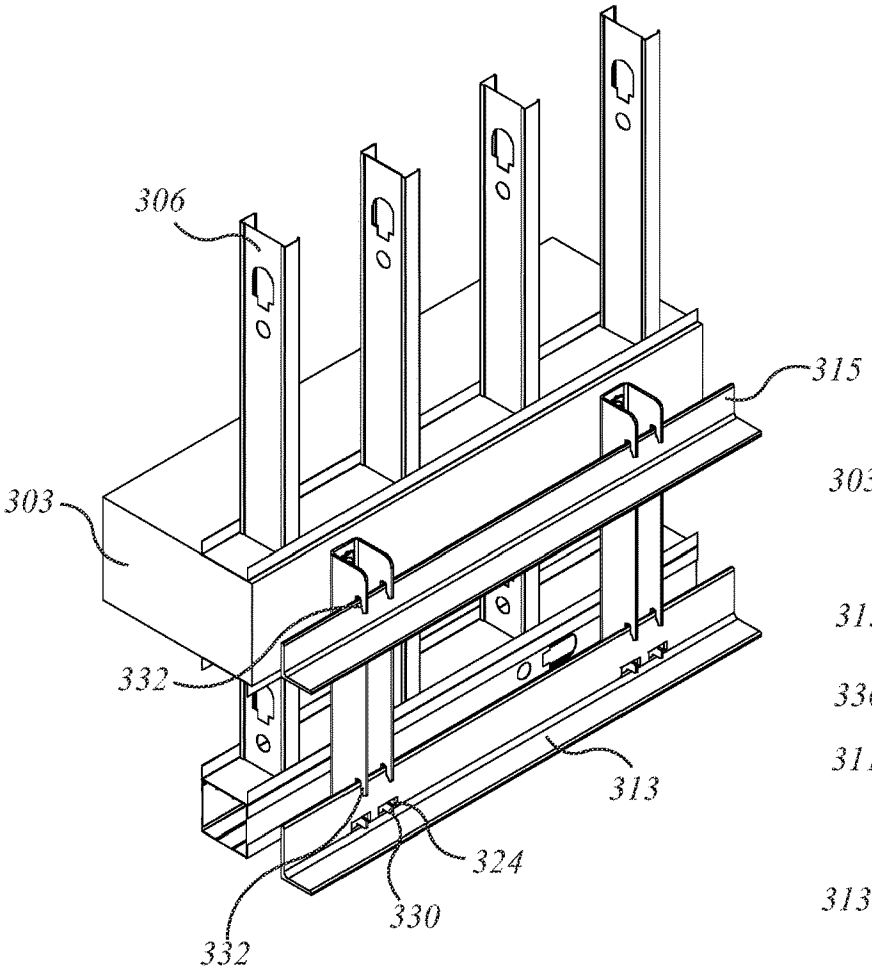
Figure 8I:
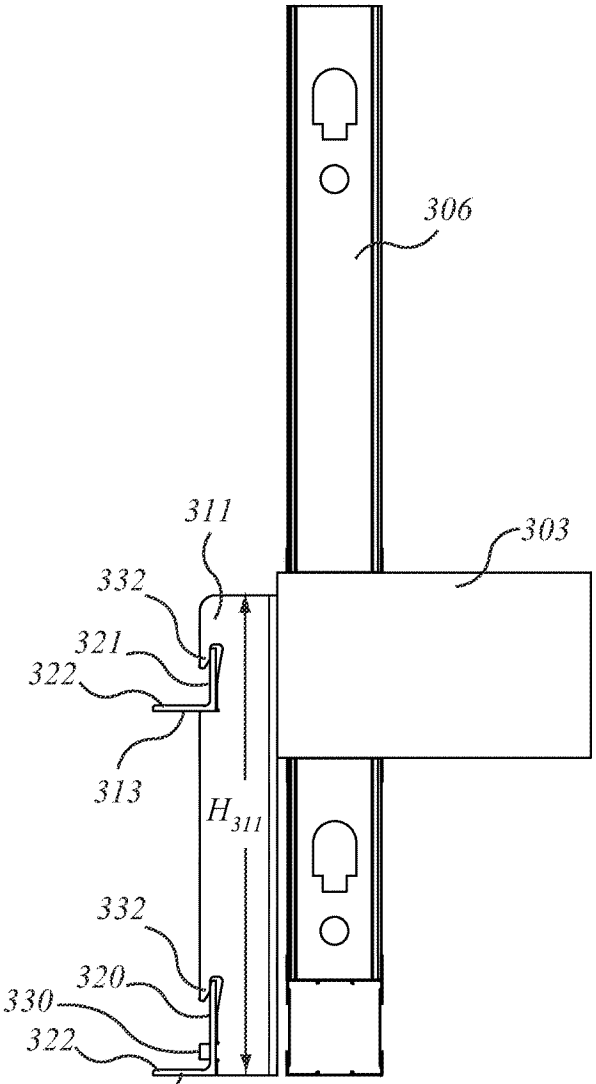
Figure 8H:
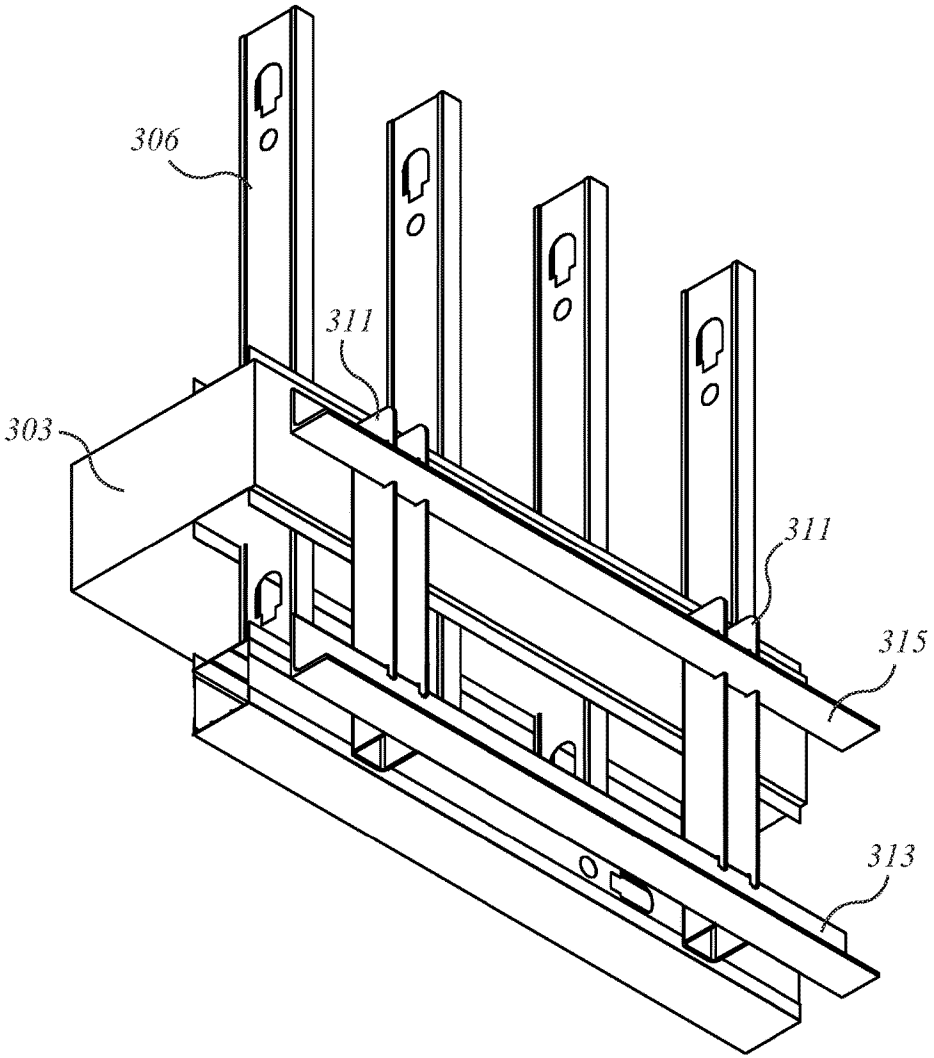
Figure 8K:
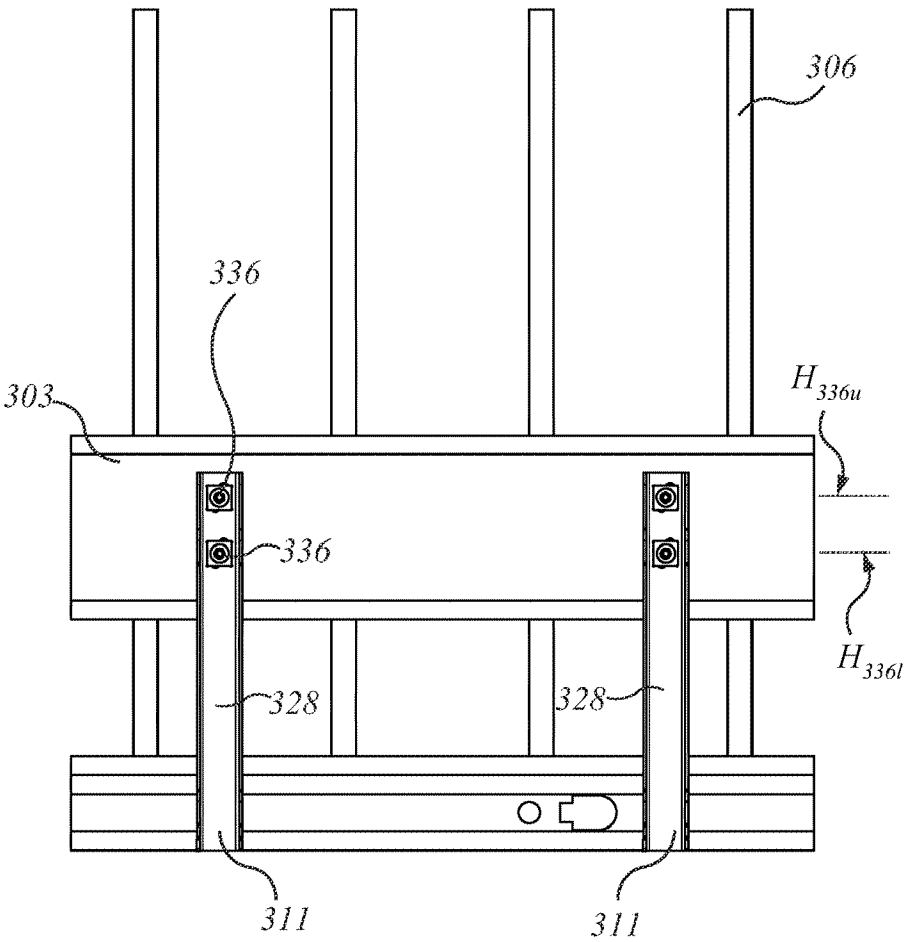
Figure 8J:
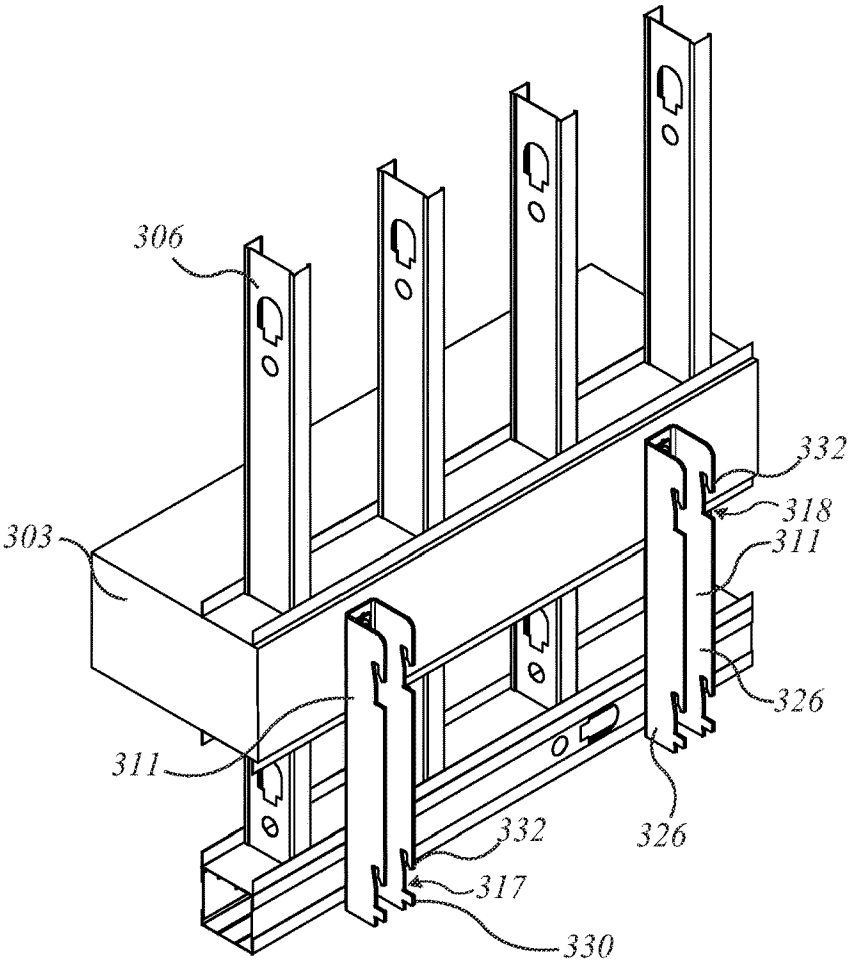
Figure 9D:
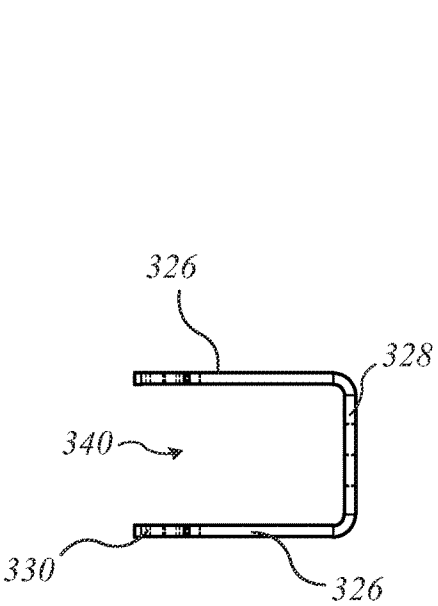
Figure 9C:
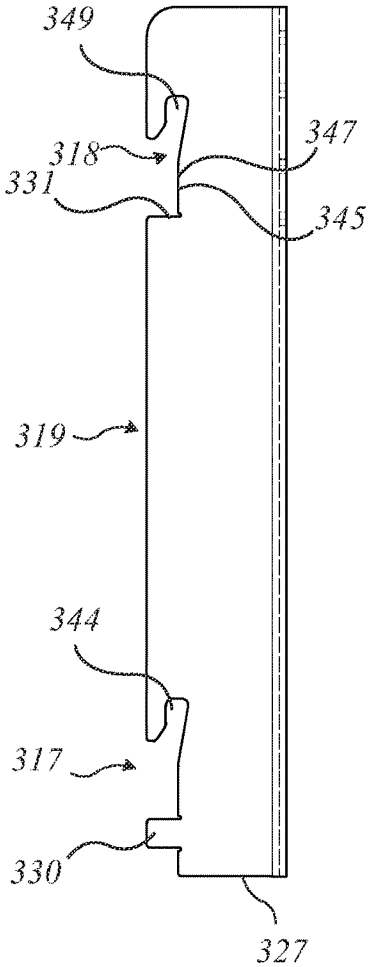
Figure 9B:
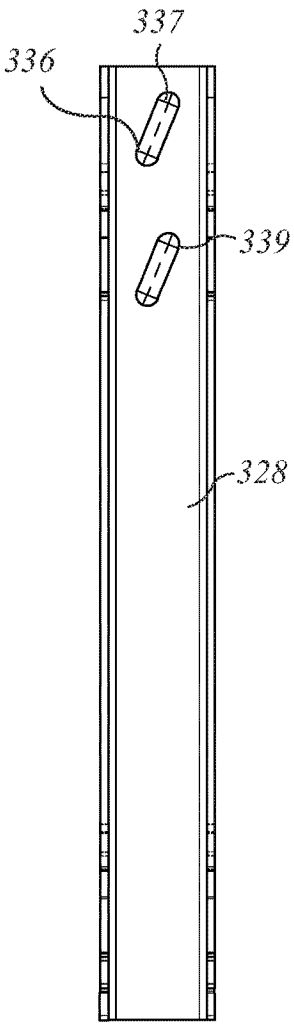
Figure 9A:
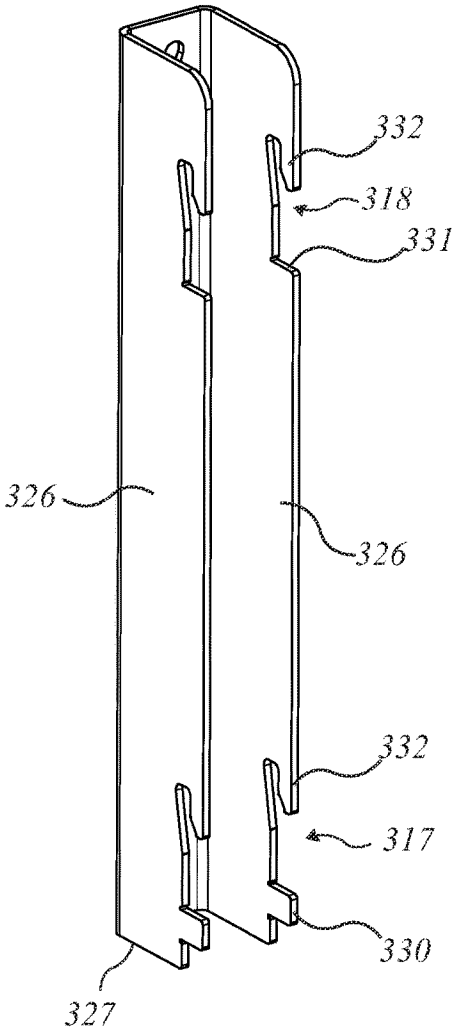

FIG. 8*d* is an isometric view of the assembly of FIG. 8*a*, shown without associated veneer members;

FIG. 8*e* is a front view of the assembly of FIG. 8*d*, shown without associated veneer members;

FIG. 8*f* is an isometric view of the assembly of FIG. 8*a* from the top, front and to one side, without associated veneer or wall members;

FIG. 8*g* is a front view of the assembly of FIG. 8*f*, shown without associated veneer members and without associated wall members;

FIG. 8*h* is an isometric view of the assembly of FIG. 8*a* from the bottom, front and to the same side, without associated veneer or wall members;

FIG. 8*i* is a side view in section of the assembly of FIG. 8*h*, shown without associated veneer members or associated wall members;

FIG. 8*j* is an isometric view of the assembly of FIG. 8*a*, shown without associated veneer, wall, or mounting members;

FIG. 8*k* is a front view of the assembly of FIG. 8*j*, shown without associated veneer, wall members, or mounting members;

FIG. 9*a* is an isometric view of structure of the assembly of FIG. 8*a;*

FIG. 9*b* is a front view of the structural element of FIG. 9*a;*

FIG. 9*c* is a side view of the structural element of FIG. 9*a;*

FIG. 9*d* is a bottom view of the structural element of FIG. 9*a;*

Figure 9G:
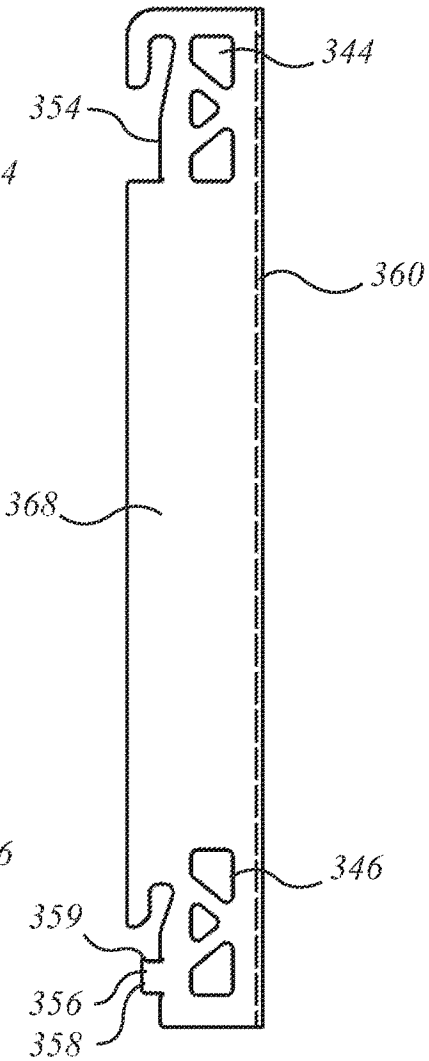
Figure 9F:
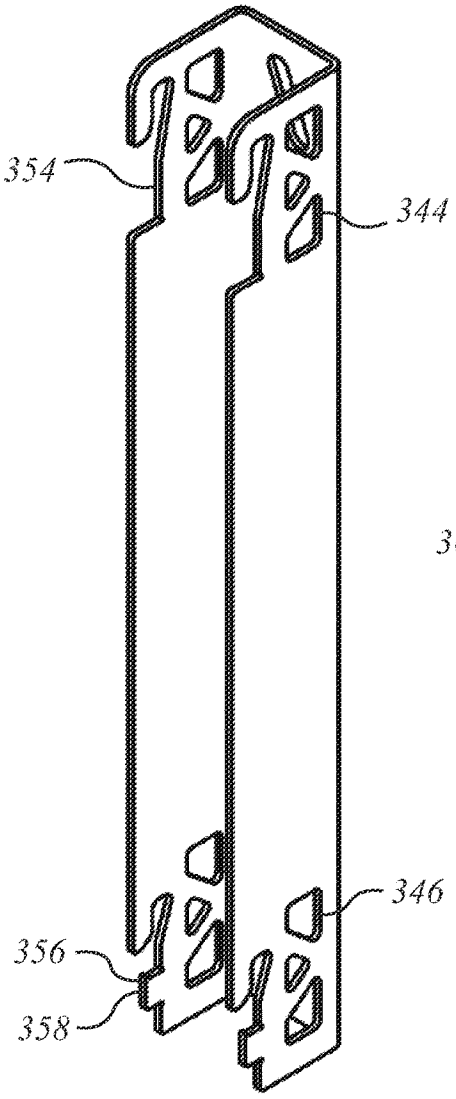
Figure 9E:
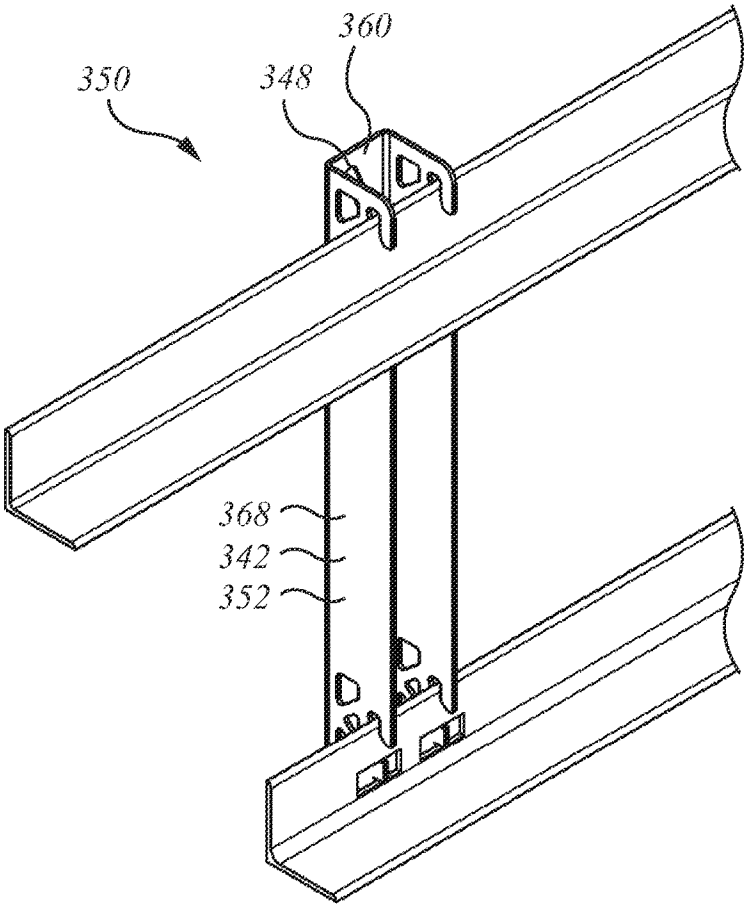

FIG. 9*e* is a perspective view of an alternate assembly to FIG. 9*a;*

FIG. 9*f* is a perspective view of an extended double-ended support bracket as used in FIG. 9*e;*

FIG. 9*g* is a side view of the double-ended support bracket of FIG. 9*f;*

Figure 10:
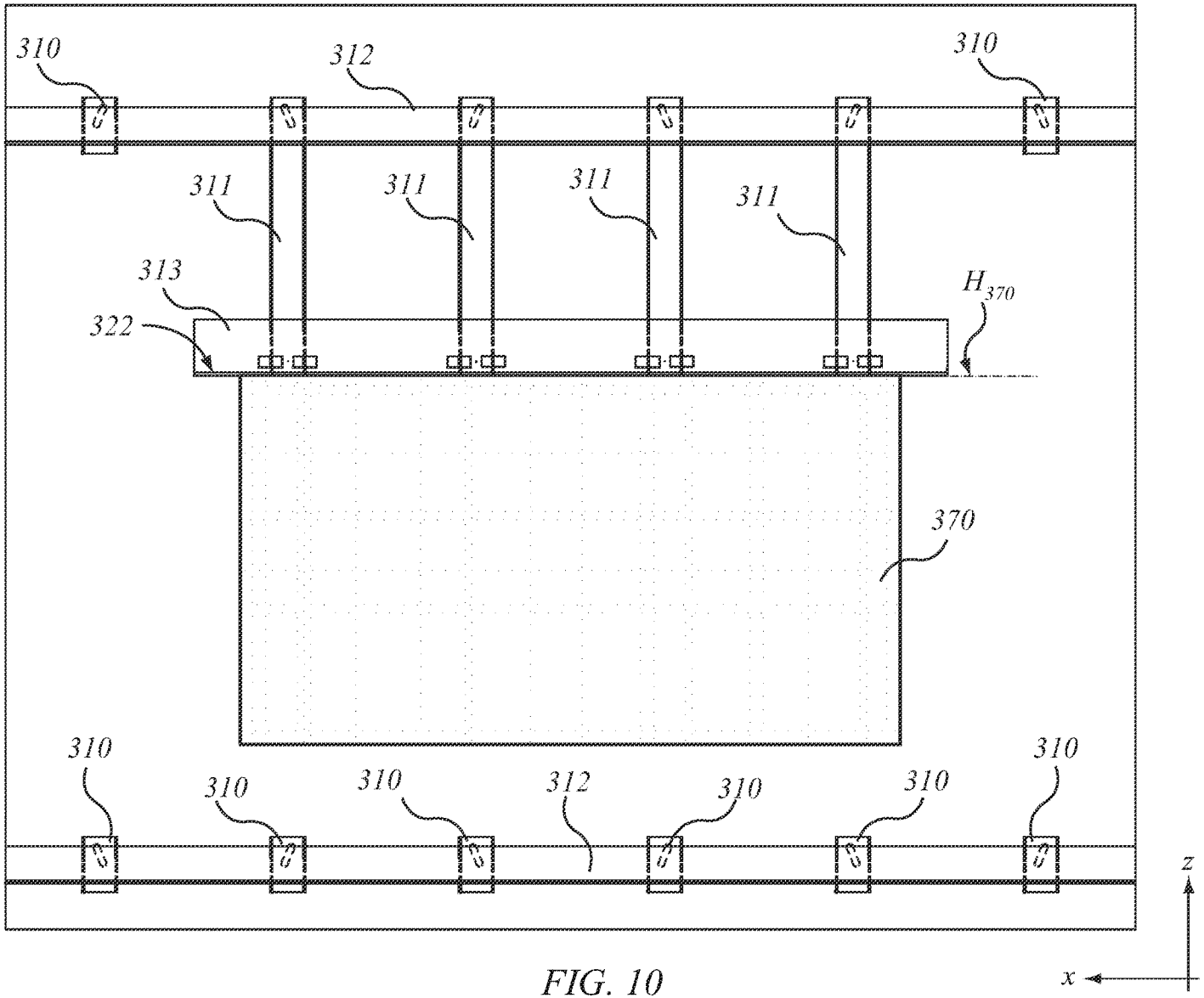

FIG. 10 is a front plan view of an arrangement similar to the general arrangement of FIG. 8*a;*

Figure 11B:
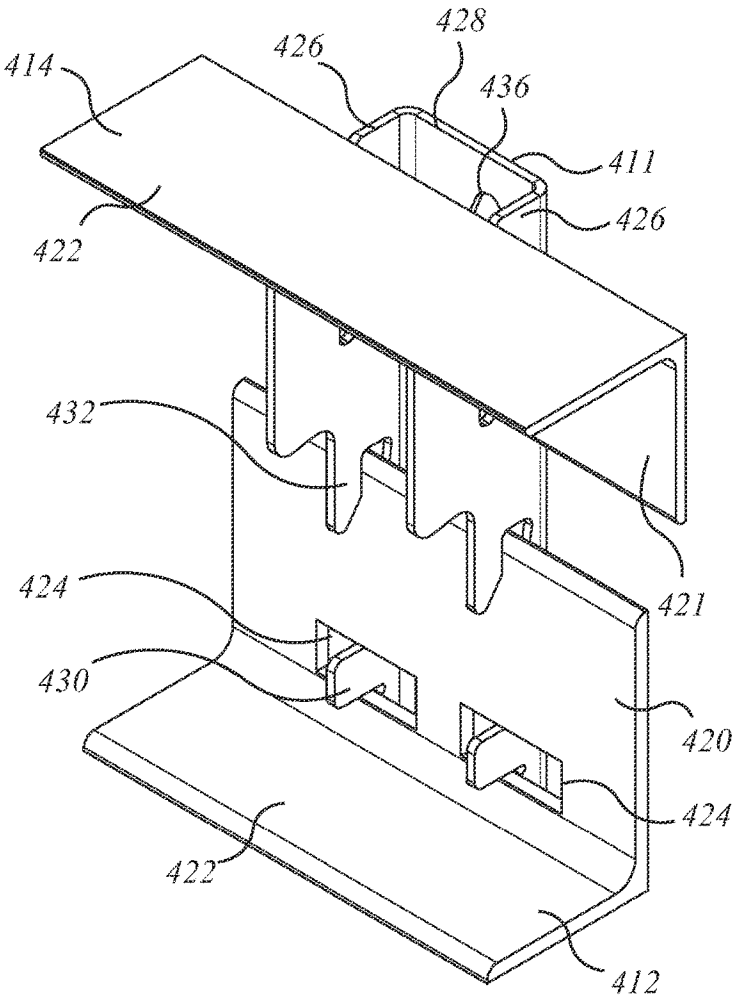
Figure 11A:
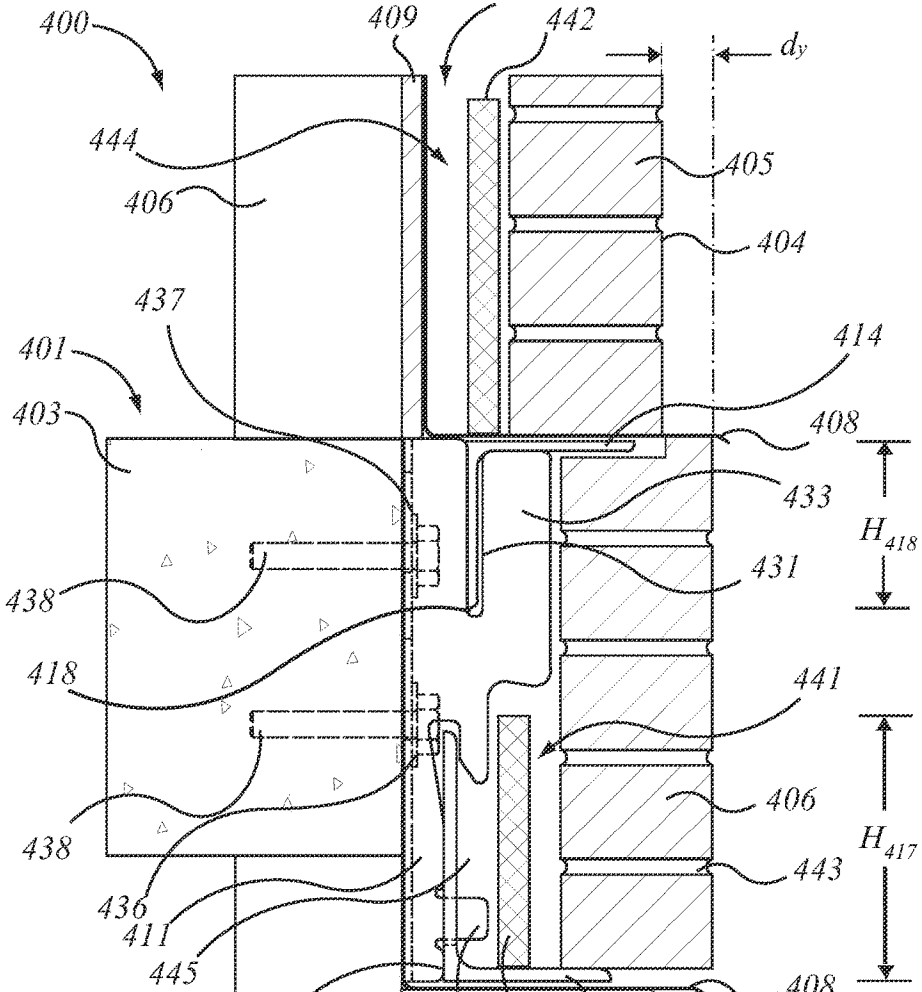
Figures 11C, 11D, 11E:
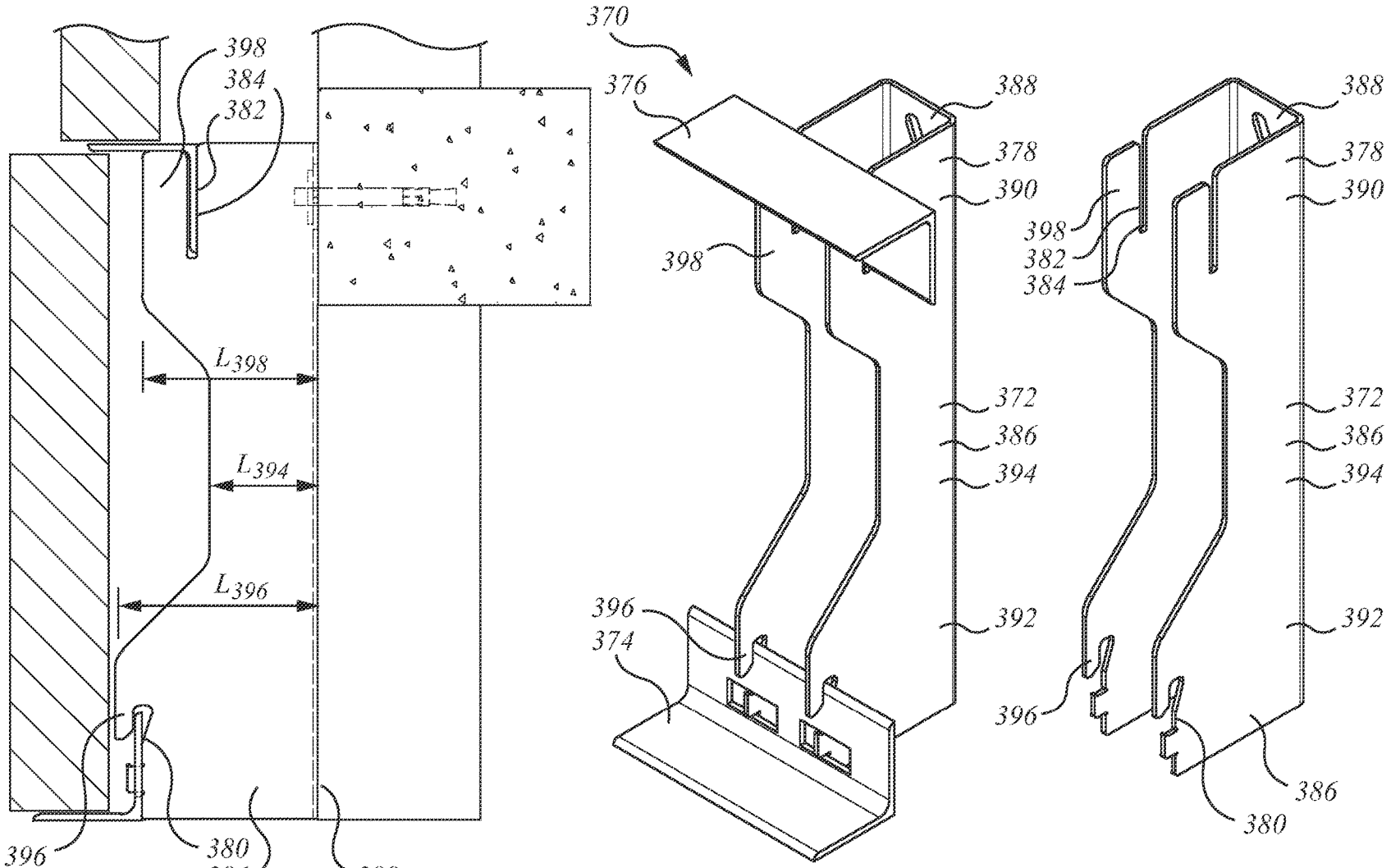
Figure 11G:
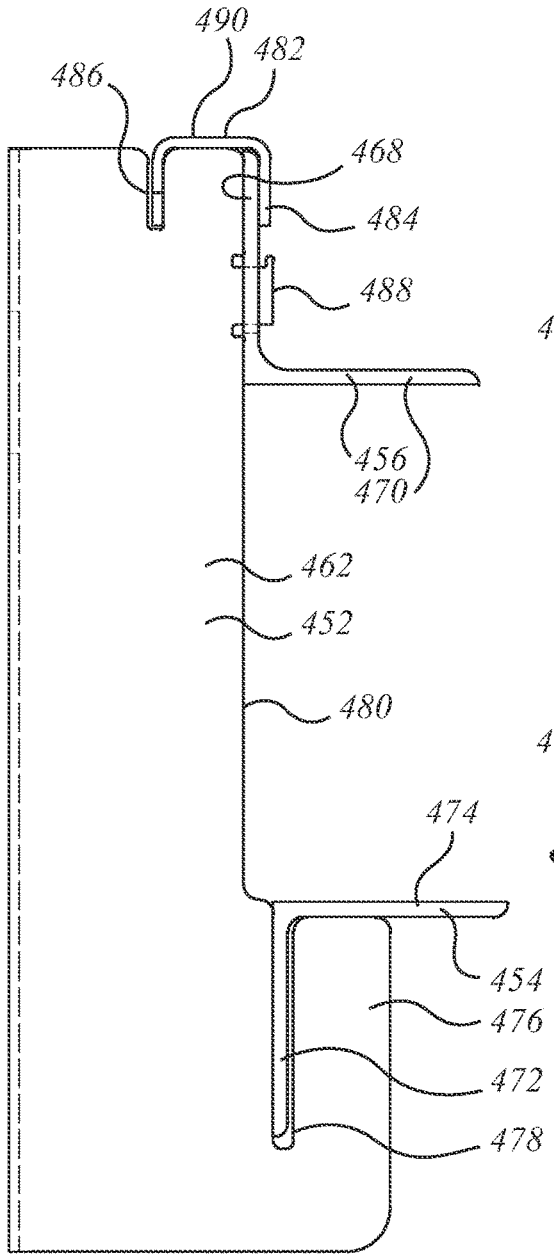
Figure 11F:
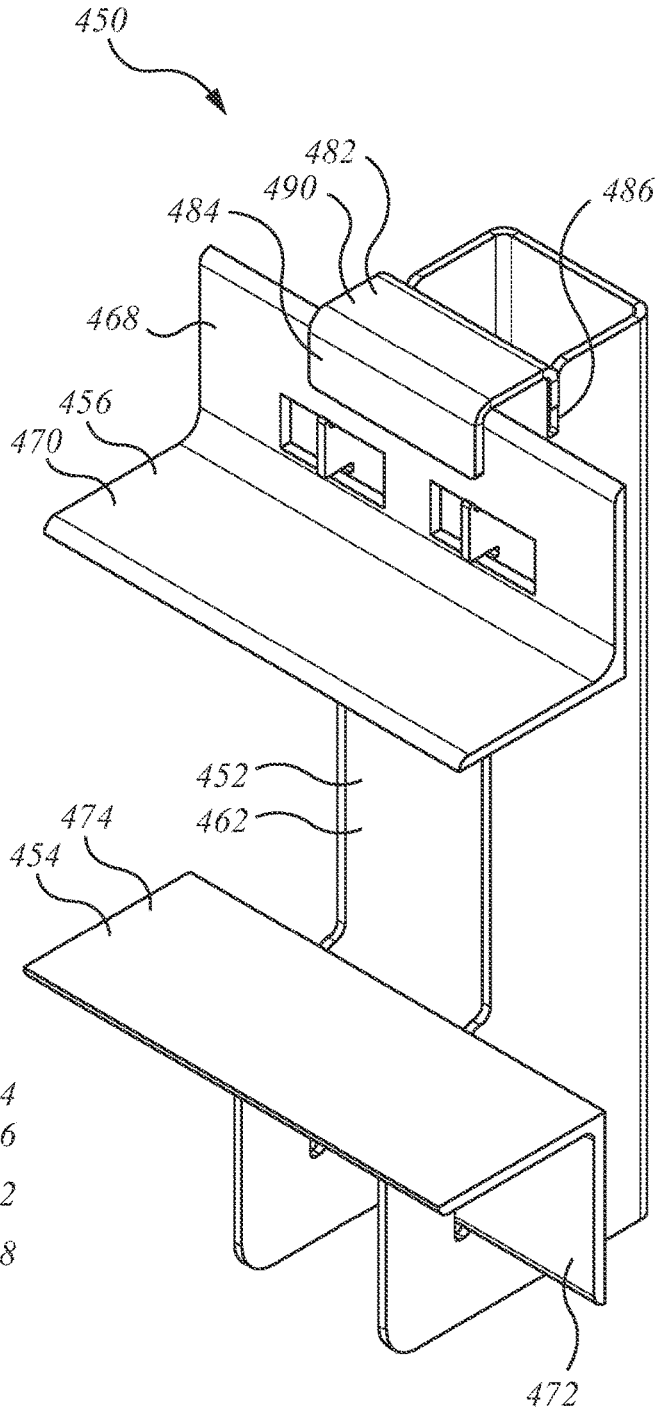

FIG. 11*a* is a side view in section of an alternate assembly to that of FIG. 8*a* according to an embodiment;

FIG. 11*b* is an isometric view of structure of FIG. 11*a* shown without associated wall members from in front, to one side, and above;

FIG. 11*c* is an alternate installation of double-ended shelf angle support assembly to that of FIG. 11*a*, in side view;

FIG. 11*d* is a perspective view of the bracket assembly of FIG. 11*c*, without support structure, or masonry veneer;

FIG. 11*e* is a perspective view of the bracket of the assembly of FIG. 11*d* without upper or lower shelf angles;

FIG. 11*f* is a perspective view of an alternate form of double-ended installation to that of FIG. 11*c;*

FIG. 11*g* is a side view of the assembly of FIG. 11*a;*

Figure 12A:
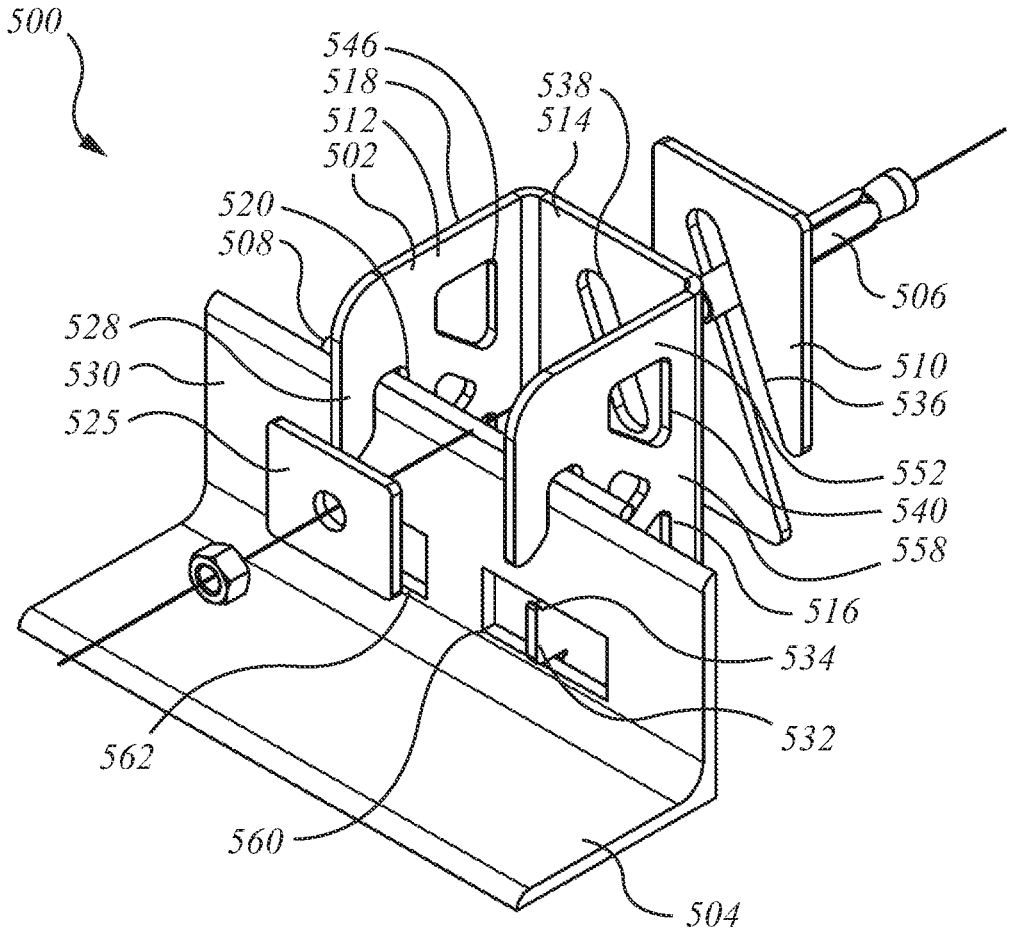

FIG. 12*a* shows a perspective view of an alternate embodiment of shelf angle support assembly to that of FIG. 1*a;*

Figure 12B:
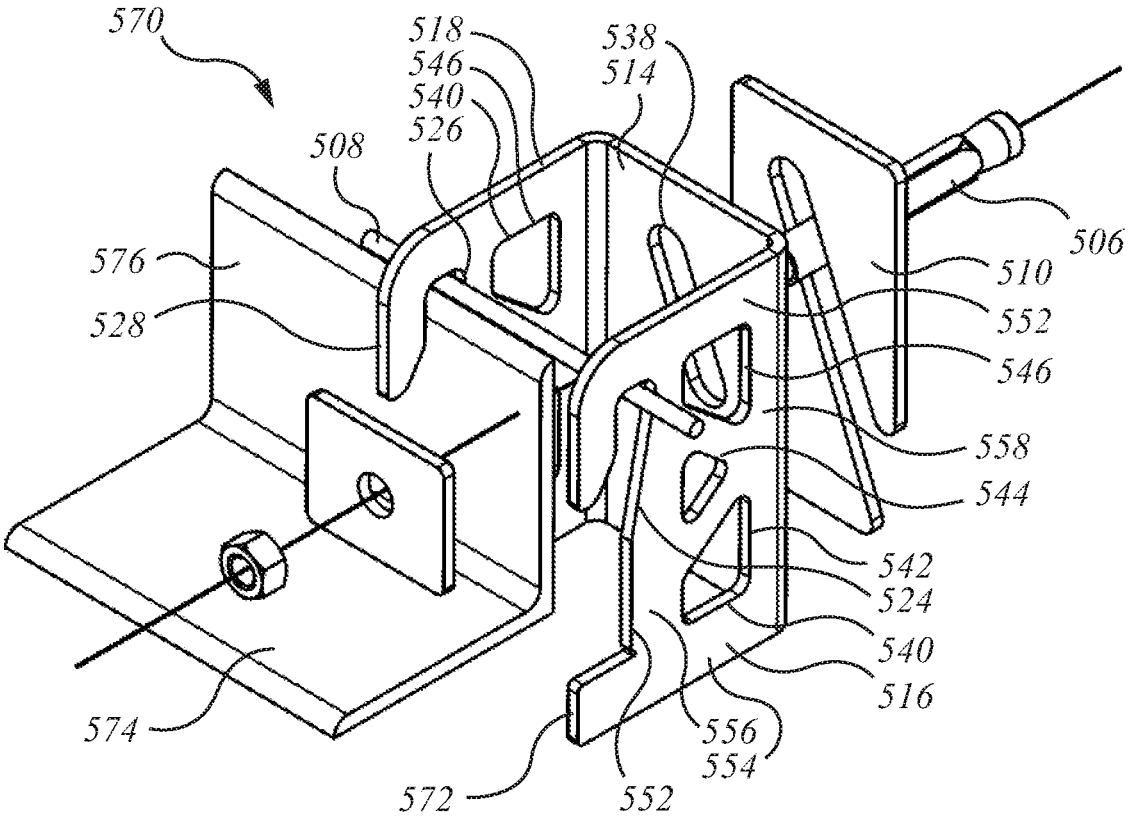
Figure 12C:
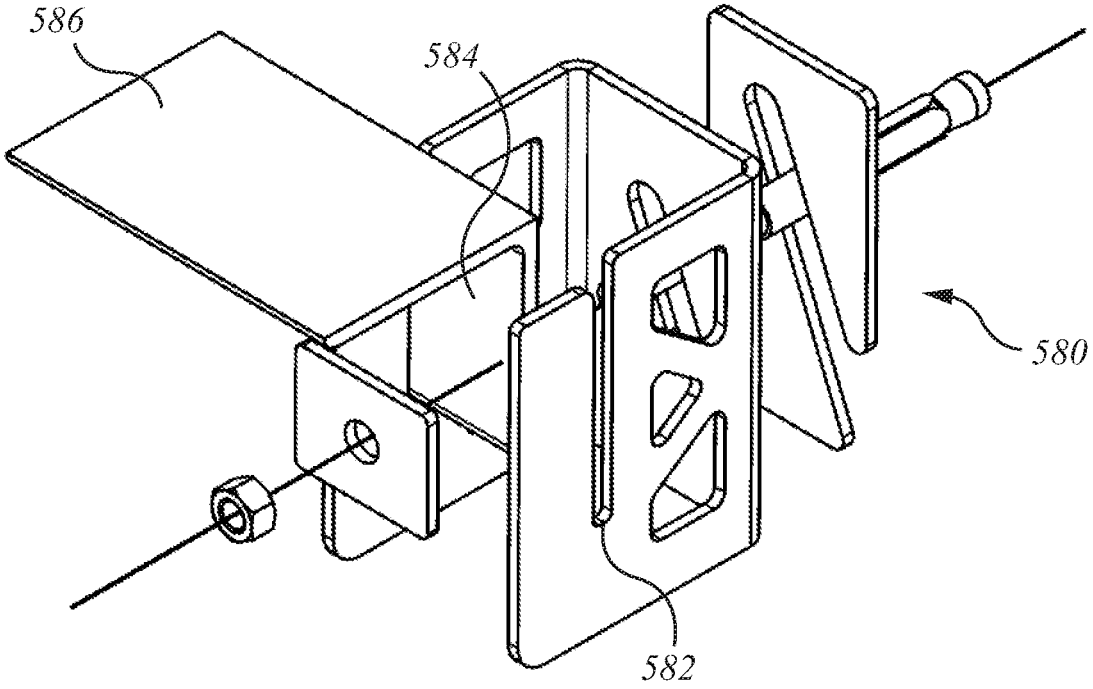

FIG. 12*b* shows the assembly of FIG. 12*a* in an exploded view;

FIG. 12*c* is an inverted embodiment of the assembly of FIG. 12*b;*

Figure 13A:
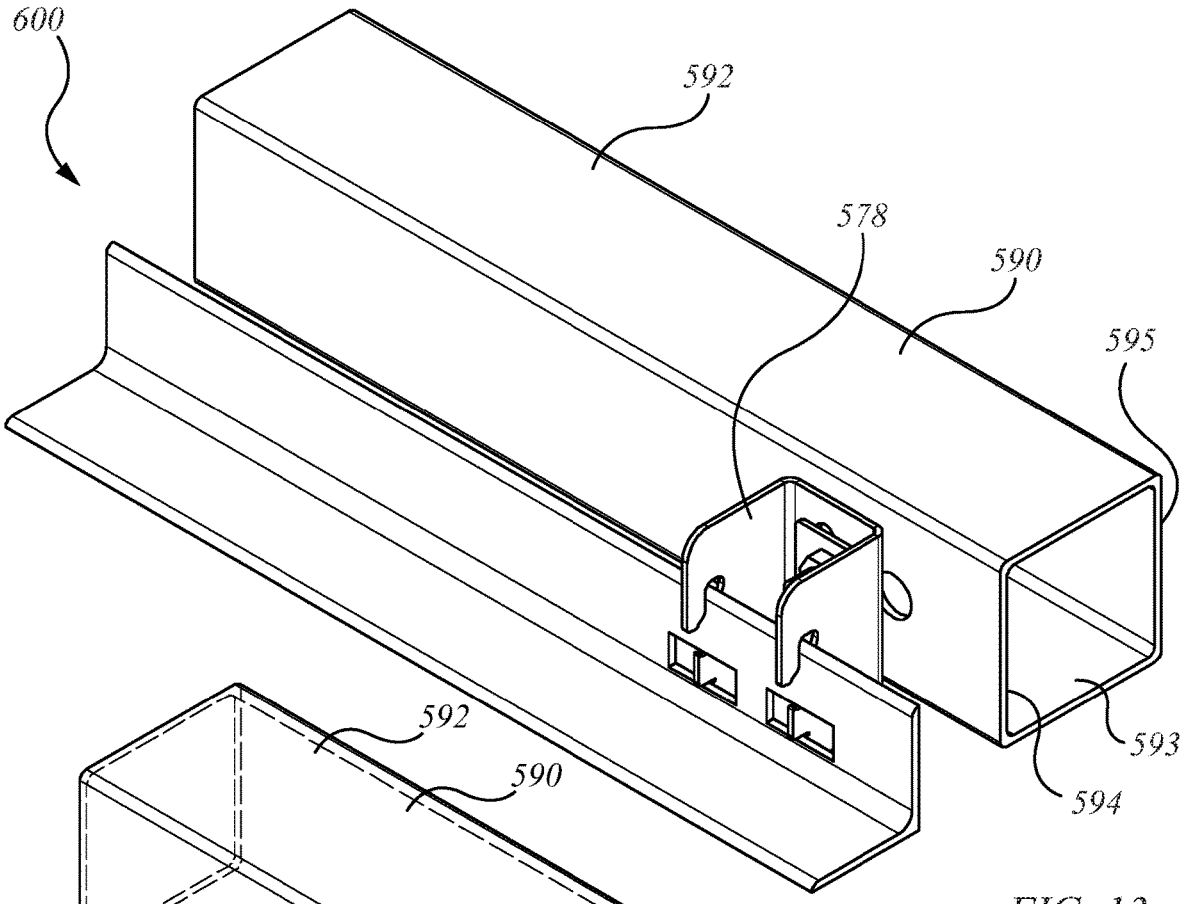
Figure 13B:
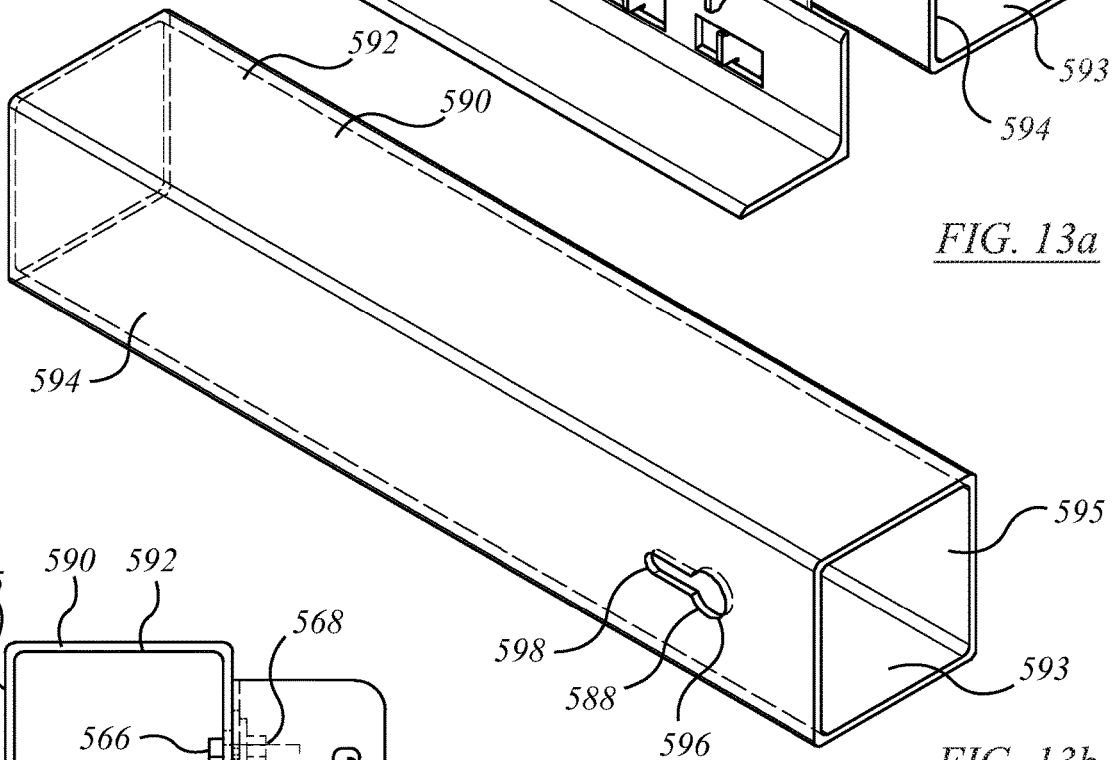

FIG. 13*a* shows a perspective view of an alternate arrangement to that of FIG. 1*a* for mounting shelf angle brackets to structural sections;

FIG. 13*b* is a perspective view of the structural section of FIG. 13*a;*

Figure 13C:
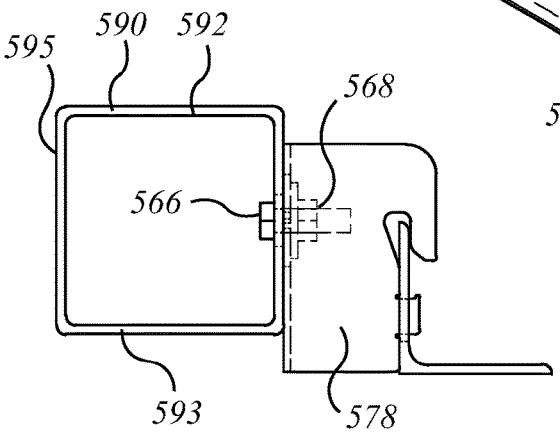

FIG. 13*c* shows a side view of the assembly of FIG. 13*a;*

Figure 13D:
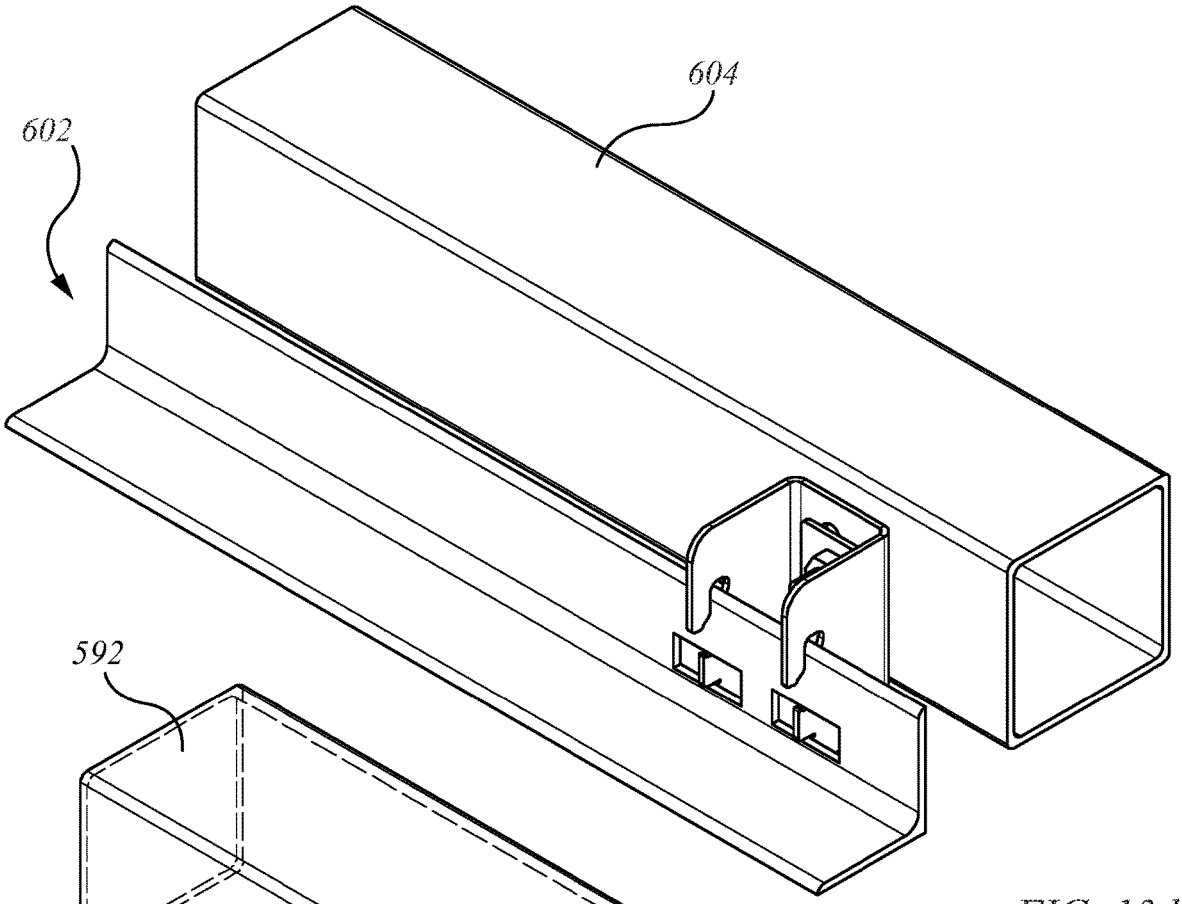
Figure 13E:
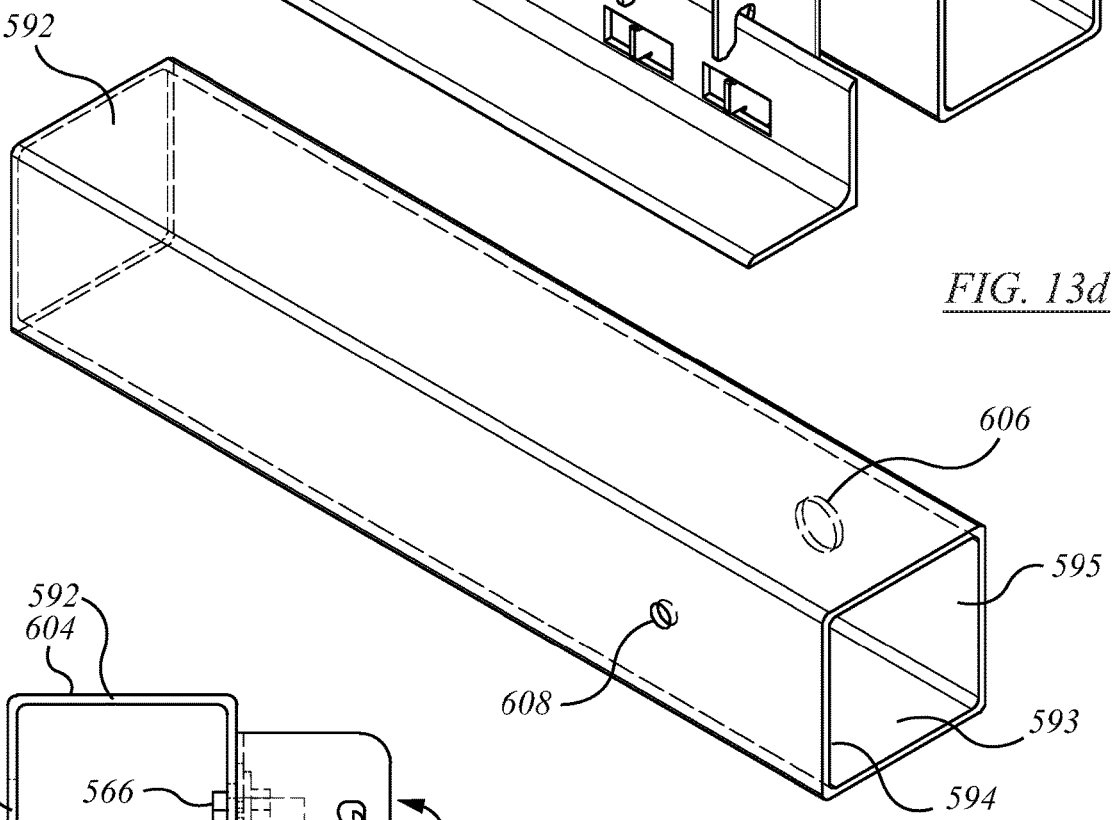

FIG. 13*d* shows an alternate mounting arrangement to that of FIG. 13*a* of mounting shelf angle brackets to hollow structural sections;

FIG. 13*e* shows the hollow structural section of FIG. 13*d;*

Figure 13F:
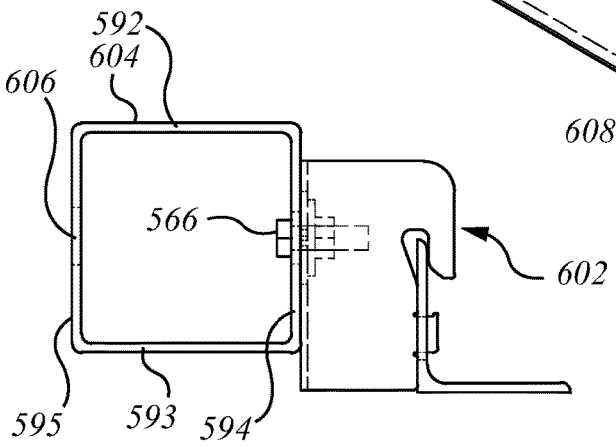

FIG. 13*f* shows a side view of the assembly of FIG. 13*d;*

Figure 13G:
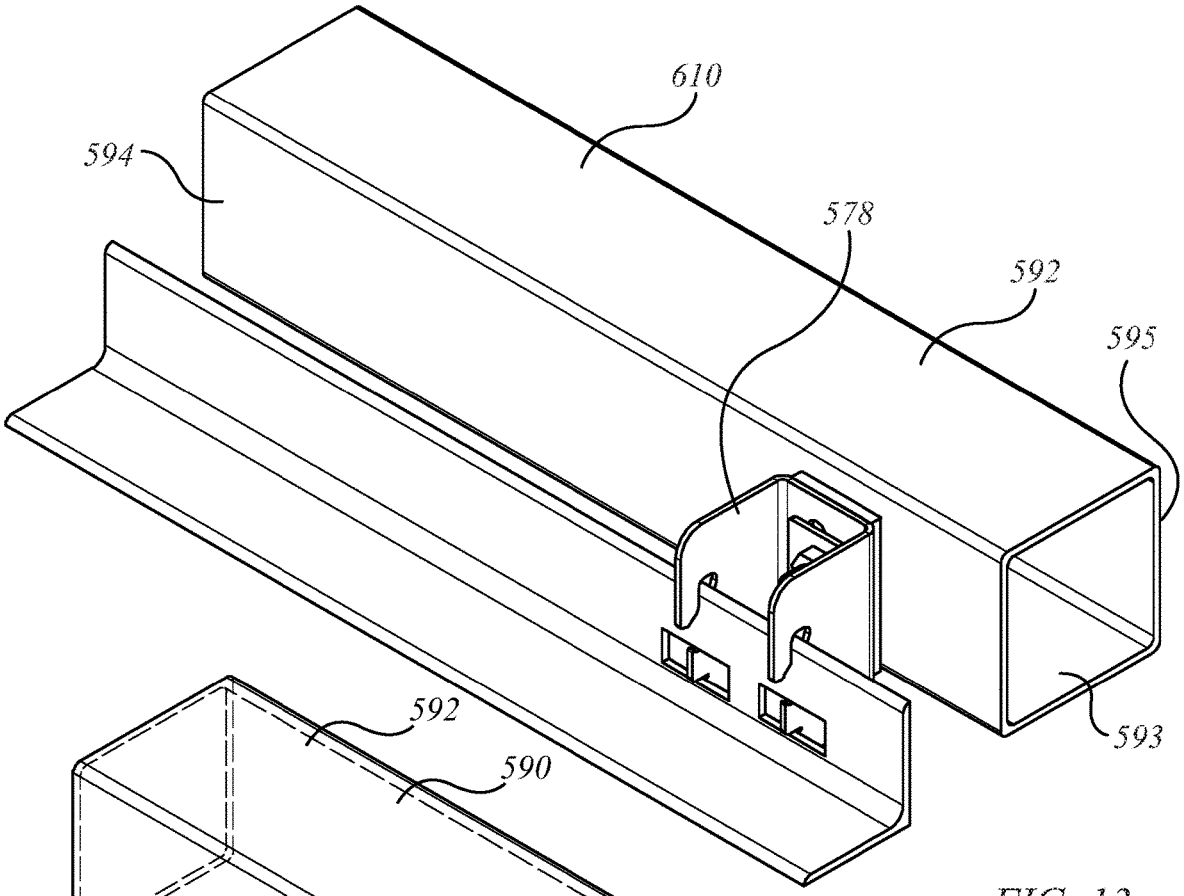
Figure 13H:
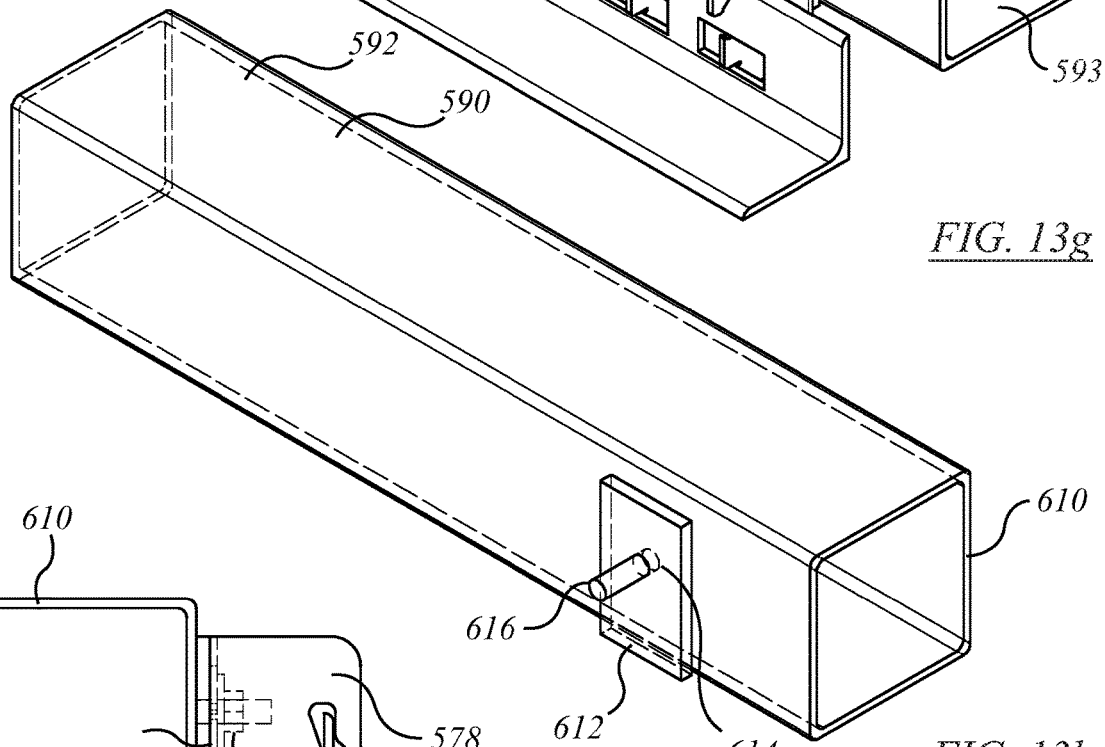

FIG. 13*g* is a perspective view of an alternate arrangement to FIG. 13*a* for mounting shelf angle brackets to hollow structural sections;

FIG. 13*h* shows the hollow structural section of FIG. 13*g;*

Figure 13I:
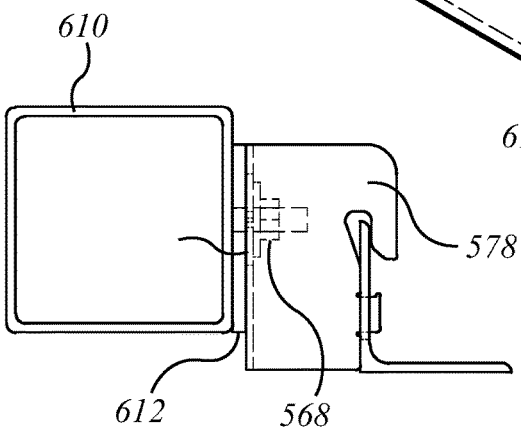

FIG. 13*i* shows a side view of the assembly of FIG. 13*g;*

Figure 14B:
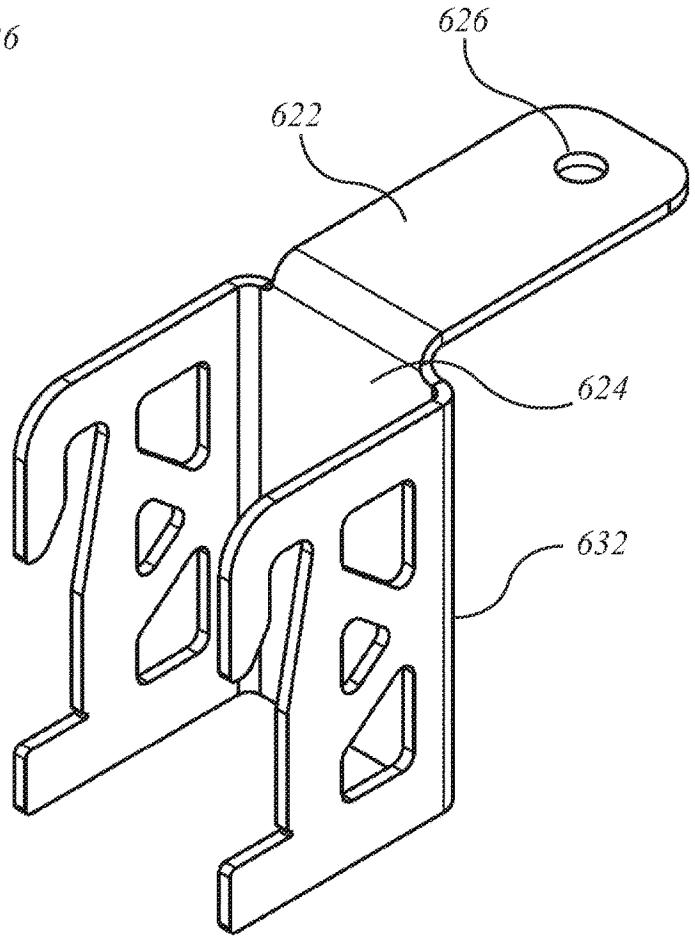
Figure 14A:
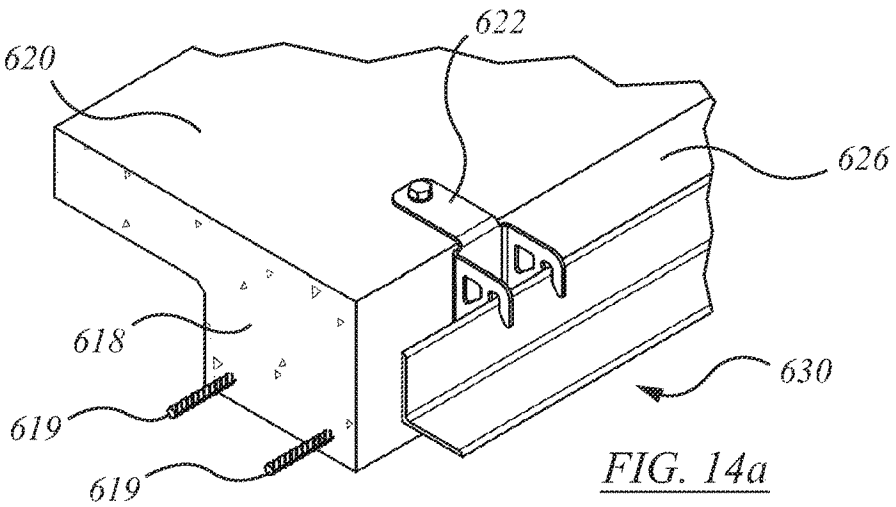

FIG. 14*a* is a perspective view of an alternate arrangement to FIG. 1*a*, of a shelf angle support bracket to a reinforced concrete member;

FIG. 14*b* shows the mounting bracket of FIG. 14*a;*

Figure 14C:
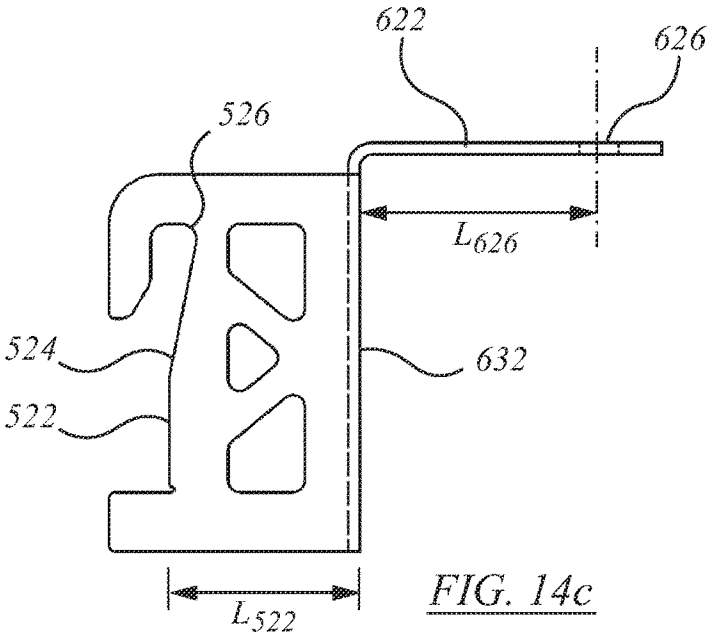

FIG. 14*c* shows a side view of the mounting bracket of FIG. 14*a;*

Figures 14D, 14E, 14F:
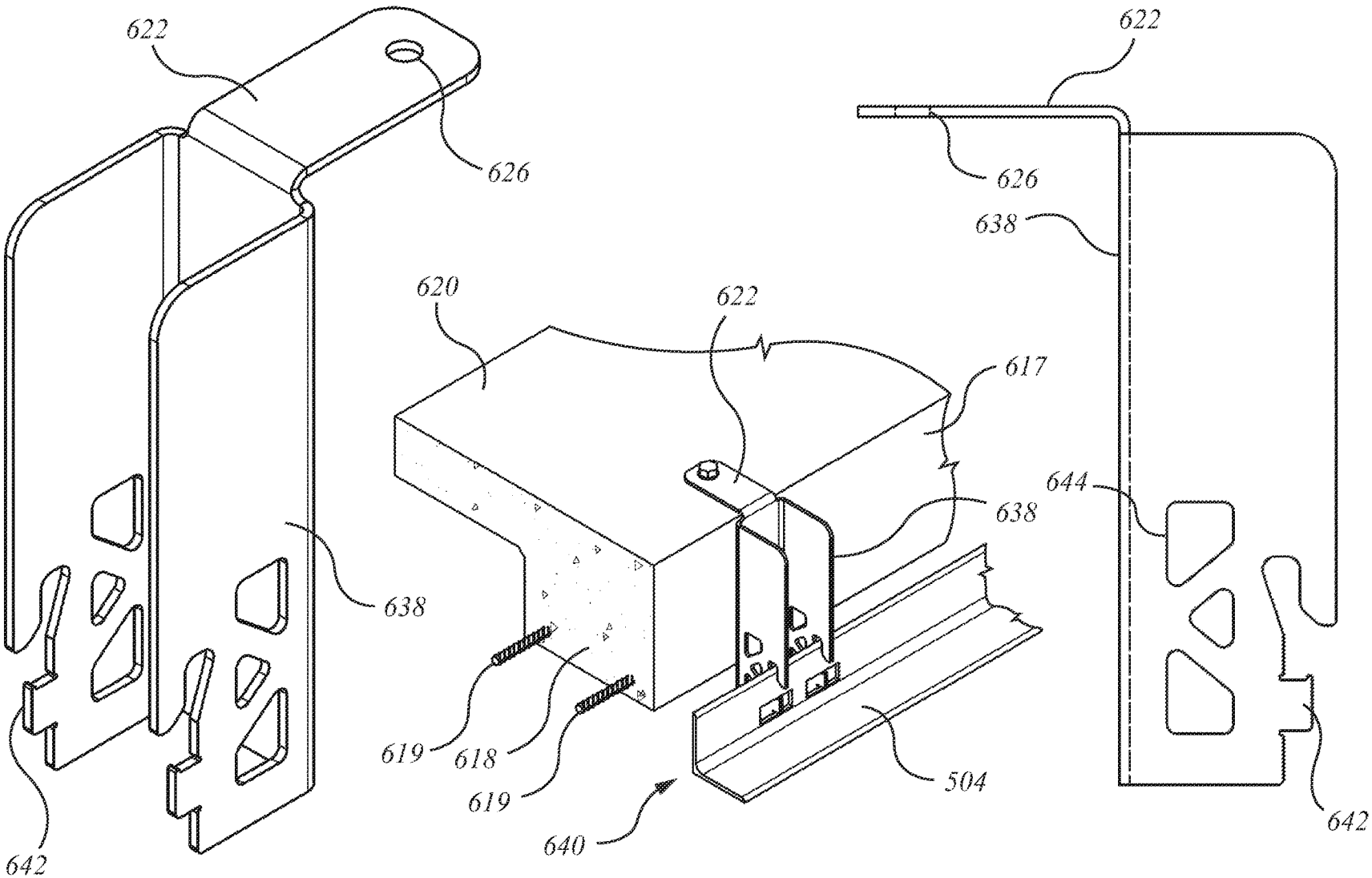

FIG. 14*d* shows an alternate mounting arrangement to that of FIG. 14*a* for mounting a long-legged shelf angle to a reinforced concrete member;

FIG. 14*e* shows a perspective view of the mounting bracket of FIG. 14*d;*

FIG. 14*f* shows a side view of the mounting bracket of FIG. 14*d;*

Figure 15C:
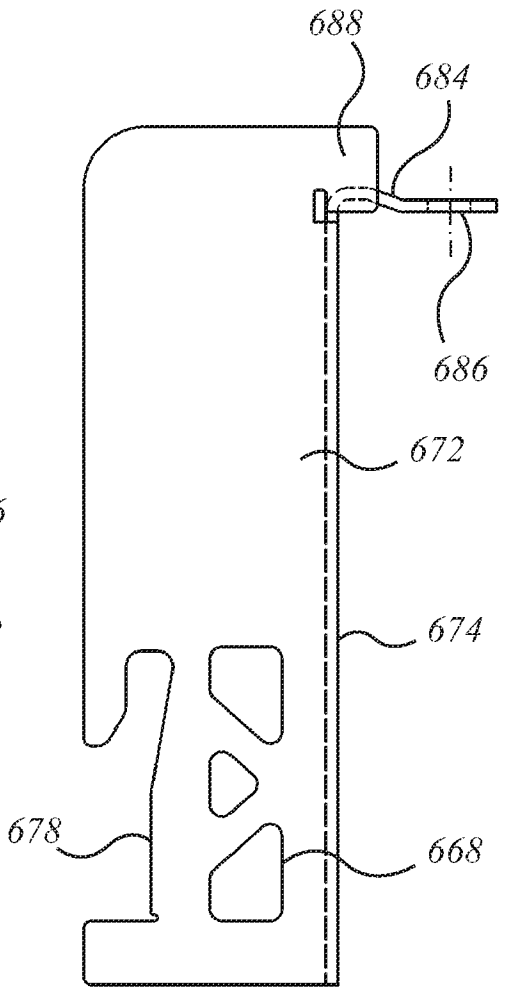
Figure 15B:
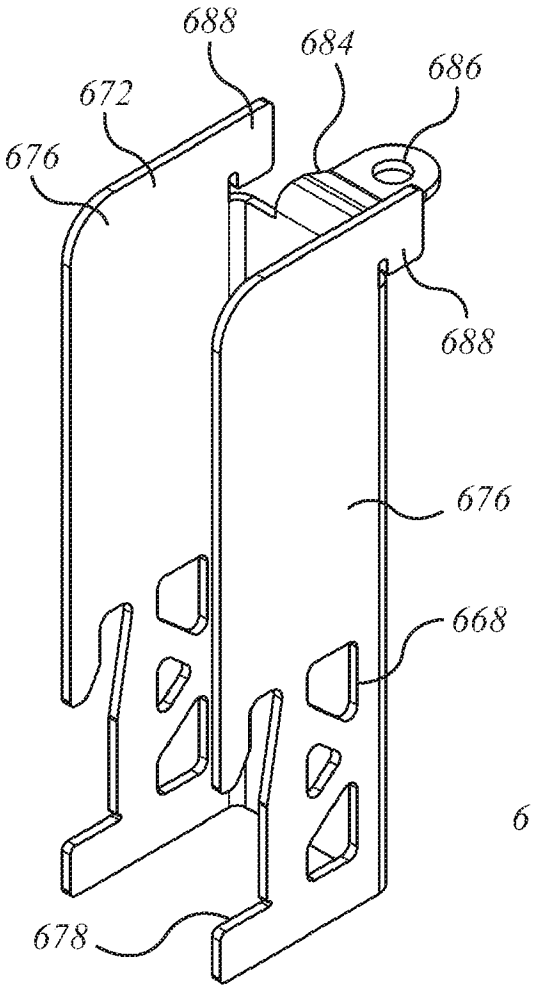
Figure 15A:
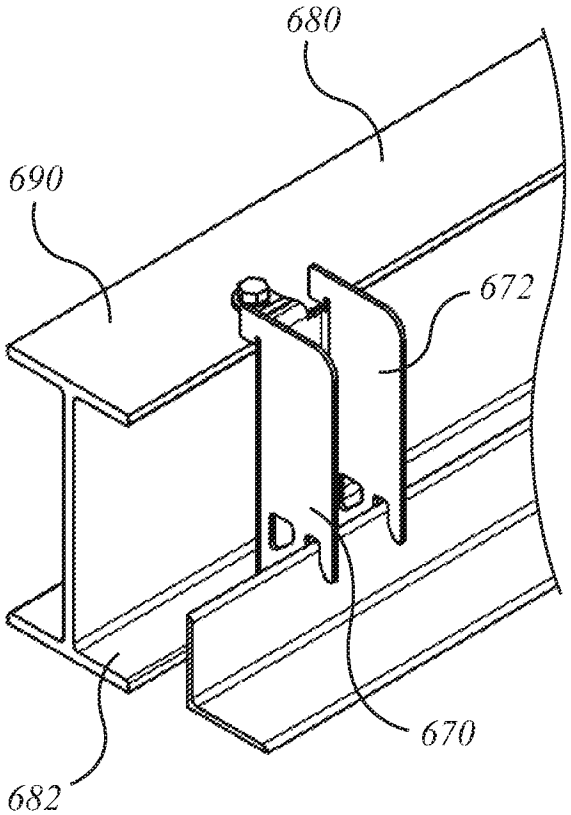

FIG. 15*a* shows a perspective view of an alternate embodiment of shelf angle support bracket mounting arrangement to a beam;

FIG. 15*b* shows a perspective view of the mounting bracket of FIG. 15*a;*

FIG. 15*c* shows a side view of the mounting bracket of FIG. 15*a;*

Figure 17A:
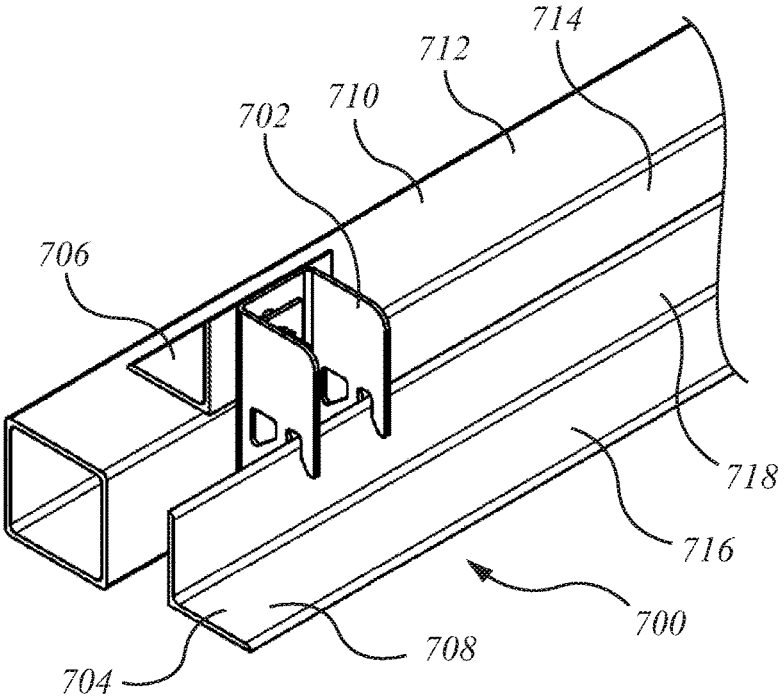
Figure 17B:
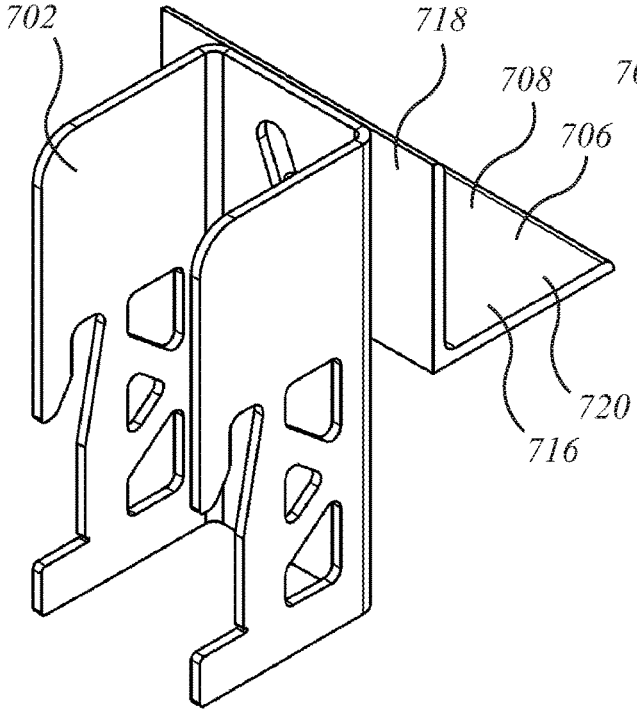

FIG. 16*a* is a side view of an alternate arrangement to FIG. 15*a* of an extended shelf angle support bracket on overhanging support structure;

FIG. 16*b* shows a perspective view of the assembly of FIG. 16*a*, dismounted, without masonry veneer, from the front, left, and above;

FIG. 16*c* shows the assembly of FIG. 16*b* from behind, left, and above;

FIG. 17*a* is a perspective view of an alternate arrangement to FIG. 7*a*, of a shelf angle bracket support assembly of a structural member;

FIG. 17*b* shows a perspective view of the bracket of FIG. 17*a;*

Figure 17C:
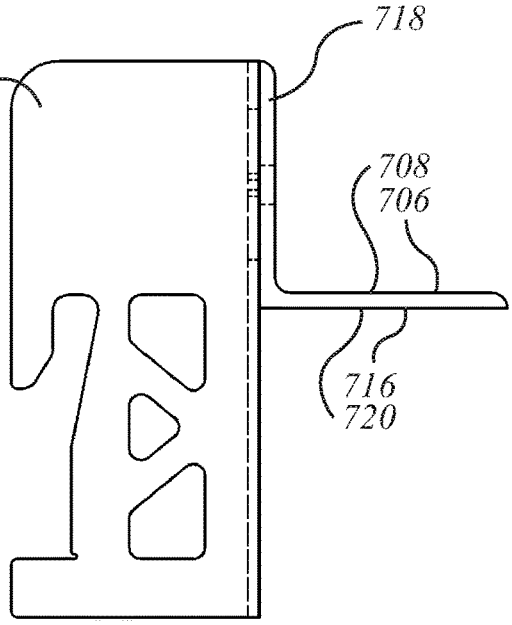

FIG. 17*c* shows a side view of the bracket of FIG. 17*b;*

Figure 17D:
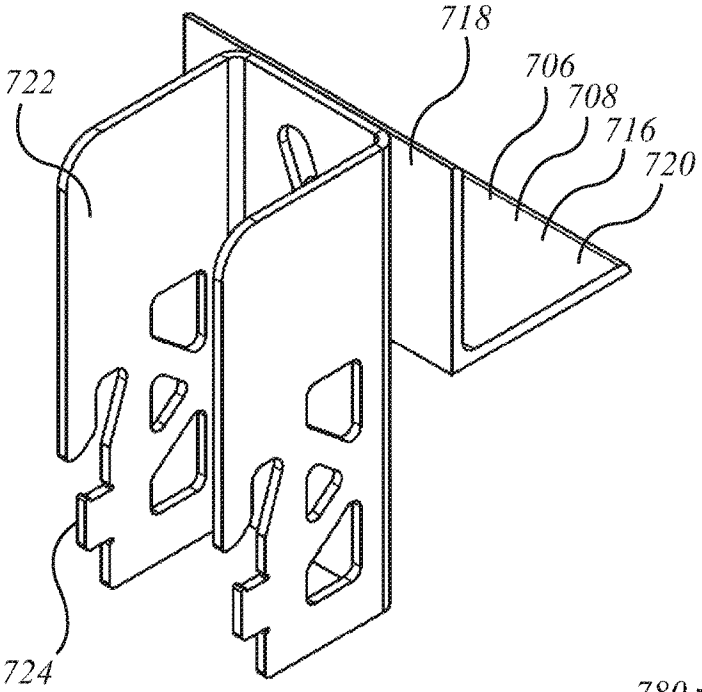

FIG. 17*d* shows an alternate embodiment of bracket to that of FIG. 17*b;*

Figure 18A:
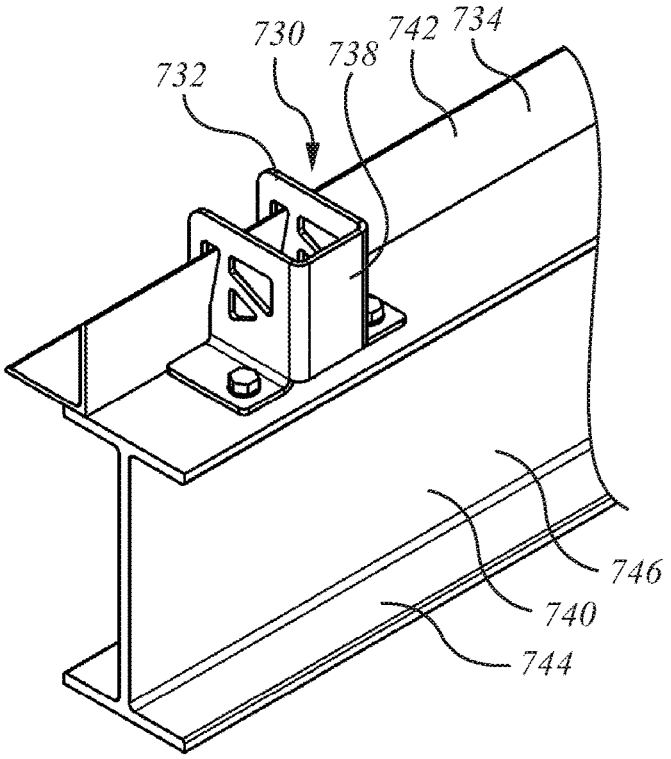
Figure 18B:
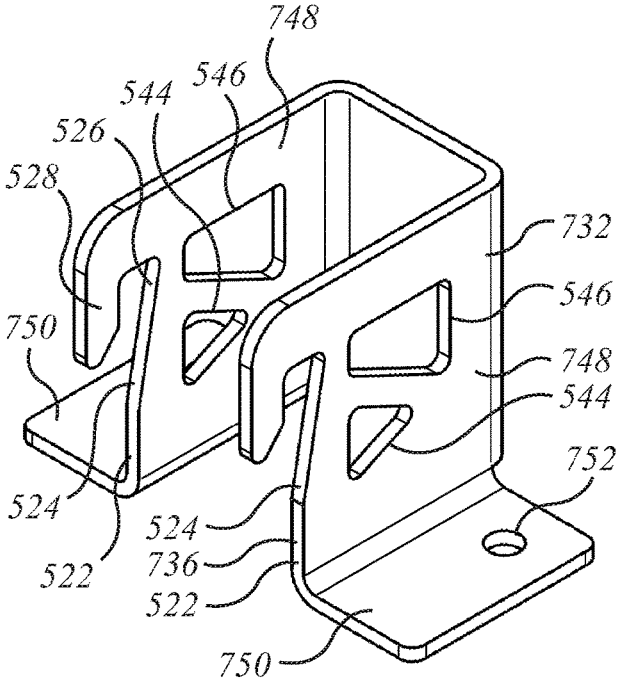

FIG. 18*a* shows an alternate shelf angle mounting bracket assembly arrangement to that of FIG. 17*a* as mounted to the top of a beam;

FIG. 18*b* is a perspective view of the mounting bracket of FIG. 18*a;*

Figure 18C:
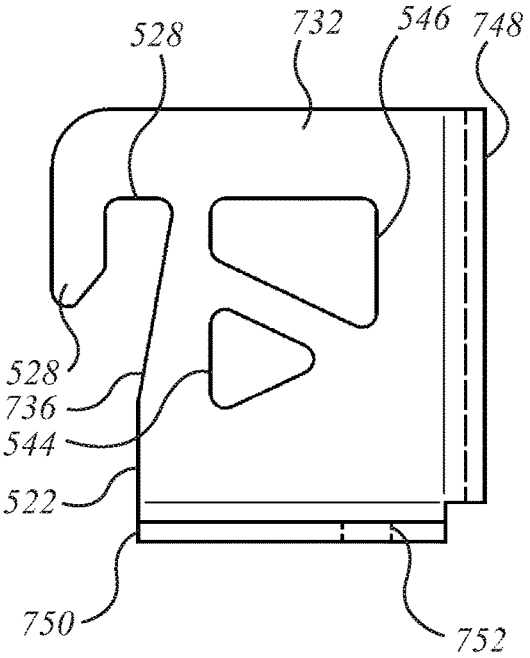

FIG. 18*c* is a side view of the mounting bracket of FIG. 18*b;*

Figure 19D:
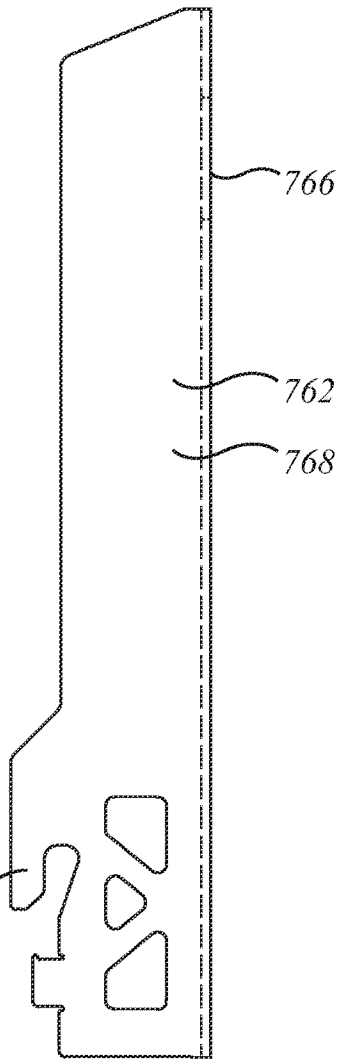
Figure 19C:
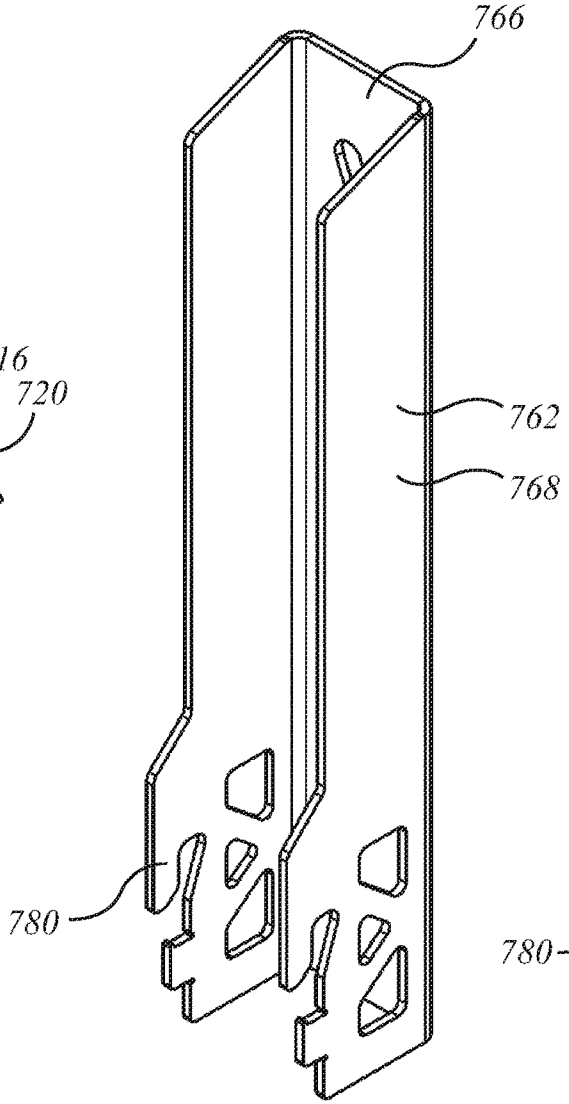
Figure 19B:
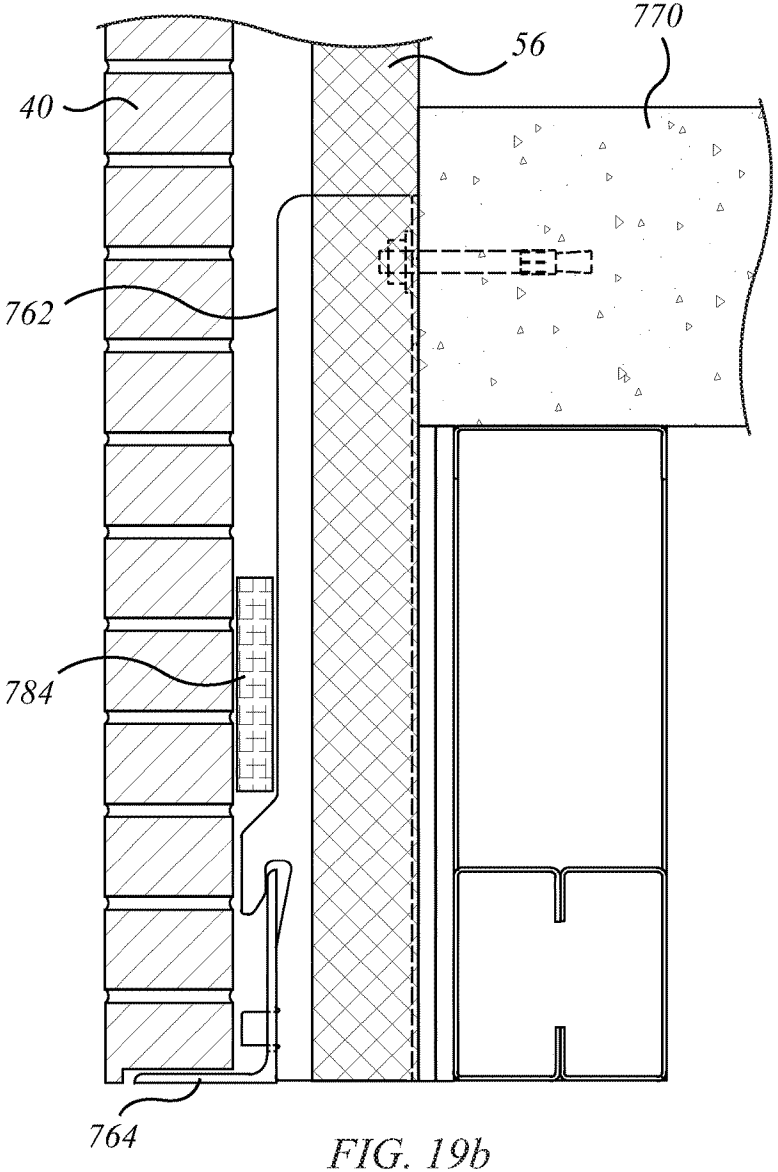
Figure 19A:
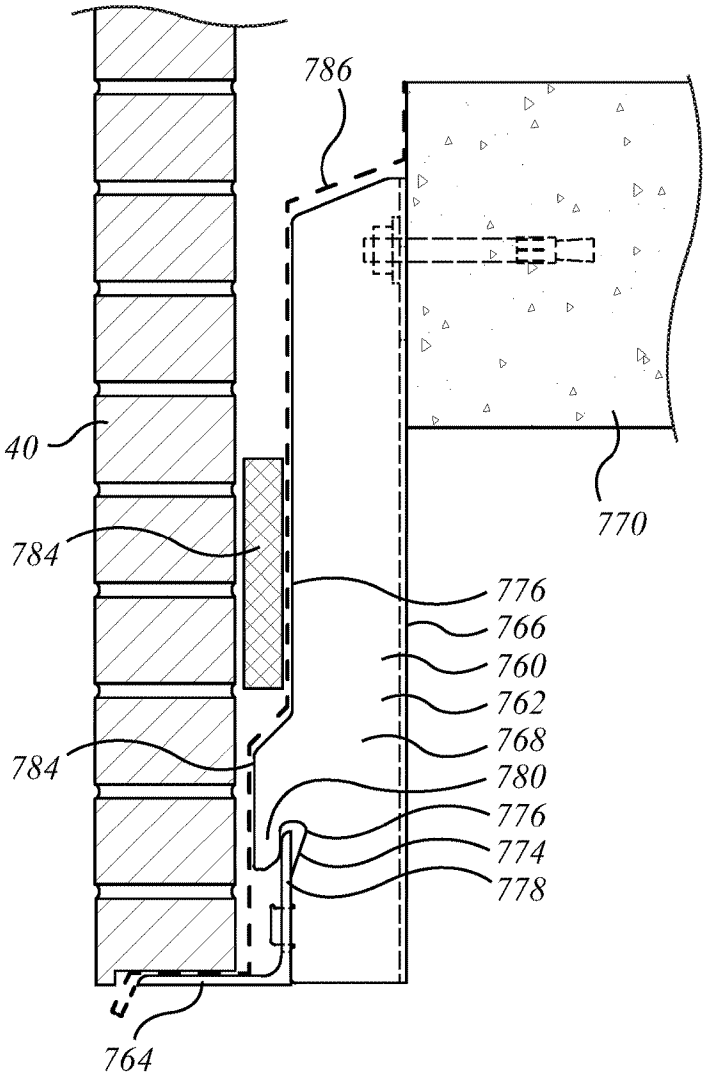

FIG. 19*a* is a side view of an alternate embodiment of shelf angle mounting bracket installation to that of FIG. 6*a;*

FIG. 19*b* is a side view of an alternate embodiment to that of FIG. 19*a;*

FIG. 19*c* is a perspective view of the mounting bracket of FIG. 19*a;*

FIG. 19*d* is a side view of an alternate bracket to that of FIG. 19*a;*

Figure 20B:
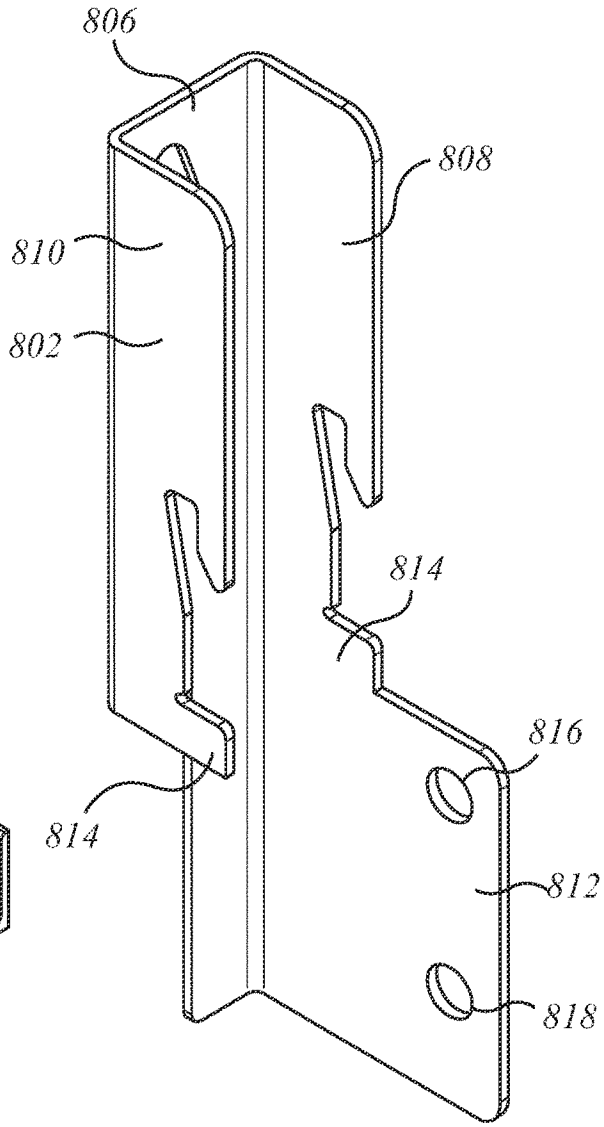
Figure 20A:
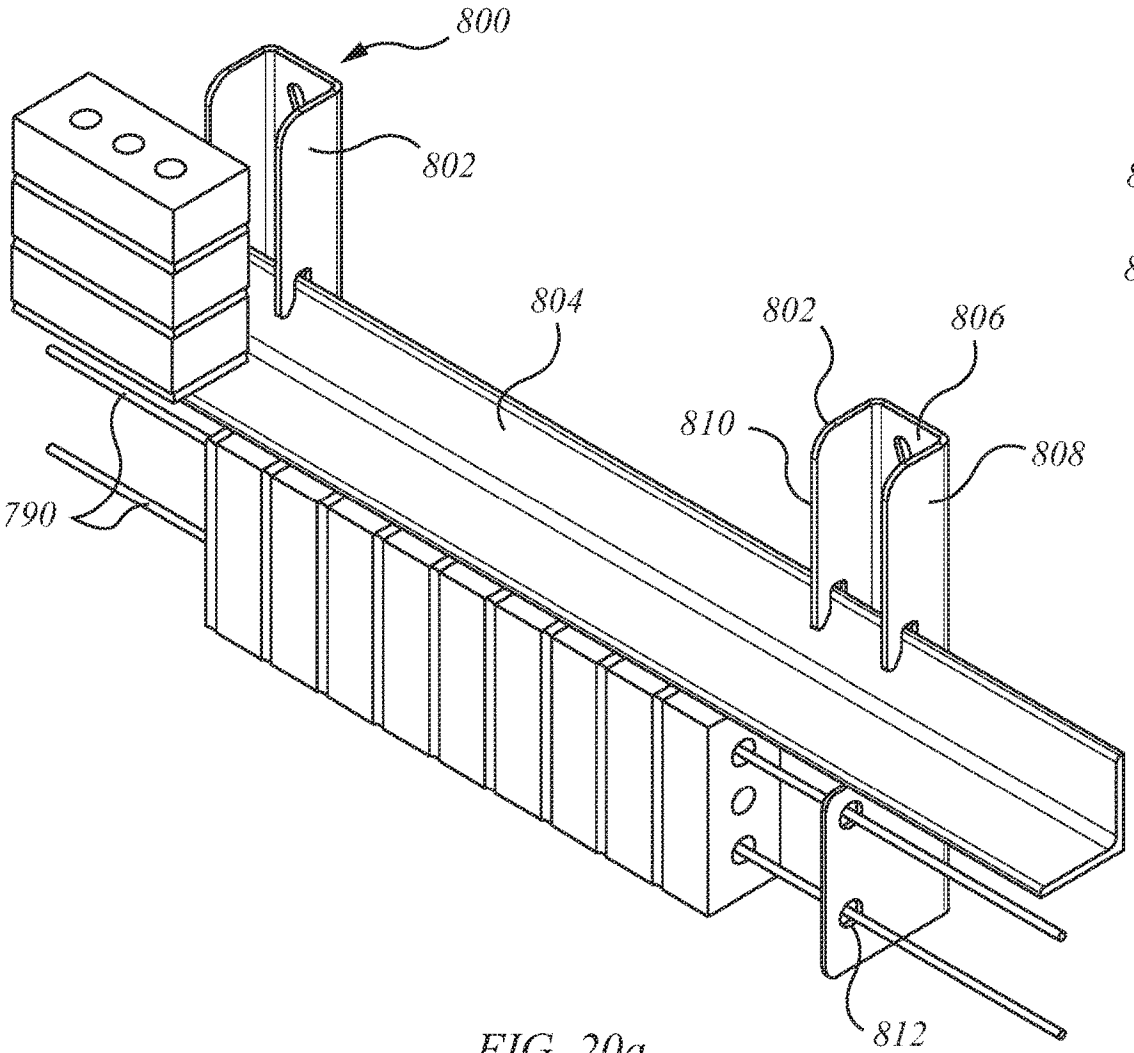

FIG. 20*a* is a perspective view of an alternate form of double-bracket shelf angle mounting assembly with an under-hung brick arrangement;

FIG. 20*b* is a perspective view of the mounting bracket of FIG. 20*a;*

Figures 20C, 20D, 20E:
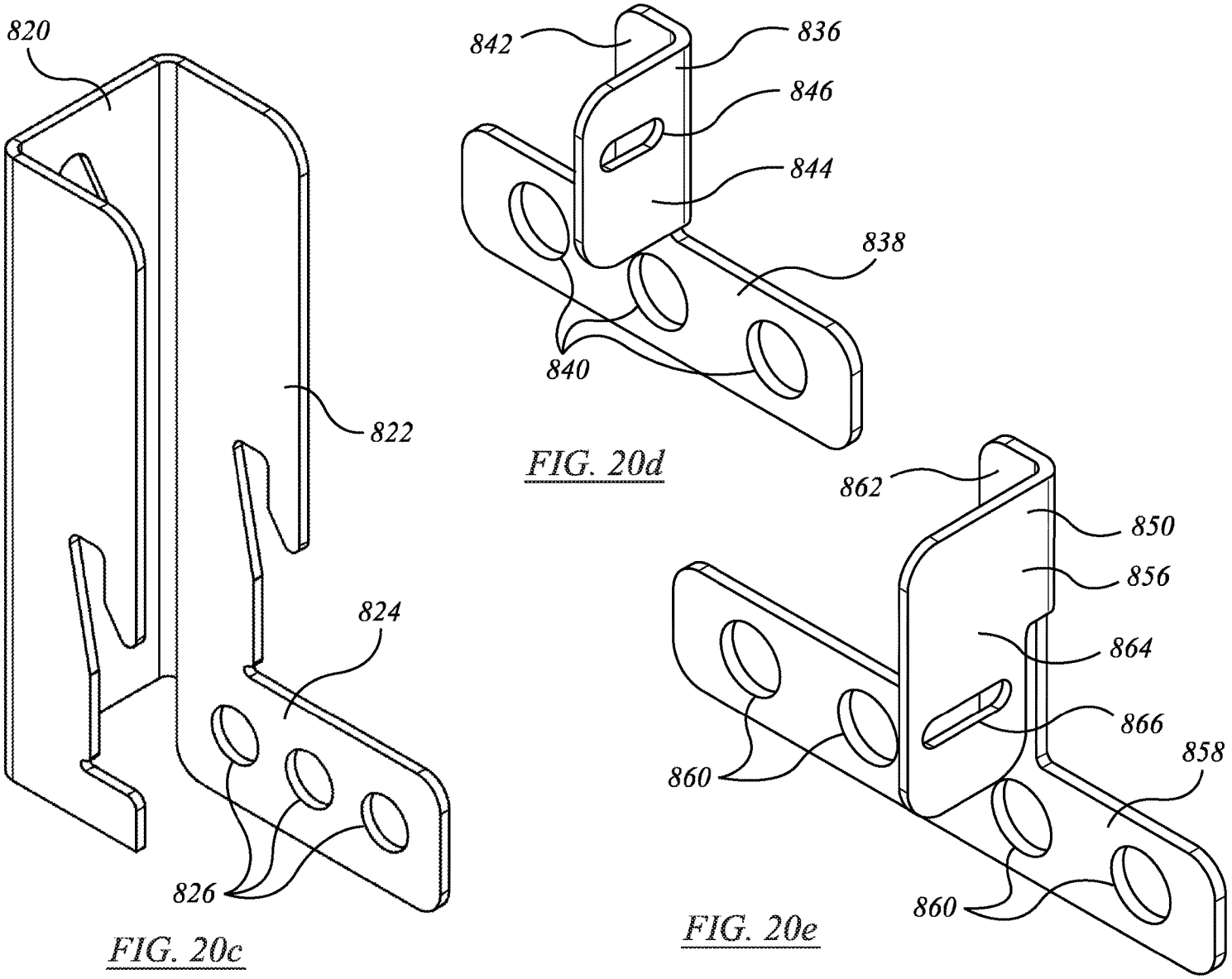
Figure 20H:
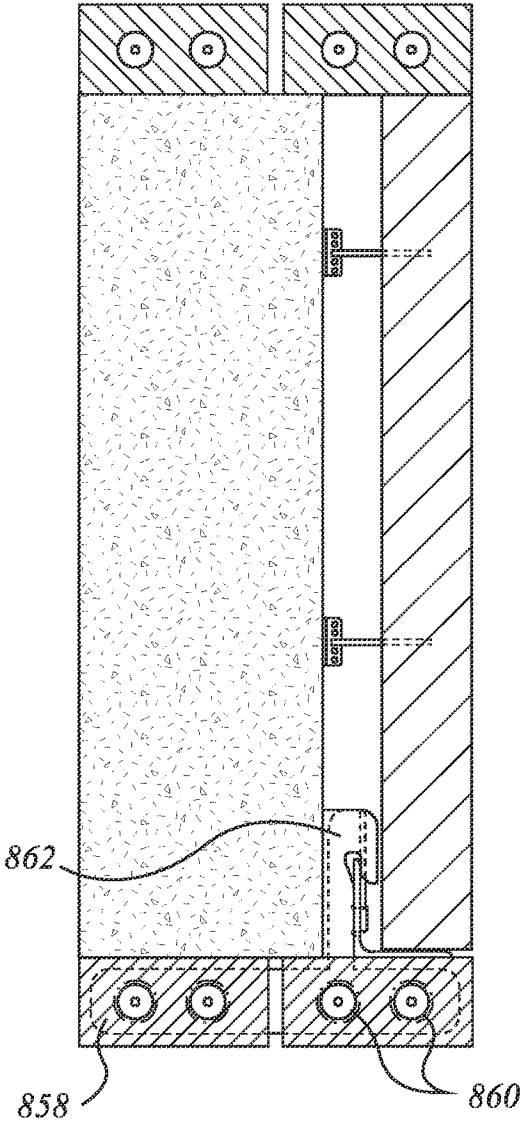
Figure 20G:
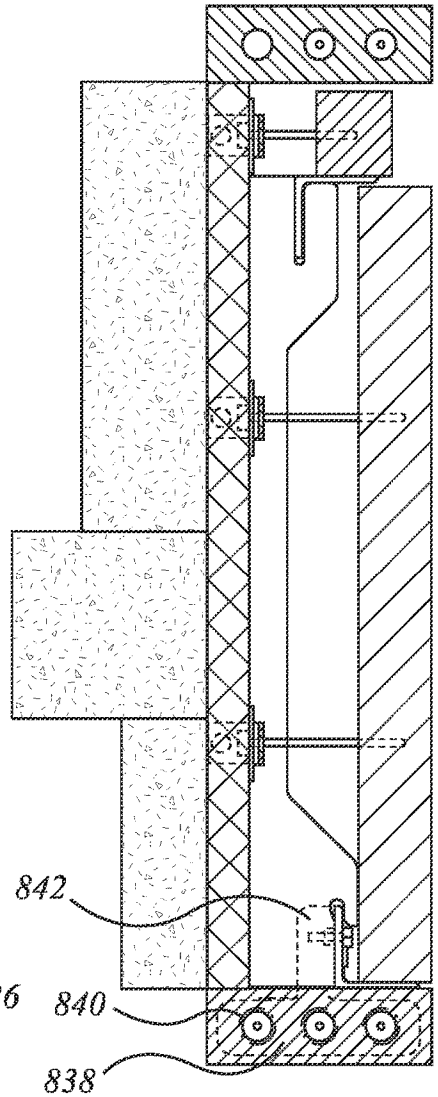
Figure 20F:
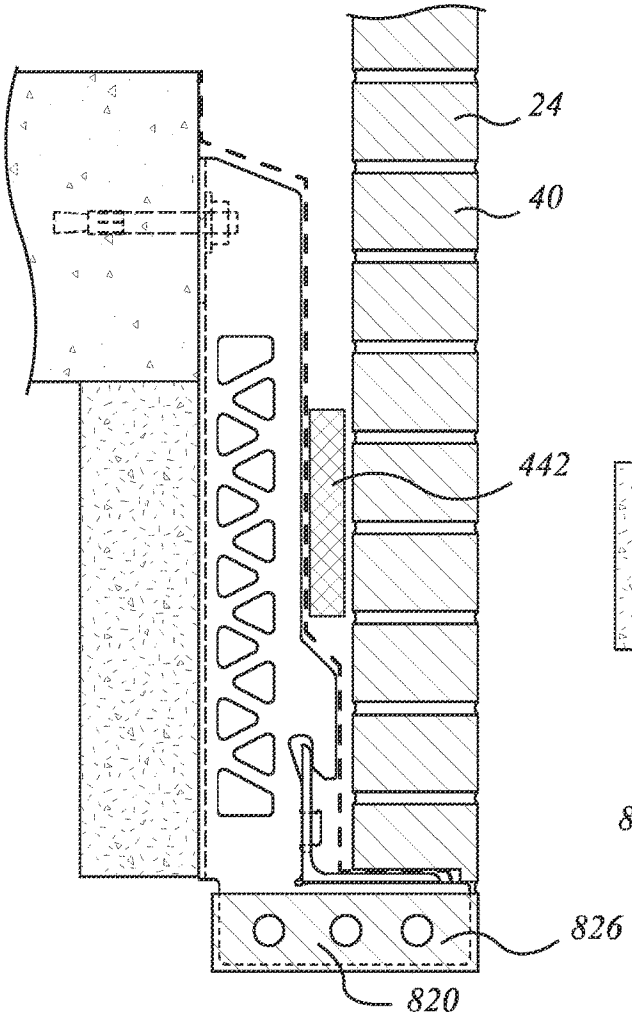

FIG. 20*c* shows an alternate embodiment of mounting bracket to that of FIG. 20*b* for an underhung brickwork arrangement;

FIG. 20*d* shows a further alternate embodiment to that of FIG. 20*b* for mounting underhung brick;

FIG. 20*e* shows a further alternate arrangement to that of FIG. 20*d* for a multiple underhung brick arrangement;

FIG. 20*f* shows a side view of an alternate assembly to that of FIG. 20*a;*

FIG. 20*g* shows a side view of the apparatus of FIG. 20*d* as installed; and FIG. 20*h* shows a side view of the apparatus of FIG. 20*e* as installed.

DETAILED DESCRIPTION

The description that follows, and the embodiments described, are provided by way of illustration of an example, or examples, of embodiments of the principles of the invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The terminology used in this specification is thought to be consistent with the customary and ordinary meanings of those terms as they would be understood by a person of ordinary skill in the art in North America. The Applicant expressly excludes all interpretations that are inconsistent with this specification. In this description the term "shelf angle" is a term of art in the field of masonry installation. It refers to an angle iron having a horizontal leg and a vertical leg. The horizontal leg defines a flat surface upon which masonry veneer is installed. The masonry veneer is typically in the form of bricks. The vertical leg of the shelf angle mates with mounting brackets that carry the vertical load of the veneer into the supporting wall structure. The shelf angle extends to span a number of mounting brackets. Unless stated otherwise, shelf angles and mounting herein are fabricated from mild steel. The steel may have anti-corrosion or anti-heat transfer coatings, or both.

In the various embodiments, the exterior of the mounting bracket may have an external coating. That coating may be a low thermal conductivity coating. It may be referred to as a thermal insulation coating, or a thermal resistance coating, or a thermal barrier, or thermal barrier coating, or thermal insulation layer. In this discussion, "low" thermal conductivity can be arbitrarily assessed as being less than 1 W/m-K. In general, thermal conductors such as metals and metal alloys have a thermal conductivity greater than 1 W/m-K. By contrast, materials commonly understood to be thermal insulators, such as wood materials, plastic resins, insulating ceramics, and so on, tend to have a thermal conductivity less than 1 W/m-K In some embodiments, the coating may have a thermal conductivity that is less than 1/50 of the thermal conductivity of the material from which the body of the mounting bracket is made, e.g., mild steel. In some instances the thermal conductivity of the coating may be less than 0.1 W/m-K.

Referring to the general arrangement of FIG. 1*a*, there is a partial cross-section of a wall assembly, indicated generally as 20. For the purposes of this description it may be helpful to consider a Cartesian co-ordinate frame of reference. The vertical, or up-and-down, direction may be designated as the z-axis, or z-direction. The direction perpendicular to the plane of the page may be considered as the longitudinal direction or x-direction, or x-axis, and may be taken as being the cross-wise direction of the wall. The left-to-right direction in the plane of the page, i.e., perpendicular to the wall, may be considered the sideways, or y-direction, or y-axis.

In this description, reference is made to load-bearing structure, and load-bearing wall structure. The description pertains to mounting bracket assemblies that support external facing veneer components, such as face brick, spaced away from the supporting structure. The mounting brackets are anchored to load-bearing structure. Whether that load bearing structure is a structural wall, or a concrete floor slab carried by framework, by a poured wall, by a block wall, or other load bearing members, in the context of this description whether it is a wall, a floor, or a ceiling, within the meaning of this specification it is a load-bearing wall structure to which the veneer supporting members may be mounted.

Wall assembly 20 may include load-bearing structure, indicated generally as 22, and externally visible facing elements, indicated generally as 24. The externally visible facing elements are mated to, or linked to, or stabilised by, load bearing structure 22. The linking, or positioning of the facing elements with the load-bearing structural elements may be achieved by the use of interface elements such as supports, or support assemblies, 26, and tying members 28. Support assemblies 26 and tying members 28 may be taken as being made of mild steel unless otherwise noted. Combinations of load bearing frame or wall assemblies, such as 22, facing elements 24, support assemblies 26 and tying assemblies 28 may be assembled as indicated in FIG. 1*a*.

Load-bearing structure 22 may have several different forms. First, it may include a foundation, which may be a poured concrete foundation 32. There may be a floor structure, such as a poured concrete floor slab 34. Floor slab 34 may carry a wall structure 36 which may have the form of laid blocks 38, or which may in other embodiments include a framed structure, such as may be a wood or steel framed structure.

Visible facing elements 24 may include brickwork 40, or stonework, be it rough stone or finished stone, or other cladding. There are many forms of visible facing elements, which may be referred to generally as masonry veneer. Masonry veneer is often in the form of face brick. The anchor system described may be used for supporting masonry veneer, thin granite veneer, large stone panels or pre-cast concrete in place of the bricks. In the example shown, facing elements 24 are shown as bricks 42 laid in successive courses.

As suggested by FIG. 1*a*, Support assembly 26 may include a first member 50, which may have the form of a support bracket 52. Support assembly 26 may also include a base or bench or second member 44 that may have the form of a "shelf angle", or angle iron 46. Angle iron 46 runs along the wall structure in the horizontal direction and provides the bed upon which the lowest course of bricks finds its support, hence angle iron 46 may be termed a brick support. Angle iron 46 may rest with the back of the angle iron seated above a non-load bearing abutment or stop or skirt such as plate 48. Second member 44 may be mounted to first member 50. First member 50 is itself fixedly mounted to the load bearing wall structure. The vertical load of the facing, e.g., bricks 42 is carried by the bench or "shelf" of second member 44, and passed into such number of first members 50 as may support second member 44.

There may typically be at least first and second such second support members 50 spaced laterally apart. For example, there may be several such supports on, for example, 24" centers, indicated as spacing $L_1$, which may correspond to the spacing, or double the spacing of wall studs in standard framing (see FIG. 3*e*). First members 50 may then carry the shear load from second member 44 into the load bearing wall structure. The depth of first members 50 in the y-direction (i.e., normal to the wall) may typically be less than the vertical height of first members 50, such that the webs of first members 50 may be considered low aspect ratio beams in which the bending moment is small, or negligible.

First members 50 are secured to load bearing wall 22. The securement may be by suitable means. For example mechanical securements in the nature of threaded fasteners 54. In the case of securement to a poured concrete wall or floor slab (as shown) the fasteners may be concrete anchors. Fasteners 54 may be concrete anchor fittings, as shown in FIG. 1*a*, or embedded threaded rods, studs, or bolts, as in FIG. 1*b*.

First members 50 have a depth (in the y-direction) that may correspond to, or may be greater than, the thickness of insulation panels 56 such as may be mounted to the front (or outside) face of the structural load-bearing wall assembly 22. There may also be a drainage shield, or flashing, 58 such as may encourage moisture to drain outwardly of and away from structural wall assembly 26. A vapor barrier membrane 59 may be captured behind insulation panels 56 upwardly of the floor slab, may traverse insulation 56 at the level of flashing 58, and may lay overtop of flashing 58 with its lowermost margin draining over angle iron 46, such that any moisture draining over vapor barrier 59 is drained away. That is, a continuous metal flashing 58 is supported on or above shelf angle 46. It may connect to a continuous flexible flashing which extends over the brick supports and that may connect to a vapour barrier membrane on the outer face of the wall. Sheets of rigid insulation are mounted over top of the membrane on the outer face of the wall. The anchor system allows cavity insulation to be continuous behind the brick support. The rigid insulation may be of a thickness that allows an air space between the insulation and the external veneer brick facing mounted on shelf angle 46. The anchor brackets 52 may be made in a variety of sizes each corresponding to a desired thickness of the rigid insulation and air space. In this arrangement, a standard size of brick support shelf angle 46 may be used without regard to the spacing between the brick facing and the face of the wall desired for insulation.

In some embodiments, tying members 28 may be located upwardly of support assembly 26. Tying members 28 may have the form of brick tie assembly 60, in which there is an anchor 62 and a brick tie 64. As may be noted, anchor 62 has a body 66 such as may have the form of a stamped steel plate. The distal portion of body 66 may be termed a tail 68. Tail 68 may have a length in the y-direction (i.e., into the wall) corresponding to the through thickness of cinder blocks 38, and such as may be located between adjacent blocks of a block wall, and embedded in the mortar therebetween. To that end, tail 68 may have perforations such as may permit mortar to flow therethrough. Body 66 may also have a proximal portion 70 of a depth in the y-direction corresponding to the thickness of insulation panel 56. Proximal portion 70 may be perforated to reduce thermal conduction in the y-direction. Proximal portion 70 may have a step, or abutment, or indexing or locating feature, such as a shoulder, by which the correct depth position in the y-direction is obtained relative to the cinder block and the insulation. Body 66 may also have an outermost end portion 74 having an array of tie location apertures, or seats or positions 76. A faceplate 78 seats on the outside face of the insulation, and may be used on installation where the positioning of anchor 62 is set prior to installation of tail 68 in a poured concrete form. Brick tie 64 is then located in one or another of the seat positions 76. When the successive courses of bricks 42 are laid, the outermost ends of brick tie 64 are embedded in the mortar between courses, as suggested in FIG. 1*a*. Tying members as described are used where the air or insulation space between the load bearing structure and the external veneer exceeds one inch, and in all cases where the wall height exceeds 30 ft. Tying members such as those described may be placed on up to 24 inch spacing vertically, and up to 32 inch spacing horizontally.

Considering the enlarged detail of the embodiment of FIG. 1*b*, support bracket 52 may have the form of a channel 80 (as viewed from above, as in FIG. 1*c*) having a first member in the nature of a rear plate or back 82, and a second member in the nature of a web or leg 84. Channel 80 may also have a third member in the nature of a second web or leg 86. In the embodiment shown, legs 84 and 86 stand outwardly of back 82. That is, as installed back 82 may lie in an x-z plane abutting the load bearing structure, be it framing, metal girders, poured concrete wall or poured concrete slab, and so on. Legs 84 and 86 stand outwardly away from that x-y plane. In general, it may be convenient that legs 84 and 86 stand in y-z planes perpendicular to the plane of back 82, standing spaced apart and parallel, but this is not necessarily so. For example, legs 84, 86 could be splayed to form a V or winged shape as opposed to a square-sided U. In the particular embodiment illustrated, legs 84, 86 are a pair of side plates that extend from respective sides of the rear plate, back 82, in a direction away from the wall to form the sides of the U-shaped channel. The side plates are generally rectangular in shape and lie in respective vertical planes.

Back 82 may have a mounting, a seat, or an attachment fitting 90 such as shown in FIG. 2*c* by which mechanical fastener 54 may secure bracket 52 to the load bearing structure. In general, in all of the embodiments herein a shim plate, such as may be substantially similar in size to the anchor bracket, may be mounted between each anchoring bracket and the outer face of the wall (i.e., load-bearing wall assembly 52), as may be suitable, for evenly engaging the concrete surface and for spacing each anchor bracket 52 from the wall as desired to accommodate irregularities in the outer face of the wall. Fitting 90 may be a slot 92 that permits height adjustment of bracket 52. Slot 92 may be oriented at a non-parallel angle or direction that is skewed relative to the vertical axis. Slot 92 may be an elongate aperture in back 82 that extends along an inclined axis 83 angularly offset from vertical. FIG. 2*c* shows a left-hand configuration. The inclined axis may be offset 22.5 degrees from vertical. In a right hand configuration the fastener slot may be offset 22.5 degrees from vertical axis in the opposite direction. The upright plate of back 82 can thus be fastened to the wall at numerous locations relative to the wall corresponding to different positions of the bolt within the slot. As installed, fastener 54 may be in tension, and the lowermost edge of back 82 may be in compression, i.e., pressed against the load-bearing structure, such that there is a moment reaction and a moment arm, $z_{54}$. Slot 92 may be located closer to the upper margin of bracket 52 than to the lower margin, such that moment arm $z_{54}$ of the reaction of bracket 52, defined as the distance from the centerline of fastener 54 to the lower margin, is typically greater than half the height of bracket 52, indicated a $z_{52}$, (FIGS. 1*b* and 2*c*). In the default, the upper datum of $z_{54}$ may be taken as the mid-height location of fitting 90, namely half way up in the middle of slot 92. Slots 92 of successive brackets 52 may be alternately left handed and right handed. That is, in use, a plurality of anchor brackets may be spaced horizontally across a wall using a chalk line and a measuring tape. The anchoring brackets are mounted in an alternating arrangement of left-hand and right-hand configurations. The brackets are mounted along the wall such that each anchoring bracket having a left-hand orientation is beside an anchor bracket having a right-hand orientation. On installation, the vertical shear load may tend to cause the brackets to wedge and lock in position on the fasteners.

The side plates defined by legs 84, 86 receive and carry the brick support defined by bracket 46. Looking at leg 84 as being representative also of leg 86, and considering the profile shown in FIGS. 1*b* and 2*b*, the distal portion of leg 84 (i.e., the portion standing away most distantly from back 82) has a fitting, or accommodation, or seat 94 that is matingly co-operable with second member 44, and that provides a shear load transfer interface in which a vertical gravity load from member 44 is transferred into web 84 (or 86 as may be). The profile of each seat 94 in the respective side plates of legs 84, 86 may have the appearance of a recessed channel in the forward or foremost, or distal edge or margin thereof.

Seat 94 includes a vertical reaction interface, indicated at 96, and a moment restraint, indicated at 98. Moment restraint 98 includes an upper reaction member 100 and a lower reaction member 102. Leg 84 (or 86) may have an overhanging member, or finger 104 that, in use, overreaches, and depends in front of, the uppermost margin of second member 44. The space between finger 104 and the upper leading edge of the body of leg 84 (or 86) more generally defines a receiving slot 107 as, or at, the upper portion of seat 94. Slot 107 extends upward, and has a rearward edge (i.e., at edge or wall 114) at a top end of the recessed, generally channel-shaped profile of seat 94. The inside face of the downward or distal tip of finger 104 may have the form of an abutment, or stop, or restraint that faces wholly, substantially, or predominantly in the −y direction, defining upper reaction member 100.

Vertical reaction interface 96 may be defined as the upper face of the toe, edge, or side of an extending portion or member or dog or toe 108, such as may be or define a protruding extension or protrusion in the y-direction of the lower margin of leg 84. That is, in the embodiment illustrated the recessed channel shape of seat 94 includes a shoulder at a bottom end. That shoulder defines vertical reaction interface 96, and it carries the shelf angle, such that the brick supporting flange extends laterally outward from the wall.

Lower reaction member 102 extends upwardly and away from the root of toe 108, and has the form of a wall or edge that faces wholly, substantially or predominantly in the +y direction. A fatigue detail, or stress relief detail, in the form of a finite radius relief 110 is provided at the root of the intersection of vertical reaction interface 96 and lower reaction member 102. The upper and lower stops (i.e., 100 and 102) constrain the translational degree of freedom of corresponding upper and lower regions of angle iron 46, and thus define a moment-couple reaction inhibiting motion in the rotational degree of freedom about the x-axis of angle iron 46 in the counter-clockwise direction.

Upwardly of an inflection point 112, wall 114 of seat 94, (being the back or rearward margin of slot 107) is relieved in the −y direction such that seat 94 may include, and slot 107 may be, a slanted slot or accommodation such as to permit entry of the upper leg of angle iron 46 into the accommodation on installation. The angle of inclination air may be in the range of 10-20 degrees in some embodiments. The lowermost extremity of the inside tip of finger 104 may also be trimmed, or tapered, or chamfered as at 115. The angle or size of the chamfer or relief at 115, designated as $\alpha_{115}$, is steeper, i.e., smaller, than the size of angle $\alpha_{107}$ of the chamfer or relief of wall 114. That is, whereas wall 114 may be angled at 10-20 degrees, from vertical, the relief at 115 may be more than 20 degrees, and may be about 24 or 25 degrees. Lower reaction member 102 may extend in a vertical plane, $P_{102}$. Upper reaction member 100 may extend in a vertical plane $P_{100}$. Planes $P_{102}$ and $P_{100}$ may be parallel and spaced apart, with upper reaction member 100 being more distant from back 82 than is lower reaction member 102. They may be spaced apart by a distance corresponding to the through thickness of the upstanding leg of angle iron 46.

The overall height of seat 94 may be taken from the vertical shear transfer receiving interface of shoulder 96 to the uppermost extremity of slot 107, and is indicated as $h_{94}$ in FIG. 1*b*. In this embodiment, shelf angle 46 is mounted at a height that corresponds generally to the height of the attachment interface of back 82 to the load-bearing support wall structure. This may be expressed several ways. First, it may be expressed in the relative squareness of the mounting bracket when seen in side view, as in FIGS. 1*b* and 2*b*. In this embodiment the most distant extremity of toe 108 is the same distance from back 82 as is the most distant extremity of finger 104. That distance, $y_{108}$, may be comparable to the overall height of member 50, indicated as $z_{52}$. It may be that the ratio $z_{52}/y_{108}$ may lie in the range: $2/3<z_{52}/y_{108}<3/2$. As another measure of squareness, the lateral projection of fastener 54 falls between the upper and lower boundaries of seat 94. Expressed differently again, the projection of the y-direction of mounting fitting 90, namely slot 92, falls within the projection of seat 94 in the y-direction. This may be expressed equivalently as the projection of seat 94 in the y-direction including the footprint of the mounting fitting. Either of those conditions also implies that the y-direction projection of shelf angle 46 also falls upon the mounting fitting footprint. As another expression of the squareness, it may be said that seat 94 lies opposite to mounting fitting 92, or generally substantially or predominantly in line with mounting fitting 92, as opposed to being offset downwardly therefrom as in the apparatus shown of FIGS. 6*a*-6*d*, discussed below.

The brick support defined by angle iron 46 may include a mounting flange which engages anchor bracket 50, and a supporting flange arranged to carry bricks. The mounting flange and the supporting flange may typically be mounted at right angles to form an L-shaped angle iron, typically made of steel. As in FIG. 3*a*, angle iron 46 has a first or horizontal leg 116 and a second or vertical leg 118. Horizontal leg 116 extends forwardly (in the +y direction) away from vertical leg 118, and hence on installation also forwardly and away from bracket 52. Horizontal leg 116 runs along the wall structure in the x-direction. Typically the running length of the angle iron is much greater than the horizontal leg length. For example, in one embodiment the running length may be 72 inches, while the leg of the angle may be 6 inches or less. In various embodiments the x:y aspect ratio of lengths may be in the range of 4:1 to 16:1. Bracket 52 may be cut to length as may suit. As installed, the length of leg 118 proud of the end of toe 108 in the y-direction may have a length corresponding to the depth in the y-direction of the facing members to be supported. In the case of face brick, that length corresponds to the depth of the face brick. In some embodiments it may be somewhat less than the depth of the face brick to permit the iron to be less noticeably visible, as in FIG. 1*a*, or to be hidden, as in FIGS. 6*a*-6*d*.

In the embodiment of FIG. 1*a*, vertical leg 118 has an accommodation, slot, aperture, socket, or relief, or reliefs 120, 122 spaced upwardly from the junction of members 116 and 118. The lower margin of reliefs 120, 122 may be located at or above the run-off of the rolled radius between members 116 and 118, i.e., in the tangent portion of the vertical leg, rather than in the radius. Reliefs 120, 122 are sized to receive the dogs, or toes 108 of web members 84 or 86. They are over-sized in the x-direction to permit lateral adjustment of bracket 52, as, for example, according to the fastener position along inclined slots 92. For half inch thick legs, the slot may be 2.5 inches wide, giving, potentially, one inch play to either side of center. The height of the slot may be slightly oversize to permit rotating installation of bracket 52. The vertical through thickness of each toe 108 may be 1" or more.

In the engagement of toe or dog 108 in accommodation or relief 120 or 122, as may be, it may be that the lowermost margin of leg 84 (or 86) does not extend lower than (i.e., downwardly proud of) the bottom of horizontal leg 116, such that no additional vertical clearance allowance is required for toe 108, meaning that the toe is concealed behind the external veneer and the bottom edge of the lowest course of bricks may be lower than otherwise. Expressed differently, in terms of a seating arrangement of structural members, first member 50 may be considered to be the receiving member, and second member 44 may be considered to be the received member. In the arrangement of FIGS. 1*a*, 1*b*, and 3*a* to 3*e*, the received member is flush with, or extends downwardly proud of, the lowermost portion or extremity of the receiving member and may tend to conceal the receiving member from view. The engagement of the receiving and received members is a mechanical interlocking relationship that is biased into securement by gravity acting on the load. That is, while the angle iron may be adjustable and engageable while unloaded, the loading of bricks or other surface elements may tend to increase the moment couple on the angle iron, such as may tend to tighten the hold of the moment couple reaction members of the receiving member.

The receiving slot 107 slidably receives an edge portion of the mounting flange of leg 118 therein such that the brick support remains secured to the anchoring bracket 46 when a weight of bricks is stacked on the supporting flange of leg 116. The rearward edge 114 of receiving slot 107 extends upward at a slight rearward incline for accommodating the edge portion of the mounting flange of leg 118 as it is inserted therein. A wedge shaped shim may then be inserted between the distal tip of leg 118 and the rearward edge 114 such as to lock the assembly in tight engagement.

The received member, such as the shelf angle identified as angle iron 46, is itself a receiving member, or accommodation, for the externally visible facing elements, and as the facing elements are received, rearward structure such as bracket 52 is obscured from view. The received member need not be an angle iron, and whether or not it is an angle iron, is need not have a 90 degree angle. More generally, the received member has a first portion that defines a seat or bench, or accommodation, or support, or platform or undergirding, or shelf, for the externally visible facing members, hence the term "shelf angle". It is a form of sill. The received member also has a second portion that engages the receiving member such that vertical load from the received member is transmitted or carried into the receiving member and thence into the load-bearing supporting structure. In that sense the second portion can be thought of as an engagement fitting, or key, or inter-locking feature, or indexing feature, that mates with the receiving member. It happens that an L-shaped angle iron may be a convenient form having these properties.

In the embodiment shown in FIG. 1*a*, inasmuch as each leg 84, 86 may pass through the wall insulation panels 56, each leg may also have an array of apertures as at 124, such as may reduce the section for heat transfer in the y-direction. In some embodiments apertures 124 may be non-circular, and may have an oval, oblong, or elliptical form. The form of aperture may have a long axis and a short axis. The long axis may be inclined at an angle to the perpendicular. In one embodiment the angle of inclination may be about 45 degrees. The interstitial strips 126 between adjacent apertures may tend to be correspondingly inclined on a generally diagonal angle. On the diagonal angle, the diagonal may be oriented from outwardly and downwardly to upwardly and inwardly, i.e., the mean slope dz/dy in FIG. 1*b* is negative. As such, a vertical load imposed at interface 96 may tend to place members 126 in tension, or to impose a tensile load component in them.

In the alternate embodiment of FIGS. 5*a* and 5*b* there is a first member of a support assembly, identified as bracket 128. Bracket 128 has a back 130, and first and second legs 131, 132, the legs and the back being joined together to for a U-shaped channel as indicated. In this instance the seat for the shelf angle may be defined by a slot 134 and the uppermost end 135 of an upwardly extending finger 136. In this example, the shelf angle (not shown, but understood to be the same as, or similar to, shelf angle 162, below) may seat in an inverted orientation, with the back web extending downward into the slot, and the root of the horizontal flange being supported on ends 135 of fingers 136. The ends of fingers 136 are vertically shy of the upper edge 133 of the proximal portion of legs 131, 132 such that, on installation, the upwardly facing surface of the horizontal flange of the inverted shelf angle may lie flush with edges 133. Ends 135 may define the shear load receiving interface. Given the downward vertical loading orientation of the accommodations defined by slots 134, slots 134 may be straight-sided, since they do not have to allow for angular rotation upon entry. Slots 134 may nonetheless define a moment-couple reaction interface such as may tend to react the eccentric moment due to loading on horizontal flange. Bracket 128 may have an array of reliefs or apertures, as indicated at 138. Apertures 138 may be non-circular, and may have a major axis and a minor axis, as do the elliptical apertures shown in FIGS. 5*a* and 5*b*. As before, the major axis of the ellipse may be angled upwardly and inwardly toward back 130. Apertures 138 may correspond in number, size, spacing, angle, and arrangement to apertures 124 in FIGS. 1*b* and 2*b*. Back 130 may have a mounting fitting, such as slot 129, which may be taken as being the same as slot 92 noted above. As above, bracket 128 has a general squareness when taking the ratio of z-direction height to y-direction depth, falling in the same range as member 50 discussed above. Likewise, the seat defined by slot 134 has the same y-direction relationship of projection relative to slot 129, the slot being opposed or generally in line with the mounting fitting. Whether upright, as in FIGS. 1*a* and 1*b*, or inverted, as in the embodiment of FIGS. 5*a* and 5*b*, the shelf angle and bracket assembly may employ apertures to reduce thermal conductivity through the bracket in the y-direction.

Support assemblies 26 need not be located only at the lowermost course of facing elements. As seen in FIGS. 6*a*, 6*b*, 6*c*, and 6*d*, such assemblies may be located at intermediate height locations, where there are bricks both above and below the support bench defined by the horizontal leg of the shelf angle. Such intermediate height locations may occur at horizontal control joints, which may typically be employed in non-residential structures having wall heights in excess of 30 ft. A shelf angle may then be used for each successive storey. Whatever the case may be, the height of the structure to which the support assembly may be mounted may not necessarily be the height of the structure at which the shelf angle is to be located. As suggested by the illustrations in FIGS. 6*a*-6*d*, there may be circumstances when the shelf angle is to be located some distance below the level of the securement to load-bearing structure.

Considering FIG. 6*a*, structural load-bearing wall assembly 140 may have steel framing 142 and a floor slab 144. A hard-point, or rail, 146 is located at the end of floor slab 144. A mounting fitting 148 is secured to rail 146. An external facing veneer assembly is identified as 150. Veneer assembly 150 has a horizontal expansion joint 152. Veneer assembly 150 is connected to wall assembly 140 by a vertical load transfer assembly 160 that, as before, includes a first member 164 and a second member 162. Second member 162 may be the received member, and may be a shelf angle. The shelf angle may have a first portion identified as horizontal leg 166 and a second portion identified as upright leg 168. The shelf angle, and in particular horizontal leg 166, may be located at the position of horizontal expansion joint 152, such that it bears the vertical load of that portion of wall assembly 150 extending upwardly thereof.

First member 164 may be the receiving member with which it co-operates, and may be a channel-shaped bracket 170. As before, the receiving member 164 is rigidly secured to the load bearing wall structure, namely wall assembly 150. On installation, the back of bracket 170 lies in facing abutment against the load bearing wall structure in the same manner, or substantially the same manner, as member 50 described above, and where the wall is vertical, bracket 170 is correspondingly vertical. The load output interface of vertical load transfer assembly 160, namely the connection to the load bearing wall, is located at a first height, identified as $H_{164}$. The load input interface of assembly 160, at which the vertical load of the external veneer or cladding is received at leg 166, is identified as a second height, $H_{166}$. The first height is substantially higher than the second height. That is, $H_{162}$ lies at a level that is below the height of the bottom margin of the floor slab, and at a height that is more than two brick courses (i.e., more than 6") below $H_{164}$. Side web or leg 172 of channel or bracket 170 is much deeper in the z-direction (see $H_{172}$) than is the depth of the accommodation for the shelf angle, i.e., second member 162, identified as $H_{168}$.

In the embodiment of FIG. 6*a*, first member 164 may have substantially the same mounting arrangement and adjustability as back 82 of bracket 46. The receiving seat or accommodation may differ, though. That is, there may be a vertical load reaction member, in the nature of a protruding toe 174 having an upper shoulder or side, or face, upon which shelf angle 162 rests. A relief or slot, or rebate, or accommodation 176 may extend upwardly therefrom, the slot being bounded by a first wall or vertex, or abutment 178 that defines the first moment couple reaction interface. At the upwardly distant end of accommodation 176 there is an overhanging, downwardly extending finger 180, the overhang being spaced away forwardly by a gap defining a slot 182 sized to fit the upper margin of the angle iron leg. The inner face or side of finger 180 defines the second moment couple resisting interface 184.

In FIG. 6*b*, insulation 182 is located in the space between load-bearing wall assembly 140 and veneer assembly 150. Bracket 184 is may be understood to be the same as bracket 164, except insofar as, in the manner of the embodiment of FIG. 1*a*, web 186 of bracket 184 is perforated as at 188 to reduce the conduction heat transfer path width across the bracket. In FIG. 6*c*, bracket 190 is substantially the same as bracket 46, except of greater vertical extent in the manner of bracket 164; or, equivalently, bracket 190 is substantially the same as bracket 184 except in respect of having a receiving seat 192 that corresponds to the receiving seat of bracket 46. In this embodiment, second member 194 may be taken as being the same as second member 44 in having apertures or reliefs 120, 122 in the upstanding leg that engage with the protruding toes 108 of the various spaced bracket. It may be that such an embodiment may be desirable where the shelf angle forms a header or sill over a window or door opening or window or door installation, as at 196.

The embodiment of FIG. 6*d* is substantially the same as the embodiment of FIG. 6*a*, except insofar as it shows a vertical load transfer assembly 200 in which the receiving load transfer member, or bracket, 202 is of greater length than in FIG. 6*a*, such as may be suitable where the expansion joint (or window header or door header) is more distant from the floor plate to which the assembly is anchored. The embodiment of FIG. 6*d* may also be modified to correspond to the embodiments of FIGS. 6*b* and 6*c*, as may be.

In each of FIGS. 6*a*-6*d*, if one defines a load center at the vertical load input interface of the seat, notionally $C_{174}$ and another load center at the connection point, or centroid, of the fastening connection or connections to the load-bearing wall structure, notionally $C_{164}$, the line of action constructed between those centers extends upwardly and toward the load-bearing structure. That line of action is predominantly upwardly oriented, i.e., the rise is greater than the run, as suggested by the ratio of $\mathbf{164}_{Rise}/\mathbf{174}_{Run}$. This may also be expressed in terms of the hanging, non-square nature of the mounting brackets of FIGS. 6*a*-6*d*. In these embodiments the y-direction projection of the seat does not fall on the footprint of the mounting fitting, but rather falls well below it. The seat is not in line with the mounting fitting. On the contrary, the seat is downwardly displaced from the center-line of the mounting fitting at $C_{164}$ by several pitches of the magnitude of the seat height, $H_{168}$. This downward offset of seat 168 (or, from the other perspective, upward offset of fitting 148) is more than one pitch of the seat height, and may be up to 6 or 8 pitches, or may lie in the range of 2 to 8 pitches of the seat height.

In each of the embodiments of FIGS. 6*a*-6*d* it may be that the receiving member, such as 170, may be a bracket having a channel-shaped cross-section when viewed from above, that cross section being substantially similar to, or the same as, that of member 50 such as illustrated in FIG. 1*c* or 2*a*. However, in an alternate embodiment, the receiving member, corresponding to item 170, may have a single web standing outwardly away from the supporting load-bearing wall structure. The web may be aligned on the center-line of the fastening mount at item 148. In some embodiments the receiving member may be an angle bracket having a flange that locates in facing abutment against the wall structure, and a web that stands perpendicular to the wall structure.

FIGS. 7*a* and 7*b* illustrate an alternate support assembly 210 that may be used at intermediate height locations, with bricks both above and below the support bench defined by the horizontal leg of the shelf angle. As suggested by FIGS. 7*a* and 7*b*, there may be circumstances in which the shelf angle is to be located some distance above the level of the securement to load-bearing structure 212.

In FIG. 7*a*, an external facing veneer assembly is identified as 214. Veneer assembly 214 is connected to wall assembly 212 by a vertical load transfer assembly 218 that, as before, includes a first member 220 and a second member 230. First member 220 may be a receiving member with which second member 230 co-operates. As shown, first member 220 may be a mounting bracket such as may have the form of a channel-shaped bracket 222. As before, receiving member 220 is rigidly secured to the load bearing wall structure, namely wall structure 212. Member 220 includes a mounting fitting 254, which may be the same as or similar to fitting 90, in which a securement member or fastener, such as a bolt 216 can be received. On installation, the back of bracket 222 lies in facing abutment against the load bearing wall structure in the same manner, or substantially the same manner, as member 50 described above, and where the wall is vertical, bracket 222 is correspondingly vertical, i.e., extends predominantly or entirely in an upright direction. Second member 230 may be the received member, and may be a shelf angle 232. Shelf angle 232 may have a first portion identified as horizontal leg or flange 234 and a second portion identified as upright leg or back 236. Shelf angle 232, and in particular horizontal leg 234, may bear the vertical load of that portion of veneer assembly 214 extending upwardly thereof.

The load output interface of vertical load transfer assembly 218, namely the connection to the load bearing wall, is located at a first height, identified as $H_{216}$. The load input interface of assembly 218, at which the vertical load of the external veneer or cladding is received at leg 234, is identified as a second height, $H_{234}$. The first height is substantially lower than the second height. That is, $H_{216}$ lies at a level that is above the height of the top margin of the slab 212, and at a height that is more than two brick courses (i.e., more than 6") above $H_{234}$. Side web or leg 242 of channel or bracket 222 is much deeper in the z-direction (see $H_{242}$) than is the depth of the accommodation for the shelf angle, i.e., second member 230, identified as $H_{230}$. Positioning shelf angle 232 of vertical load transfer assembly 218 above the top margin of floor slab 212 may allow the load input interface to be aligned with other structural features, such as door or window frames. Window frames may typically be elevated above slab 212. Thus, the vertical load transfer assembly 218 may enable the load input interface to be aligned with, e.g., the upper or lower sill of the window framing.

In FIGS. 7*a* and 7*b*, first member 220 may have substantially the same receiving seat or accommodation to that of first member 164 of vertical load transfer assembly 160. However, the vertical load reaction member may differ slightly as a result of the vertical placement of seat 246 along legs 242. That is, there may be a vertical load reaction member, in the nature of a shelf 245 having an upper shoulder or side, or face, upon which shelf angle 232 rests. A relief or slot, or rebate, or accommodation 248 may extend upwardly therefrom, the slot being bounded by a first wall or vertex, or abutment 247 that defines a first moment couple reaction interface. At the upwardly distant end of accommodation 248 there is an overhanging, downwardly extending retainer or finger 244, the overhang being spaced away forwardly by a gap defining a slot 249 sized to fit the upper margin of the angle iron leg. The inner face or side of finger 244 defines the second moment couple reaction interface.

FIG. 7*c* shows an alternate embodiment of a first mounting member 260 to that shown in FIGS. 7*a* and 7*b*. As with bracket 222, shelf angle receiving seat 250 of bracket 260 is positioned proximate upper edge 276 of bracket 260 and the load input interface, such as a shelf angle, can thus be positioned above slab 212 to which bracket 260 is mounted. However, in this instance the seat for the shelf angle is similar to the seat of bracket 128 shown in FIGS. 5*a* and 5*b*. The seat may be defined by a slot 268 and the uppermost end 274 of an upwardly extending finger 266. In this example, the shelf angle (not shown, but understood to be the same as, or similar to, shelf angle 232) may seat in an inverted orientation, with the back web extending downward into slot 268, and the root of the horizontal flange being supported on ends 274 of fingers 266.

Bracket 260 has a back 262, and first and second legs 270, 272, the legs and the back being joined together to form a U-shaped channel. The ends of fingers 266 are vertically shy of upper edge 276 of proximal portion of legs 270, 272 such that, on installation, the upwardly facing surface of the horizontal flange of the inverted shelf angle may lie flush with edges 276. Ends 274 may define the shear load receiving interface at which vertical loads of the shelf angle are carried into the mounting bracket. Given the downward vertical loading orientation of the accommodations defined by slots 268, slots 268 may be straight-sided, since they do not have to allow for angular rotation upon entry. The vertical sides or edges of slots 268 define a moment-couple reaction interface such as may tend to react the eccentric moment due to loading on the horizontal flange of the shelf angle.

In each of the embodiments of FIGS. 7*a*-7*c* it may be that the receiving member, such as mounting bracket 220, may be a bracket having a channel-shaped cross-section when viewed from above, that cross section being substantially similar to, or the same as, that of member 50 such as illustrated in FIG. 1*c* or 2*a*. However, in an alternate embodiment, the receiving member, corresponding to item 220, may have a single web standing outwardly away from the supporting load-bearing wall structure as in the manner of an angle iron, T-section. The web may be aligned on the center-line of the fastening mount at item 216. In some embodiments the receiving member may be an angle bracket having a flange, like back 262, that locates in facing abutment against the wall structure, and a web 264 that stands perpendicular to the wall structure. The receiving members, such as 220 or 260, may also include an array of reliefs or apertures similar to apertures 188 shown in FIGS. 6*b* and 6*c*.

FIGS. 8*a*-8*k* illustrate a general arrangement of a wall assembly, indicated as 300. Wall assembly 300 generally includes a load-bearing structure 301, which may include various framing members 306, as well as insulation panels 308 and sheathing (be it plywood or oriented strand board (OSB)), vapour barriers 309 similar to insulation panels 56 and vapour barrier 59 respectively. Wall assembly 300 also includes an external facing veneer assembly identified as 302. External facing veneer assembly 302 may have a first or forward face 304 facing outward from the wall assembly 300 to provide a cladding on the outer surface of the structure. The external facing veneer members 302 are connected to load-bearing structure 301 by a vertical load transfer assembly 305 that, as before, includes a first member such as a mounting fitting or mounting bracket 310 and a second member, such as a shelf angle 312. As suggested by FIG. 8*a*, the vertical load transfer assembly 305 may also include an additional second member 312. First member 310 may be a receiving member with which both of the second members 312 co-operate.

Second members 312 may provide a base or bench for the external facing veneer assembly 302 in the form of shelf angles 313, 315. As with angle iron 46, shelf angles 313, 315 run along the wall structure in the horizontal direction and provide a bed upon which the bricks or other masonry of the external facing veneer assembly find support, hence angle irons 313, 315 may be termed a brick support. Each second member 312 may be mounted to first member 310. First member 310 is itself fixedly mounted to the load bearing wall structure 300. The vertical load of the facing, e.g., bricks 302, is carried by the bench or "shelf" of second member 312, and passed into such number of first members 310 as may support second member 312. First member 310 may have a depth (in the y-direction) that may correspond to, or may be greater than, the thickness of insulation panels 308 such as may be mounted to the front (or outside) face of the structural load-bearing wall assembly 300. As shown in FIG. 8*d*, the seat of the first members 310 may be positioned outward of the insulation panels when the first members 310 are secured to the load-bearing wall assembly 300. Inasmuch as each leg 326 may pass through the wall insulation panels 308, each leg may also have an array of apertures such as apertures 124, 138, or 188 that may reduce the section for heat transfer in the y-direction.

As suggested by FIGS. 8*a*-8*d* and 10, it may be that when a first shelf angle is to be located near to the level of the securement to the load-bearing structure and a second shelf angle is to be located at some distance below the level of the securement to load-bearing structure. For instance, as in FIG. 10, a second shelf angle 315, 313, may be provided to support external veneer members above a window 360 or door opening or window or door installation. A structural feature such as a window or door may result in a gap in the external facing veneer members. Thus, the veneer members positioned immediately above the gap (e.g. above the window or door) need to be supported by an additional shelf angle.

Mounting bracket 311 includes first and second seats 317, 318 to support first and second shelf angles 313, 315. As shown in the embodiments of FIGS. 8*a*-8*k*, first seat 317 and second seat 318 are vertically spaced apart so that one is an upper seat and the other is a lower seat. On assembly, a first shelf angle 313 is supported by first seat 317 while a second shelf angle 315 is supported by second seat 318. As shown in FIG. 8*a*, second seat 318 can support second shelf angle 315 at a height proximate to the level of floor slab 303, i.e., within the range of the horizontal projection of the slab, or, e.g., within one seat pitch such as $H_{318}$ or $H_{317}$ therefrom. Second seat 318 may thus support the members of external veneer 302 positioned at, and above, the level of floor slab 303. First seat 317 supports first shelf angle 313 at a level that is vertically displaced below, i.e., to a level lower than, floor slab 303. Thus, first shelf angle 313 is in a position or condition to be able to support members of external veneer 302 positioned between first shelf angle 313 and the level of floor slab 303.

In FIG. 8*c*, the vertical distance between seats 317 and 318 may be substantially greater than the height or pitch of first seat 317, indicated as $H_{317}$, and greater than the height or pitch of second seat 318, indicated as $H_{318}$. As a result, the vertical separation between leg 322 of first shelf angle 313 and leg 322 of second shelf angle 313, indicated as $H_{312o}$, will also be substantially greater than the height of either seat 317, 318. For example, the vertical separation $H_{312o}$ may be at least twice the height of either first or second seat 317, 318, and may be as much as five times the height of either first or second seat 317, 318.

Positioning first seat 317 at a distance spaced vertically lower than floor slab 303 allows mounting bracket 311 to support both the bricks between floor slab 303 and a feature such as a window or door as well as bricks above the level of floor slab 303. This provides a more efficient method of supporting cladding members at the level of floor slab 303 as well as cladding members between a window or door 360 and floor slab 303. In contrast, if brackets such as bracket 52 described above are used to support a shelf angle 315 at the level of floor slab 303 while brackets such as brackets 202 are used to support a shelf angle 313 below the level of floor slab 303, twice the number of brackets are required, requiring substantial increases in the time required to align and mount brackets, as well as increased material costs for the additional brackets.

As shown in FIGS. 8*a*-8*k*, at least one of seats 317, 318 may be substantially similar to, or the same as, seat 94 such as illustrated in FIG. 1*b* or 2*a*. As with leg 84 (or 86) of seat 94, leg 326 of bracket 311 may have a retainer 332, receiving slot 344 and a protruding toe 330 that cooperate to form a seat 317 for shelf angle 313. Accordingly, corresponding shelf angle 313 may be substantially similar to, or the same as, angle iron 46 such as illustrated in FIG. 1*b* or 3*a*. As with angle iron 46, shelf angle 313, 315 both have a first or horizontal leg 322 and a second or vertical leg or back 320. Back 320 of shelf angle 313 also has an accommodation, slot, aperture, socket, or relief, or reliefs 324 spaced upwardly from the junction of members 320 and 322. Accommodations 324 are sized to receive dogs, or toes 330 of seat 94.

In the engagement of toe or dog 330 in relief 324, as may be, the lowermost margin 327 of leg 326 may not extend lower than (i.e., downwardly proud of) the bottom of horizontal leg 322, such that no additional vertical clearance allowance is required for toe 330, meaning that toe 330 is concealed behind external veneer 302 and the bottom edge of the lowest course of bricks may be lower than otherwise. In FIG. 8*a*, the lower received member (i.e., shelf angle 313) is flush with, or extends downwardly proud of, the lowermost portion or extremity of the receiving member (i.e., bracket 311) and, as installed, may tend to conceal the receiving member from view. This arrangement of seat 317 and shelf angle 313 may be helpful when mounting veneer members above a door or window installation. By positioning horizontal leg 322 of lower shelf angle 313 flush with, or downwardly proud of, the lowermost portion of bracket 311, lower shelf angle 313 may be positioned flush with, or immediately above, the upper level of window 360, indicated as $H_{360}$.

In FIGS. 8*a*-8*k*, upper seat 318 for shelf angle 315 may differ from lower seat 317 for lower shelf angle 313. As a first point, the height of the back or web of shelf angle 315 may be different from the height of the back of shelf angle 313, implying a different seat height corresponding to that difference in height. More commonly, however, $H_{317}$ and $H_{318}$ may be the same size. Moreover, while a seat of the form of seat 317 could be formed in the upper portion of bracket 311, and shelf angle 315 could have the pairs or rectangular apertures of accommodations 324, the use of the toe-and-accommodation mounting may be most helpful where the shelf angle is intended to conceal the mounting bracket, as above a door or window. In the upper mounting, seat 318, such a consideration might not be pertinent, given that legs 326 extend downward to lower seat 317 in any event.

As seen, the external facing support assembly has a first portion or section, that of seat 317, and a second portion of portion or section, that of seat 318. The forward facing edge or profile of the leg or web, 326, which is spaced forwardly, or outwardly from the load bearing structure, defines the respective seats, has a first profile portion, or periphery, namely that of seat 317, and a second profile or periphery, that of seat 318. There is a vertical spacing between these two portions or peripheries, where the edge is straight. The intermediate peripheral edge extends between 317 and 318 such that the seats and the front of the profile are continuous and vertically aligned.

Similar to the seat of first member 164, seat 318 may include a vertical load reaction member or reaction interface, such as may be in the nature of a shoulder or side, or face 331, upon which shelf angle 315 rests. A relief or slot, or rebate, or accommodation 345 may extend upwardly therefrom, the slot being bounded by a first wall or vertex, or abutment 347 that defines the first moment couple reaction interface. A retainer 332 cooperates with face 331 and accommodation 345 to provide a seat 318 for shelf angle 315. In the example shown, at the upwardly distant end of accommodation 345 there is an overhanging, downwardly extending retainer or finger 332, the overhang being spaced away forwardly by a gap defining a slot 349 sized to fit the upper margin of the angle iron leg. The inner face or side of finger 332 defines a second moment couple resisting interface. As shelf angle 315 may rest on shoulder 331, back 321 of upper shelf angle 315 may be free from openings in the nature of accommodations 324 in back 320 of lower shelf angle 313. Back 321 may be a substantially continuous or solid web along the horizontal length of shelf angle 313.

In FIGS. 8*a*-8*k*, mounting fitting 336 includes a pair of fittings 337 and 339. First members 310 can secured to load bearing wall assembly 301 by suitable securement means, such as mechanical securements in the nature of threaded fasteners, concrete anchors, concrete anchor fittings, or embedded threaded rods, studs, or bolts. Fittings 337 and 339 may be taken as slots being the same as slot 92 or 129 noted above.

While lower fitting 339 is positioned at a height that corresponds generally to the height of upper seat 318, bracket 311 also extends above upper seat 318, with upper fitting 337 being positioned at a height above, and vertically displaced from, upper seat 318. Lower seat 317 is further vertically displaced from mounting fittings 337, 339, such that the lower load input interface of the bracket and shelf angle assembly is vertically displaced from the load output interface of the vertical load transfer assembly.

As before, the receiving member (e.g., bracket 311) is rigidly secured to the load bearing wall structure, namely wall assembly 300. On installation, the back of bracket 311 lies in facing abutment against the load bearing wall structure in the same manner, or substantially the same manner, as member 50 described above, and where the wall is vertical, bracket 311 is correspondingly vertical. The vertical load transfer assembly shown in the embodiments of FIGS. 8*a*-8*k* has upper and lower output interfaces provided by the connections to the load-bearing wall assembly. The upper and lower load output interfaces of the vertical load transfer assembly, namely the connections to the load bearing wall, are located at a first height, identified as $H_{336l}$ and a second height identified $H_{336u}$. The vertical load transfer assembly shown in the embodiments of FIGS. 8*a*-8*k* also has upper and lower load input interfaces corresponding to the upper and lower shelf angles 313, 315 at which the vertical loads of the external veneer or cladding is received at leg 326. The upper load input interface is identified as a third height, $H_{322u}$ and the lower load input interface is identified as a third height, $H_{322l}$. The third height is slightly below the first and second height, and substantially above the further height. The fourth height is substantially lower than the first and second height. That is, $H_{322l}$ lies at a level that is below the height of the bottom margin of the floor slab 303, and at a height that is more than two brick courses (i.e., more than 6") below $H_{336l}$. Side web or leg 326 of channel or bracket 311 is much deeper in the z-direction (see $H_{311}$) than is the depth of the accommodations for shelf angles 313, 315, identified as $H_{313}$ and $H_{313}$ respectively.

In some embodiments, tying members 314 may be located upwardly of bracket 311. Tying members 314 may have the form of a brick tie assembly such as brick tie assembly 60, noted above. In some embodiments, some tying members 314 may also be located at a height spanned by bracket 311. For example, tying members 314 may be located at a height aligned with the intermediate section of bracket 311, between the lower and upper seats 317 and 318. Such tying members 314 may be offset horizontally from bracket 311, for instance between horizontally adjacent brackets 311.

In each of the embodiments of FIGS. 8*a*-8*k* it may be that the receiving member, such as 310, may be a bracket having a channel-shaped cross-section when viewed from above, that cross section being substantially similar to, or the same as, that of member 50 such as illustrated in FIG. 1*c* or 2*a* or member 220 illustrated in FIG. 7*a*. However, in an alternate embodiment, the receiving member, corresponding to item 310, may have a single web standing outwardly away from the supporting load-bearing wall structure in the manner of an angle iron or T-section. The web may be aligned on the center-line of the fastening mount at item 336.

Considering FIGS. 9*a*-9*d*, support bracket 311 may have the form of a channel 340 (as seen from below, as in FIG. 9*d*) having a first member in the nature of a rear plate or back 328, and a second member in the nature of a web or leg 326. Channel 340 may also have a third member in the nature of a second web or leg 326. In the embodiment shown, legs 326 stand outwardly of back 328. Legs 326 may extend along substantially the entire vertical height $H_{311}$ of bracket 311. An intermediate section 319 may stand outwardly of back 328 for a vertical extent much greater than either of seats 317, 318.

FIGS. 9*e*-9*g* correspond to a double-bracket support assembly 350 in an arrangement that is the same, or substantially the same as that of FIGS. 9*a*-9*d*. It differs insofar as first member 342, which may be a channel section 352 substantially as before, having a back 360 and a pair spaced-apart, opposed side webs, or legs, 362, 364 extending away from back 360, has upper and lower perforation arrays 344, 346 associated with respective upper and lower shelf angle seats 354, 356. It has the same mounting interface 348 in channel back 360 as has channel 340. Protruding toe 358 may be a shorter length toe than toe 330. Protruding toe 358 may also terminate at its distal end in an upturned cusp or catch, or dog, or finger 359, such as may tend to discourage the shelf angle from inadvertently sliding off during installation. There is an intermediate spacing or region 368 between upper and lower seats 354, 356. Intermediate spacing or region 368 may be a continuous web, as shown, or it may include perforations, such as corresponding to the patterns of perforations of upper and lower perforation arrays 344, 346. The perforation arrays, 344, 346 may be formed as indicated above in the context of FIGS. 2*a* and 2*b*, or as in the context of FIGS. 12*a*, 12*b*, 14*a*, 14*b*, and so on herein, or as in U.S. Provisional Application Ser. No. 62/774,535 filed Dec. 3, 2018, the specification and drawings of that US Provisional application being incorporated herein by reference.

FIG. 10 shows an example general arrangement illustration of the position of bracket 311 or 352 in relation to a wall assembly in which a window 370 is to be installed. Upper shelf angle 313 can be positioned at the level of the floor slab, with mounting fittings 336 securing bracket 311 or 352 to the wall assembly at the level of the floor slab. Another first member 312 is also shown positioned at the level of the floor slab of the floor below. As illustrated, bracket 311 or 352 also extends downward from the floor slab so that leg 326 of lower shelf angle 313 can be positioned immediately above the upper level $H_{370}$ of the window frame 370. Leg 326 of the lower shelf angle 313 can support the veneer members located between the upper level $H_{370}$ of window frame 370 and upper shelf angle 315.

By installing bracket 311 to support veneer members at and above the floor slab as well as veneer members or cladding positioned between window 370 and the floor slab, the installation process can be simplified. Instead of alternating between brackets such as bracket 50 to support the veneer members at and above the floor slab and bracket 170 to support the veneer members or cladding positioned between window 370 and the floor slab (and thereby increase the number of brackets used), half the number of brackets can be used. It also establishes a fixed vertical spacing dimension between the respective upper and lower seats, and therefore between the masonry veneer elements mounted on those seats.

FIGS. 11*a* and 11*b* illustrate an alternate support assembly 400 that may be used to support veneer members 402 at different levels of an external veneer. In the alternate embodiment of FIGS. 11*a* and 11*b* there is a first member of a support assembly, identified as bracket 410. Bracket 410 has a back 428, and first and second legs 426, the legs and the back being joined together to for a U-shaped channel as indicated. As with bracket 311, bracket 410 defines a first or lower seat 416 for a first shelf angle 412 and a second or upper seat 418 for a second shelf angle 414. Lower seat 416 and lower shelf angle 412 may be the same as, or similar to, lower seat 317 of bracket 311 and lower shelf angle 313, noted above. Lower seat 416 can include a retainer 432, protruding toe 430 and a slot within which lower shelf angle 412 can be received. Back 420 of shelf angle 412 can include accommodation 424 sized to receive protruding toe 430 of lower seat 416.

In this embodiment, unlike bracket 311, second seat 418 may include a slot 431 and the uppermost end of an upwardly extending retainer or finger 433. In this example, shelf angle 414, which may be the same as, or similar to, shelf angle 162, may seat in an inverted orientation, with back web 421 extending downward into slot 431, and the root of the horizontal flange 422 being supported on the ends of fingers 433. As shown in FIGS. 11*a* and 11*b*, as compared to bracket 311, bracket 410 may omit, partially or completely, intermediate section 319 extending between lower seat 416 and upper seat 418. In other words, lower seat 416 and upper seat 418 may have relatively little vertical separation therebetween. For example, in FIG. 11*a* it can be seen that the separation of the bottom margin of seat 431 (and hence of the inverted vertical leg of shelf angle 414) is less than one seat pitch, be it $H_{416}$ of lower seat 416 or $H_{418}$ of upper seat 418. In this case the compactness of the mounting permits the horizontal flange of shelf angle 414 to be flush with, or shy of, the top of floor slab 403, as where some of that flange may form the sill, or part of the sill, of a doorway or window opening. However, since upper shelf angle 414 is seated in an inverted configuration, flange 422 of lower shelf angle 412 is vertically spaced apart from flange 422 of upper shelf angle 414 by a greater distance (five brick courses in the example shown in FIG. 11*a*). Thus bracket 410 may provide a larger vertical separation between lower shelf angle 412 and upper shelf angle 414, while having a smaller vertical extent itself. That is, the vertical spacing between the upper end of seat 416 and the lower end of seat 418 is smaller than the vertical spacing between the respective horizontal flanges.

The relationship between the vertical load input interface and vertical load output interface is also different in bracket 410 as compared to bracket 311. As shown in the example of FIG. 11*a*, bracket 410 may again have a pair of mounting fittings 436, 437 which can be used to secure bracket 410 to floor slab 303 using securement members or fasteners such as bolts 438. However, in bracket 410 lower mounting fitting 436 is positioned much closer to the lower vertical load input interface located at flange 422 of lower shelf angle 412. Lower mounting fitting 436 is positioned at a height that intersects lower seat 416 on which lower shelf angle 412 is mounted. Upper mounting fitting 437 is positioned at a height that intersects upper seat 418 on which upper shelf angle 414 is mounted. However, as shelf angle 414 is mounted in an inverted configuration upper mounting fitting 414 is positioned below the upper load input interface.

Bracket 410 also allows some external veneer members, such as upper masonry veneer members 405, to be mounted in a horizontally recessed position relative to other veneer members, such as lower masonry veneer members 406, supported by bracket 410. As bracket 410 supports upper shelf angle 414 in an inverted configuration, bracket 410 does not extend above veneer support 422 of upper shelf angle 414. Veneer members 405 may then sit on veneer support 422 of upper shelf angle 414 at an offset dy horizontally inward of veneer members 406 seated on veneer support 422 of upper shelf angle 414, which are prevented from so doing by legs 426 of bracket 410. This may facilitate varied structural and architectural designs for the cladding on the exterior of the building, and may provide a more varied external face 404.

Bracket members 410 have a depth (in the y-direction) that may correspond to, or may be greater than, the thickness of insulation panels (not shown, but which may be the same as or similar to insulation panels 56) such as may be mounted to the front (or outside) face of the structural load-bearing wall assembly 400. There may also be a drainage shield, or flashing, 408 such as may encourage moisture to drain outwardly of and away from structural wall assembly 400. A vapor barrier membrane 409 may be captured behind the insulation panels upwardly or downwardly of the floor slab 403, may traverse insulation at the level of flashing 408, and may lay overtop of flashing 408 with its lowermost margin draining over angle irons 414 or below angle iron 412, such that any moisture draining over vapor barrier 409 is drained away.

When masonry veneer members 402 are mounted on shelf angles 412, 414, a gap 440, 441 may form behind veneer members 402 and between veneer members 402 and wall assembly 401. When veneer members 402 are being mounted on shelf angles 412, 414, the mortar 443 between the brick courses can leak into the gaps 440, 441 and may collect at the base of gaps 440, 441. This may prevent the moisture from exiting gaps 440, 441 and result in a build-up of water in gaps 440, 441. In FIG. 11*a*, a mortar mesh, or mortar netting 442 can be positioned in gaps 440, 441 to collect any mortar 443 that may fall on the inside of the bricks from obstructing the entirety of gaps 440, 441. That is, there is a remaining space 444, 445 behind netting 442, such that water may find a drainage path, or, alternatively, an air space is left such that moisture may tend to have a better opportunity to evaporate. That is, the mesh or netting can prevent the mortar from collecting at the base of gaps 440, 441 so that moisture can drain away endwise off the shelf angle and then via the flashing 408. Mortar netting 442 can also include wicking to allow water to drain down via flashing 408.

In the embodiment of FIGS. 11*c*, 11*d* and 11*e*, there is a double-ended masonry veneer support assembly 370 that has a first member 372, a second member 374, and a third member 376. First member 372 has the form of a channel, or substantially channel-shaped section, indicated as channel member 378. It has a first, or lower, shelf angle seat 380, and a second, or upper, shelf angle seat 382. Second member 374 has the form of a shelf angle that locates in lower seat 380 on installation at the time of assembly. Third member 376 has the form of a shelf angle that seats in upper seat 382 on installation. As with assembly 400, upper seat 382 has the form of a downwardly extending slot 384 formed in side webs 386 that extend away from back 388. To that end, side web has an upper portion 390, a lower portion 392, and an intermediate portion 394. Lower seat 380 has an overhanging retainer or finger 396 in the manner described before, above. Upper seat 382 has the form of a forwardly and upwardly extending retainer or finger 398. As may be noted, intermediate portion 394 has a first depth standing away from back 388, indicated as $L_{394}$. This is the datum depth of the bracket, i.e., of channel member 378. Both of the upper and lower seats extend beyond this datum depth, as indicated by dimensions $L_{396}$ and $L_{398}$ respectively. Slot 384 is located outwardly of $L_{394}$, as is the slot of first seat 380. In each case, the respective seat is located proud of the intermediate, or datum, depth, $L_{394}$. As before, the upper masonry veneer is mounted at a different depth distance from the supporting wall structure than the lower masonry veneer. The reverse could be true, or the respective depths could be the same. The height between the seat pitches is again smaller than the distance between the respective veneer supporting surfaces of the lower shelf angle and the inverted upper shelf angle. As in FIGS. 11*a* and 11*b*, a mortar trapping or capturing net 441, 442 may be installed on the upper surface of the shelf angle. The body of channel member 378 may be perforated in the webs in the space between back 388 and datum depth $L_{394}$, either in the regions of upper and lower seats 382, 380, or throughout its length, including in intermediate portion 394. The vertical length of intermediate portion 394 may vary according to the depth between the shelf angle seats. The upper and lower portions are smoothly radiused into intermediate portion 394, and the margins of the upper and lower fingers 398, 396 extend outwardly on a sloped or tapering diagonal to merge smoothly into outer radii at the outer edge of those fingers. The diagonal has a slope that may be between 30 and 60 degrees. The upper edge of the lower slope provides a stop on which to catch the mortar net.

In FIGS. 11*g* and 11*h* there is a double-ended masonry veneer support assembly 450 that is the reverse of assemblies 350 and 400. As before it has a first member 452 in the form of a channel, or channel member 452, having a flange or back 458 and left and right hand legs or webs 460. It also has a second member 454 in the form of a first, or lower shelf angle, and a third member 456 in the form of a second shelf angle. However, the lower and upper shelf angle seats 464 and 466 are reversed relative to assemblies 350 and 450 such that the upper shelf angle is in the customary upright orientation in which the vertical flange or web 468 extends upwardly of horizontal leg 470; and the lower shelf angle is in the inverted position in which vertical flange or web or leg 472 extends downwardly of horizontal leg 474. In this arrangement, channel member 452 has an intermediate portion 462 between lower seat 464 and upper seat 466. Lower seat 464 has a forwardly extending finger 476 that runs upwardly in front of a slot 478 into which vertical web 472 slides downwardly on installation. Slot 478 lies forwardly of forward margin 480 of intermediate portion 462. The entrance is radiused into slot 478 such that the inside of the radius is substantially flush with the upper surface horizontal leg 474 once installed. The top end of finger 476 is flattened, and is radiused to provide clearance for the inside radius between horizontal leg 474 and vertical web 472. The tip of horizontal leg 474 extends forwardly proud of the tip of horizontal leg 470, such that masonry veneer, such as face brick, mounted on leg 474 may also stand forwardly of masonry veneer installed on leg 470. At the upper end, upper seat 466 may not employ a formed finger, as before, but rather may use a retainer 490. Retainer 490 may be termed a lock, or clip, or catch. It may have, and in the embodiment shown does have, a channel shape having a back 482, a first leg 484 and a second leg 486. First leg 484 and second leg 486 need not be of the same length, although it is convenient that they be. First leg 484 seats in slot 478 formed in each of legs or webs 460. Second leg 486 then reaches over, and extends downwardly in front of, the upper margin of upwardly extending flange, web, or leg 468, trapping upper shelf angle 456 in place. That is, upper shelf angle 456 has apertures as described above that seat on protruding toes 488, those toes being the same as protruding toes 358. Toes 358 receive the vertical shear load. Second leg 486 prevents horizontal forward translation of upper shelf angle 456, and reacts the forward (i.e., clockwise in FIG. 11*g*) moment couple due to the eccentric vertical load of the masonry veneer. Retainer or clip 490 may be slightly spring loaded, such that installation causes it to flex, such that the lower tip of leg 486 is pre-loaded to ride against, or to squeeze, the upper margin of leg 468 against the forward upper edge of bracket 452. This allows upper shelf angle 456 to be installed by translation, without having to be rotated into a slot, as previously. It also allows the vertical extent of the overhanging "finger" to be smaller. That is, the finger has the vertical height of the thickness of the material of retainer 490, as opposed to the bulk of material of finger 398 above the corresponding slot in FIG. 11*e*.

In FIG. 12*a* there is a masonry veneer mounting support assembly 500. It includes a first member 502, which is the mounting bracket; and a second member 504, which is the shelf angle. Also shown are the mounting fastener 506, a locking member, or key, in the form of a rod 508, and a washer or spacer or shim 510. As in other embodiments, first member 502 has the form of a channel member 512 having a flange or back 514 and first and second spaced-apart side webs or legs 516, 518 that extend forwardly from the ide margins of back 514. The forwardmost margin of each of legs 516, 518 has a shelf angle seat 520 defined therein, the shelf angle seat having a lower, vertical margin 522, and an upper, rearwardly relieved margin 524 and an enlarged upper trap 526 between margin 524 and the rearward margin of overhanging finger 528. The enlarged trap 526 may be, or may appear to be somewhat bulbous or rounded, to permit upstanding flange or web or leg 530 of shelf angle 504 to be inserted and then partially rotated to the vertical position in which the front face of the upper margin of leg 530 is retained by the rearward facing margin of finger 528 in the vertical plane, and the lower margin of leg 530 abuts the forward facing margin 522, the combined effect being to provide a moment couple interface restraint to prevent shelf angle 504 from rotating forward. Mounting member 502 also has a forwardly protruding toe 532 having an upper shoulder 534 that defines a vertical shear load input force transfer interface upon which horizontal leg 534 of shelf angle 504 rests. When shelf angle 504 is in place, the locking member is inserted cross-wise in trap 526 behind leg 530. Locking member 508 will tend to want to work its way down the taper of margin 524 against leg 530, wedging itself into place. A wedge shapes member could be provided for this purpose. However, use of round re-bar may tend to be convenient inasmuch as re-bar is ubiquitous and inexpensive.

The fastener shown is for installation in concrete, and includes a mushrooming end that expands at the nut us tightened against washer 525 on the threaded bolt. The shim, or spacer 510 has a footprint that corresponds to the shape of back 514. In the embodiment shown spacer 510 is rectangular, being longer in the vertical direction and shorter in the horizontal direction. It has an open-ended slot 536 that is formed on the diagonal and matches the angled slot 538 formed in back 514. As may be understood, for mounting brackets having fitting adjustment slots of opposite hand, spacer 510 is flipped over to face the other way. At the upper end, slot 536 matches slot 538 in extent. At the bottom end slot 536 exits the side of the vertical edge just above the bottom corner, such that spacer 510 can be inserted over fastener 508. That is, spacer 510 is a U-shaped spacer, with the U being slanted on the diagonal rather than vertical. Spacer 510 may be made of mild steel. Alternatively, it may be made of a lower thermal conductivity material, or mild steel that has been coated in a lower thermal conductivity material or coating, such as to present a thermal resistance to heat flow from the building structure that is greater than mild steel. Spacer 510 may be thin, and may be made of a high density polymer. Alternatively, spacer 510 may be made of steel coated in a polymeric coating, such as the "Aerolon" ™ Acrylic, above.

Looking again at the side webs or legs 516, 518, it is seen that they have an array of perforations 540, the perforations or openings or apertures 542, 544, 546 thereof being bounded by a rectangular frame that includes upper cross-member 552, lower cross-member 554, first vertical upright margin 556 along the forward edge thereof; and second vertical upright 558 that is joined to, and co-operates with back 514 to form an angle section. There are also diagonal strut portions 548, 550 that link upright margins 556, 558 as struts, and that separate apertures 542, 544, 546 from each other. As so formed, each leg 514, 516 has the form of a truss. The reduction in metal section arising from the perforations reduces the cross-section of the section available for conductive heat transfer between margins 556 and 558. Furthermore, bracket 502 generally may have a coating to discourage heat transfer. The coating may be a polymeric coating. The polymeric coating may be an acrylic coating. The coating may have, and in the embodiment illustrated does have, an aerogel filler mixed in the resin of the coating. One such product is supplied by Tnemec Inc., 6800 Corporate Drive, Kansas City, Mo. 64120 USA under the identification "Series 971 Aerolon Acrylic", or simply "Aerolon". The manufacturer suggests the thermal conductivity of the coating may be in the range of 12 mW/m-K. A low thermal conductivity coating may be applied to any of the shelf angle support brackets, or support bracket assemblies shown or described herein.

In the embodiment of FIG. 12*a*, shelf angle 506 is perforated to define accommodations as at 560, 562 to receive protruding toes 532, and shelf angle 506 conceals bracket 504 when installed. In FIG. 12*b*, assembly 570 is substantially the same as assembly 500, except that protruding toe 572 locates underneath the horizontal leg of shelf angle 574, and the vertical leg or flange 576 is accordingly not perforated. In the embodiment of FIG. 12*c*, assembly 580 has an inverted mounting in the form of slot 582 into which the vertical leg 584 of shelf angle 586 seats, in the manner described above in the context of FIGS. 11*f* and 11*g*.

That is, in FIG. 12*a* there is a shelf angle bracket, a shelf angle, a shim, and a locking bar. The shelf angle bracket has channel-shape having a back, a first leg extending away from the back, and a second leg extending away from the back. The first and second legs are mutually opposed. The legs have respective arrays of apertures and diagonal struts. The first and second legs have respective shelf angle seats defined therein. The shelf angle has a horizontal leg extending forwardly of the mounting bracket, upon which to install masonry veneer, and a vertical leg. The vertical leg is located in the respective shelf angle seat or seats. The respective seat or seats of the shelf angle seat include an installation lobe. The locking bar is inserted in the installation lobe. The back is rectangular. The back has an oblique slot formed therein to define a mounting fitting. The shim conforms to the rectangular form of the back. The shim has an oblique slot formed therein. The oblique slot in the shim is open at one end. The shim is made of a thermal insulator, or is coated in a thermally insulating coating.

In some circumstances it may be desired to mount shelf angle support brackets to structural members. The back side of the structural member may not be easily accessible. In the example of FIGS. 13*a*-13*c* there is a masonry veneer support assembly 600 that is to be mounted to a structural member 590. In this instance, structural member 590 is a beam member. It is a beam member having a closed-periphery. In the example, it is a seamless steel tube. The seamless steel tube is square (or rectangular, as may be) and has upper and lower flanges 592, 593 and first and second, or forward and rearward, webs 594, 595 that run between the flanges, the four sides co-operating to form the closed section. The back of forward web 594 is not optimally accessible. Accordingly, forward side web 594 has a keyhole aperture 588 having a large end 596 and a narrower slot 598 extending horizontally away therefrom. On installation, the head of bolt 566 is introduced through large end 596. The bolt is the slid along narrower slot 598, where the underside of the head of bolt 566 bears against the inside of web 594. The external nut 568 on bolt 566 is then tightened. In this example, mounting bracket 578 is intended to be generically representative of any of several of the mounting brackets shown and described herein that mount to a vertical planar face.

FIGS. 13*d*-13*f*, show a structural member 604 and a masonry veneer support assembly 602. Again, the rear face of web 594 is not optimally accessible. In this instance an access port 606 is formed in the second, or rearward, web 595 rather than in the first or forward web 594. Forward web 595 has an accommodation, or hole, 608 formed therein to permit the threaded end and shank of bolt 566 to pass through. Access port 606, which may be a round hole, is a clearance opening to permit introduction of the head of bolt 566 and a socket drive. The threaded end of bolt 566 is then fed through hole 608, and nut 568 is tightened in place, as before. As compared to FIGS. 13*a*-13*c*, the hole 608 in load-bearing web 594 is smaller, and provides contact under the full circumference of the head of bolt 566.

In the example of FIGS. 13*g*-13*i*, it may be that a penetration in the load bearing wall is not desired. To that end, there is a structural load-bearing member 610, which may be a seamless steel tube, as in the examples of members 590 and 604. In this example, a reinforcement, a load spreading plate, or doubler, 612 is mounted to the forward face of forward web 594. Doubler 612 has a though-hole, or bore 614 into which a threaded stud 616 is pre-mounted, the inner end being flush or shy of the end of bore 614. Attachment is by welding, e.g., a plug weld. The doubler is then welded with fillets around its periphery to web 594. Assembly 602 is as before, except that when mounted it stands outwardly of the front face of web 594 by the additional distance of the thickness of plate or doubler 612.

In FIGS. 13*a*-13*i* there are three versions, in which there is a structural beam with a first vertical web, a shelf-angle support bracket for co-operation therewith, and one of (a) the first vertical web has a relief defined therein, the relief has a wide portion and a narrow portion adjoining the wide portion; the shelf angle support bracket has a mounting fitting and mounting hardware; the mounting hardware has a head, the wide portion of the relief admitting entry of the head, and the narrow portion preventing passage of the head; (b) a second vertical web spaced apart therefrom; the first vertical web has a first opening defined therein; the second vertical web has a second opening defined therein, the second opening is aligned with the first opening and is larger than the first opening; the shelf angle support bracket mounts to the first vertical web and the shelf angle support bracket has a mounting fitting co-operable with the opening in the first vertical web; there is a mechanical fastener has a shaft and a nut or head; the first opening admits the shaft and obstructs the nut or head; the second opening admits the shaft and the nut or head; and (c) a load spreader is mounted to the first vertical web; a mounting fitting is secured to the load spreader; and the shelf angle support bracket is mounted to the mounting fitting of the load spreader.

The example of FIGS. 14*a*-14*c* address the circumstance of mounting a masonry veneer support assembly 630 to a concrete structural support as represented by concrete member 620. Concrete member 620 may be a floor slab, a pre-cast beam, a wall, or other concrete member. It has reinforcement bars 619 and a poured concrete matrix 618. It may not be desired to mount an anchor fitting in the forward face 617 of concrete member 620. Accordingly, mounting assembly 630 (which is otherwise similar to, or the same as mounting assembly 500 of FIG. 12*a*, 570 of FIG. 12*b* or 580 of FIG. 12*c*) has a rearwardly extending member, or arm, or strap, or tab 622 that is formed of a bent extension of back 624. It has an aperture 626 for a mounting fitting, such as expanding concrete anchor fitting 628, which may be the same as shown and described above in the various horizontal installations. In the example of FIGS. 14*a*-14*c*, the vertical centerline of aperture 626 is offset from the plane of back 624 by a distance $L_{626}$. As may be noted, $L_{626}$ is equal to, or greater than $L_{522}$ measured between the rearward face of back 624 and the forwardly facing lower abutment surface defined by vertical margin 522 of shelf angle seat 628. This distance represents the shelf angle offset distance from the supporting structural wall, i.e., the insulation and air gap distance. The air gap distance may, of course, be augmented by the distance that the rear face of the masonry veneer lies forward of the vertical plane of margin 522. It may also be noted that distance $L_{626}$ is greater than the side inset distance of the nearest re-bar 618 from the forward face of concrete member 620 against which back 624 seats in planar engagement. As before, assembly 630, or first member or mounting bracket 632 thereof individually, may have a thermal conduction resistant coating. Location of the concrete anchor fitting inboard or the first re-bar may tend to lessen the tendency of the concrete member to split inconveniently.

The example of FIGS. 14*d*-14*f* shows a masonry veneer support assembly 640 that is similar to, or substantially the same as, assembly 630, except that, in this case, it is a long-legged version in which the vertical shear load transfer interface of toe 642, and, in this example, all of seat 634, hangs down below the bottom edge or face or surface, of the supporting concrete member 620. As noted, the side legs or webs 636 of bracket 638 may have the aperture arrangement as in FIGS. 12*a*, 12*b* and 12*c*, whether only of partial height adjacent to seat 634, or over more of the height up to the top of the legs, as may be.

The example of FIGS. 15*a*-15*c* addresses the issue of mounting a masonry veneer support assembly or support member 650 to a fabricated beam, such as a formed wide flange or I-beam 648. It may be noted that the mounting shown would also apply to a closed-section, or box-section, beam or truss. In this example, first member, i.e., mounting bracket 652, is a long-legged bracket having a vertical extent to have a moment couple reaction defined by the lower margin of back 654 against a lower portion of beam 648, in this case the lateral edge of bottom flange 646. Side webs 656 may have the same arrangement of shelf angle seat 658 and perforation arrays 644 as previously described. Mounting bracket 652 differs from those previously described in having a rearwardly extending formed arm or tab 664 that has an attachment fitting 666 to permit mechanical fastening to the upper flange of the beam. In the example illustrated, tab 664 has been made by bending an extension of back 654 rearward and downward on a radiused curve, and then bending the end of the tab in the other direction, i.e., upward at a point of reverse inflection, to lie flat. The eccentric rotating moment couple is counter-acted by the abutment of the lower margin of back 654 against the outward, laterally facing edge of lower flange 646. The mechanical fastener prevents that relationship from being altered. The upper ends of side webs 656 have rearwardly extending ears, or horns, or abutments 668 that engage the top of the upper flange 660 of the beam, but do not require penetrations in the flange. That is, whereas the mechanical fastener penetration is well inset from the lateral edge of the flange, the twin abutments of ears 668 transfer vertical shear load into the flange along their abutting surface even to the edge of the upper flange 660 of beam 648. Abutments 668 extend rearwardly proud of back 654. Abutments 668 also extend vertical proud of tab 664, having a greater depth of section to form a short aspect ratio beam having a depth of section greater than the through-thickness of tab 664. Abutments 668 may be flush with the flat foot of tab 664, or alternatively, abutments may extend slightly downwardly proud of the flat foot, such that when the mechanical fastener is tightened, tab 664 is slightly pre-loaded in bending, and the abutment surfaces of abutments 668 are correspondingly slightly pre-loaded in compression. Thus the total depth of section in shear is the sum of abutments 668 and tab 664.

That is, in FIGS. 14*a*-14*f* and 15*a*-15*c*, a shelf angle support bracket has a channel-shaped structural member that has a back, a first leg and a second leg. The first leg and the second leg extend forwardly away from the back and are mutually opposed. The first and second legs have respective shelf angle seats defined therein. The shelf angle seat is distant from the back. The back has an extending member. The extending member of the back is bent rearwardly away from the rest of the back. The rearwardly extending member has an attachment fitting. At least the first leg has a first rearwardly extending abutment that stands rearwardly proud of the back, and that defines a vertical shear load transfer interface.

The rearwardly extending attachment fitting defines a moment couple reaction interface. The second leg has a second the rearwardly extending abutment. The first and second rearwardly extending abutments are located in respective regions of the first and second legs that are upwardly of the respective shelf angle seats. The abutments stand upwardly proud of the rearwardly extending member of the back. The beam has an upwardly facing surface. The first abutment transfers shear into that upwardly facing surface. The attachment fitting of the rearwardly extending member of the back defines a retainer attached to the upwardly facing surface of the beam. The retainer is operable to prevent the first abutment from disengaging from the upwardly facing surface. The beam has a web and a flange. The flange defines the upwardly facing surface. The second leg has a second abutment space apart from the first abutment. The first and second abutments transfer shear load into the flange at a margin of the flange. The attachment fitting of the extension of the back of the channel-shaped section is attached to the flange. The extension of the back overreaches the flange more distantly from the back of the channel-shaped section than do the first and second abutments. The beam has an upper flange and a lower flange. The abutments seat upon the upper flange. The mounting bracket has at least one abutment that reacts against the lower flange of the beam.

In the example of FIGS. 16*a*-16*c* there is a masonry veneer support mounting assembly 670 that mounts to an overhanging, or cantilevered structural member or structural assembly 680. In the embodiment illustrated, the overhanging structure is a concrete floor slab 682 that extends outwardly from a supporting wall 684. In this instance, mounting bracket 672 has the form of a long-legged channel, such as previously described in many alternatives. Although only a single-ended, depending shelf-angle seat 674 is shown, bracket 672 could be, or could have, a double-ended arrangement, also as described in several alternatives herein. There is a shelf angle 676, again such as described in many alternatives, and masonry veneer 678, also as previously described. Assembly 670 differs from the previous examples in having not only a first structural anchor, or vertical shear load transfer interface, as at anchor 686, but also a second anchor, as at load transfer interface 688. That is, there is a reinforcement, or brace, or gusset or auxiliary bracket, or secondary bracket, or member 690, however it may be called, that has a body 692 with a first mating fitting 694 that mates to a region of back 696 of bracket 672 that is distant from anchor 686. In the example illustrated, it is downwardly distant therefrom, being located in a lower region or portion of back 696, while anchor 686 is located near the upper margin of back 696. Body 692 has a second mating fitting 695 that is the second anchor to structural assembly 680. In this case, body 692 functions as a diagonal strut to provide a counter-acting clockwise (as seen in the point of view of FIG. 16*a*) rotational moment couple reaction to the counter-clockwise moment of the eccentrically applied vertical load of masonry veneer and shelf angle. The first end of body 692 has a first flange 698 that mates with back 696, and second flange 699 that mates with the underside of the concrete slab, the flanges having the respective mounting fittings 694 and 695 that receive fasteners engaged with assembly 680, in this case embedded concrete anchors. The offset of the two mounting points creates a moment arm, and the reaction acting one that arm counter-acts the overturning eccentric moment on the shelf angle. The mounting assembly is a long-legged assembly that hangs downwardly so that shelf angle seat 674 is located below not only the floor slab, but also below mating fitting 694 (and therefore also fitting 695).

That is, in FIGS. 16*a*-16*c*, there is a structural support assembly upon which to mount masonry veneer. The structural support assembly includes a shelf angle; a shelf angle mounting bracket; and a brace. The shelf angle mounting bracket has a back and a leg extending forwardly away from the back. The leg has a shelf angle seat defined therein, the shelf angle locating in the shelf angle seat on installation. The back has a rearwardly facing surface has a first mounting fitting by which to secure the shelf angle support bracket to supporting structure. The back has a second mounting fitting by which the brace is secured to the shelf angle support bracket. The second mounting fitting is separated from the first mounting fitting be a moment arm distance. The brace has a footing by which the brace is secured to the supporting structure distantly from the first fitting. The brace defines a diagonal strut. The supporting structure defines an overhang; the first fitting secures to an end of the overhang; and the first footing of the brace secures under the overhang.

The shelf angle support bracket extends downwardly proud of the overhang, and the shelf angle seat depends from the overhang.

The example of FIGS. 17*a*-17*c* addresses the issue of mounting a masonry veneer support mounting assembly to an adjacent structural supporting member where it is desired not to penetrate the support member (and thereby cause a stress concentration therein) or where it is desired to spread the input load into the structural member over a larger area, or both. To that end, masonry veneer support assembly 700 is mounted to structural member 710. Structural member 710 has first and second mounting engagement surfaces or interfaces, those being a first face, or horizontal face, 712 and a second face, or vertical face, 714. In the embodiment illustrated, structural member 710 is shown as being a seamless steel tube; the horizontal face is the top flange of the tube, and the vertical face is the forwardly facing vertical web of the tube. In this instance, support assembly 700 includes a first member 702, being the mounting bracket; a second member 704, being the shelf angle; and a third member 706, being an intermediate member, or intermediate fitting, or mediating fitting 708, which, in this example is an angle iron. First member 702 may be one of the mounting brackets shown or described above. In the illustration provided it is a depending mounting bracket with a shelf angle seat downwardly offset from its adjustable mounting fitting, and partial length truss apertures. In this instance, mediating fitting 708 is an angle iron 720 having a horizontal leg 716 that seats on, and distributes load into, horizontal face 712 of structural member 710; and a vertical leg 718 standing upwardly therefrom. Leg 716 may be, and as shown is, longer in the running direction than bracket 702 is wide, such that the load on bracket 702 is distributed into more of structural member 710 than defined by the width of spacing of the legs of the channel section of racket 702. Leg 716 may have a length transverse to structural member 710 that is as great as the cross-sectional width of structural member 710, or, as shown, that leg length may be less than the width of structural member 710, while still spreading the input load. In the example, leg 716 may be fillet welded to horizontal face 710 of structural member 710. First member 702 is secured to angle iron 720 by a mechanical fastener, which may be a threaded fastener as described above. Vertical leg 718 effectively raises the shear load transfer interface above the upper face of structural member 710, and provides the upper moment couple reaction interface. The lower portion of first member 702 backs on vertical face 714 of structural member 710, thus providing the second moment couple reaction interface. The fabrication of angle iron 720 carries or provides the moment couple from leg 718 to leg 716, and thence into structural member 710. In FIG. 17*d*, first member 722 is the same as first member 702, except insofar as having a raised protruding toe 724 as described above, for cooperation with a shelf angle 726 having apertures in the vertical leg, also as previously described above in several embodiments.

Expressed differently, FIGS. 17*a*-17*c* show a shelf angle support bracket assembly for supporting masonry veneer. The shelf angle support bracket assembly includes a channel-shaped member that has a back and first and second legs extending forwardly from the back in mutual opposition. The first and second legs have a shelf angle seat defined therein distant from the back. A load spreader has a first member and a second member. The first member defining a transversely extending vertical load output interface. The second member defining an upwardly extending vertical load input interface. The channel-shaped member has an output fitting co-operably engaged to the vertical load input interface of the load spreader. The channel-shaped member has a width measured across the legs, and the load spreader has a length transverse to the channel-shaped member that is greater than that width. The load spreader is an angle iron has an upright leg and a horizontal leg, the horizontal leg is welded to a supporting beam, and the back of the channel-shaped member is releasably attached to the upright leg.

FIGS. 18*a*-18*c* address the circumstance of having a load supporting structural member that has a support interface at a suitable height for carrying the shelf angle itself, directly for the transfer of vertical shear load, or where the lateral distance between the supporting structural member and the masonry veneer may be limited, or, as in the example illustrated, both. To that end there is a masonry veneer support assembly 730 and a structural support member 740. In the example illustrated, support assembly 730 includes a first member 732 and a second member 734. The first member is the mounting bracket. The second member is the shelf angle. In this instance first member 732 has a truncated shelf angle seat 736, inasmuch as it does not have a protruding toe or toes, but rather relies in support member 740 to provide the protruding toe or shear load input interface. In the example illustrated, structural support member 740 is a beam having an upper face, or flange 742. In the particular example, support member 740 is an I-Beam, or wide flanged beam having an upper flange 742, a lower flange 744 and an intermediate web 746 extending between the upper and lower flanges. First member 732 has the general form of a formed channel section that has a truncated back 738, and lower extensions of side webs 748 that extend downwardly below the truncation of back 738 are splayed or bent outwardly sideways to form wings, or flanges, or tabs, or feet, 750 that seat upon upper flange 742 of support member 740. Feet 750 include respective mounting fittings 752 by which to secure first member 732 to flange 742. In the example, mounting fittings 752 align with penetrations, i.e., bores or mounting holes through flange 742 those penetrations are more than half the width of support member 740 away from its forward edge. That is, as in the example illustrated, fitting 752 locate in flange 742 on the far, or rearward, side of web 748. In this instance, the separation of fitting 752 from the forward edge of seat 736 provided the moment couple reaction arm, and the vertical shear load is carried directly into flange 742 from shelf angle 734. This provides a compact installation.

Thus, in FIGS. 18*a*-18*c*, the shelf angle mounting bracket has a channel-shaped section that has a back, a first leg extending away from the back, and a second leg extending away from the back. The first and second legs are mutually opposed and have respective feet bent to form respective first and second tabs by which to secure to supporting structure. The channel-shaped section has at least a first portion of a first shelf angle mounting seat formed in at least the first leg distant from the back. The respective first sand second tabs are bent to be co-planar. The tabs have mounting fittings defined therein. The back is truncated shy of the tabs. The shelf angle mounting bracket includes only one of (a) a vertical load receiving interface; and (b) a moment couple resisting interface. The first leg and the second leg stand in opposed vertical planes. The first leg has a profile formed therein to define an upwardly extending slot in which to receive an end of an upright leg of the shelf angle. The second leg has a profile formed therein to define an upwardly extending slot in which to receive an end of an upright leg of the shelf angle. The tabs of the first and second legs are coplanar and have respective mounting fittings. The back is truncated shy of the tabs. When seated on a flat surface, part of the shelf angle locates within the portion of the shelf angle mounting seat, and another part of the shelf angle engages the flat surface. When mounted in in combination with a shelf angle and a beam, the mounting bracket forms the first portion of the shelf angle seat, and the beam forms a second portion of the shelf angle seat.

The example of FIGS. 19*a*-19*d* addresses the circumstance in which it is desired for the mortar netting or mortar catching element to be able to be installed to overlap, to sit rearwardly flush with, or to extend rearwardly beyond, the vertical leg of the shelf angle. This may occur where a more compact installation is desired between the insulation and the masonry veneer, or, contrarily, where the shelf angle is presented more distantly from the supporting structure. In this example, the main, or upper, datum portion of the legs or webs of the mounting bracket is a first distance, and, as installed, the vertical lag of the shelf angle lies forwardly of that distance, or, expressed differently, the overhanging retainer, or finger, and the protruding toe, both extend forwardly proud of the general or datum dimension of leg size. In that circumstance, extending the webs of the channel section to the full extent of the finger (or of the toe) would be an unnecessary waste of material, or an obstruction to installation of the mortar netting, or both. So, in FIGS. 19*a*-19*c* there is a masonry veneer support assembly 760 that is mounted to supporting structure, indicated generally as 770. Masonry support assembly 760 may include a first member 762, being the mounting bracket, and a second member 764, being the shelf angle, as before. Supporting structure 770 may be any kind of suitable framing of structure. It could be steel beams and girders. In the example shown it is a concrete floor slab. Similarly, first member 762 could be single-ended or double-ended. As illustrated, it is a long-legged single-ended mounting bracket, of the general channel-shaped arrangement of a back 766 and a pair of legs 768. There is a shelf angle seat 772 that has a lower portion 774 that extends in a vertical plane, and an upper portion 776 that forms the bulbous upper portion discussed in the context of FIG. 12*a*. The major portion of legs 768 terminates forwardly at a margin 776. Margin 776 lies in a vertical plane. The retainer, identified as finger 780, protrudes or extends forwardly of margin 776 to over-reach the front face of vertical leg 778 of second member 764. As installed, the rearward margin of finger 780 contacts, and engages, the forward face of the upper margin of vertical leg 778, preventing it from rotating counter-clockwise. The outer margin of finger 780 is identified as 782. In this instance, shelf angle 764 has apertures in vertical leg 778, and first member 762 has respective protruding toes 784 that extend through those apertures and receive the vertical shear load of the masonry veneer, as previously described. In this example, the margin defined by portion 774 lies flush with, or, as illustrated, forwardly of, the dominant, or thinner, margin of legs 778, namely margin 776. Further, the distance between margin 776 and margin 782 corresponds to the thickness of mortar net 784, which installs against, and is trapped above, fingers 780, i.e., between margin 776 and the rearward face of the masonry veneer. In FIG. 20*a*, mounting bracket 762 has mitered upper edges, suitable for installation of a flashing, shown in phantom as 786, indicating that shelf angle 764 is carrying the lowest courses of bricks. In FIG. 19*b*, shelf angle 762 has a squared top, and is not carrying a flashing. First member 762 can have solid continuous side webs as in FIGS. 19*a* and 19*b*, or may have an array of apertures as in FIGS. 19*c* and 19*d*, over part or all of the height of side webs 768, and with a short protruding toe as in FIG. 19*a* or a long protruding toe as in FIGS. 19*b*, 19*c*, and 19*d*.

That is, in FIGS. 19*a*-19*d*, the shelf angle mounting bracket has a structural section has a back and a web. The back has a rearwardly facing surface. The leg stands forwardly away from the back. The back has a mounting fitting by which to secure the mounting bracket to supporting structure. The web has a forward margin distant from the back. The forward margin has a first portion located a datum distance away from the back. The forward margin includes a second portion defining a shelf angle seat. The shelf angle seat is located forwardly more distant from the back than the datum distance. The mounting bracket has a mortar net seat forwardly of the first portion. The shelf angle seat has a portion lying in a vertical plane, against which a rearwardly-facing surface of an upright leg of a shelf angle abuts in use. That portion of the shelf angle seat lies in a vertical plane that is forward of the first portion of the forward margin of the leg of the mounting bracket. The shelf angle seat has a vertically extending slot located forwardly of the first portion of the forward margin of the leg. The leg has a finger that extends forward of the first portion of the margin. The finger defines a retainer that, in use, locates forwardly of an upright leg of the shelf angle. The finger has a forward margin most distant from the back, and the mounting bracket defines a mortar net seat in a space forwardly of the first portion of the forward margin, between the first portion of the first margin and the forward margin of the finger. The leg of the mounting bracket includes a retainer that extends forwardly of the first portion of the forward margin. The forward margin has a second portion that is tapered from the first portion to the retainer. The mounting bracket is more than twice as tall as the shelf angle seat. The first portion of the forward margin of the leg has a greater vertical extent than does the shelf angle seat. The support structure is a floor slab, the mounting bracket extends at least one of (a) upwardly proud of the floor slab; and (b) downwardly proud of the floor slab. The shelf angle seat is located one of (a) upwardly of the floor slab; and (b) downwardly of the floor slab. The shelf angle is mounted to the bracket and has masonry veneer installed on the shelf angle. A mortar net is trapped between the masonry veneer and the first portion of the forward margin of the leg. The mounting bracket has the form of a channel section in has two the legs extending away from the back in mutual opposition. The mounting bracket both upper and lower shelf angle mounting seats. Both the upper and lower shelf angle seats are located forwardly of the first portion of the margin of the first leg.

The example of FIGS. 20*a* and 20*b* provides another form of double-ended, or double-seated, masonry veneer support assembly 800 such as may address the circumstance where the shelf angle support assembly is to be within the masonry veneer, such that the support assembly is not seen from beneath. It may be, for example that, as illustrated in FIG. 20*a* a row of bricks is to be located standing on end underneath the shelf angle. Accordingly, support assembly 800 includes a first member 802, the mounting bracket, and a second member 804, the shelf angle. The upper regions of first member 802 may be as previously described. In some instances, first member 802 may also include an upper end fitting as in the double-ended mounting bracket examples noted above. First member 802 has the generally channel shaped configuration with a back 806, and first and second, or right-hand and left-hand forwardly extending webs 808, 810. First member 802 differs from the previously described examples in that at least one of webs 808, 810 has an enlarged depending end indicated generally as 812 located below forwardly protruding toe 814 (in this example, shelf angle 804 has penetrations in the vertical leg defining accommodation for toes 814. In this case, the left and right-hand webs are asymmetric, the left had one being larger than the right hand one. Although a left-handed item is shown, the same description would apply to the other handed item, allowing for opposite handedness. Enlarged depending end 812 may have the form of a plate forming a downward extension of web 808 generally. That plate may extend forwardly of the tip of protruding toe 814, and in some instances may extend forwardly proud of the tip of the horizontal leg of shelf angle 804. Depending end 812 may have bores 816, 818. Bores 816, 818 admit the introduction and passage therethough of steel reinforcement members, e.g., re-bar 790, that also passes through the mortar holes of the bricks of the array of bricks to be mounted between bracket 802 and its opposite handed mate (or mates).

On installation, a hoarding, or support, or false-work, may be constructed in a position to support a sting of bricks, set on end, between bracket 802 and its mates, however many there may be. As the bricks are put in place, their internal openings are filled with mortar. The reinforcement rod is then threaded through the aligned holes. When the mortar has set, the bricks will be held in fixed position on the re-bar, and shelf angle 804 will be above the lowermost course of bricks. The use of two (or more) re-bars 790 of course presents a spaced-apart moment arm, thus discouraging the bricks from rotating in the vertical plane. Once set, the false-work is removed.

In the example of FIG. 20*c*, it may be that it is desired for the under-hung row of bricks to lie flat, rather than on end. Accordingly, assembly 820 includes a first member 822, i.e., the mounting bracket, that has a downwardly extending tab or plate, or extension 824 that is shallower vertically than it is wide in the through-thickness direction of the wall assembly more generally. Extension 824 has a profile seen in side view that is smaller than a brick, such that when the bricks have been installed as in FIG. 20*f*, extension 824 may tend not to be visible. Extension 824 has an array of apertures 826 in which the apertures are spaced horizontally, rather than vertically as in FIG. 20*b*. It follows that the shelf angle will also then not be visible. In this example, the upper margin of the extension also defines the bottom margin of the shelf angle seat, upon which the shelf angle sits, and into which the shelf angle passes vertical shear loads.

First member 822 may be made by laying out the developed profile of member 822 on a flat plate; cutting the plate to that profile, and then forming the channel shape in a press or brake. Depending on the size of extension 824, and the ability to nest parts in the plate from which the parts are to be made, that process may result in undesirable wastage or scrap.

Accordingly, in the examples of FIGS. 20*d* and 20*e*, there is an assembly 830, in which there is a first member 832, being such of the various examples of mounting bracket fittings as described above as may be, and there is a second member, 834, being the shelf angle. In addition, there is a third member 836, which may be either left-handed or right-handed. Third member 836 is a depending masonry veneer mounting fitting. It has a predominant flat plate portion 838 with apertures 840, forming the brick veneer interface plate as before, and permitting the installation of re-bar as before. In this case, there is an upstanding tab 842 in the plane of plate portion 838. Tab 842 has a leg 844 that has been bent out-of-plane. Leg 844 may be square to flat plate portions 838. Leg 844 includes a mounting fitting 846 in the nature of a slot. The slot extends transversely, i.e., horizontally, and has a length that is greater than one half of a brick pitch. As such, however the bricks may align, third member 836 will always be within one half brick pitch of any alignment aperture. Leg 844 can mount against, and be fastened to, the vertical leg of the shelf angle. Alternatively, in a long-legged arrangement of mounting bracket 832, leg 844 can mount within the channel section of bracket 832, and be attached to the back thereof. To that end, the width of tab 842 in the through-thickness direction is less than or equal to the spacing between the inside face of the back the channel and the rear face of the shelf angle. In the embodiment shown, tab 842 is centered such that whether leg 844 is mounted to the back of the shelf angle or mounted to the back of the channel, the bores for the re-bar will line up in the same place even if flat plat portion 838 is flipped end-for-end, i.e., reversed. Alternatively, the mounting fitting in the shelf angle can be offset from the mounting bracket and the upper portion of tab 842 can be mounted snug against the inside or outside of either of legs 846 of the channel section or mounting bracket 832 (or, snug against a shim lying thereagainst), and tightened in position. When installed as in FIG. 20*g*, leg 844 reaches over the respective protruding toe, such that the vertical shear load of the under-hung course of bricks is carried into the web of the mounting bracket, whichever version it may be.

In the example of FIG. 20*e*, there is an assembly 850 in which there is a first member, 852, being the mounting bracket; a second member 854, being the shelf angle, and a third member 856 being the hanger for the underhung brick. In this case, plate 858 differs from extension in having an array of four (or more) apertures 860, spaced to permit first and second courses of underhung brick to be installed as in FIG. 20*h*. It also differs in having a longer upstanding tab 862, such as may reach over an overhanging finger of the mounting bracket, and then having a depending leg 864. The adjustable attachment slot 866 in depending leg 864 is as before in slot 846.

Accordingly, in FIGS. 20*a*-20*h*, there are support brackets for use in the mounting of masonry veneer. They have a structural member that has a back and a first leg extending forwardly from the back. The back has a fitting by which to secure the back to supporting structure located rearwardly thereof. The leg has a shelf angle seat defined therein distant from the back. The leg has a portion thereof has at least two apertures formed therethrough. In use, the apertures accommodate rods that pass through an array of bricks. In one type, the apertures are spaced in a horizontal array. In another, the apertures are spaced in a vertical array. In one type, the apertures are located upwardly of the shelf angle seat. In another, the apertures are located downwardly of the shelf angle seat. They can be both above and below. The structural member includes a second leg extending forwardly of the back. The first and second legs are mutually opposed. The first and second legs are asymmetric. The first leg includes an extension has the array of apertures formed therein. The extension has a profile that is smaller than three sides of a brick mounted thereto, whereby bricks mounted to the extension hide the extension. Where another support bracket of opposite hand is also used, spaced apart sideways, a shelf angle is mounted to span the respective shelf angle seats of the support brackets. A set of rods extends between, and through, the respective apertures of the support brackets. Brickwork is mounted to the shelf angle, and brickwork is mounted to the rods. The brickwork mounted to the shelf angle has a different orientation from brickwork mounted to the rods. The brickwork mounted to the shelf angle and the brickwork mounted to the rods is positioned at least partially to conceal the support brackets from at least one of (a) above; and (b) below. In a further feature, the extension is a separate part from the structural member, and is mechanically mounted to the structural member.

The present description provides examples and explanations that address a number of installation challenges that may present themselves during the installation of masonry veneer, particularly in circumstances where the installation diverges from installation in a large plat plane. The various features can be mixed-and-matched, as may be appropriate.

In each case the general description of installation and use is substantially the same. That is, a masonry veneer support, such as a brick support, in the form of a shelf angle is mounted across the wall on the anchoring brackets. The anchoring brackets are first bolted to the wall by securing the bolts. The brick support is mounted on the anchoring brackets by inserting an edge portion of mounting flange 118 upward into receiving slot 92 of each anchoring bracket 52 (or as may be) at an incline and then by pivoting the supporting flange inward until the mounting flange engages the rearward edge of seat 94. The rearward edge at 102 prevents the brick support from being further pivoted within the recessed channel under the increasing moment couple as the weight of the bricks is applied to the brick support. The bolts are then tightened snugly and the wedge-shaped shims may be inserted to suit.

Until the nuts on the respective bolts are fully tightened, the relative height of each anchoring bracket is adjustable by sliding the anchoring bracket laterally along the brick support as the anchoring bracket is moved upward or downward relative to the bolt extending from the wall. This permits adjustment with a spirit level to make the shelf angle level. This lateral movement of the anchoring bracket relative to the brick support with the adjustment in height is due to the inclination of the fastener slot from the vertical.

Once the nuts are tightened on the bolts the brick support is secured to the load-bearing wall structure, and bricks may be supported thereon. The inclination of the fastener slot from the vertical acts to inhibit vertical displacement of the anchoring bracket along the mounting bolt through the resistance of the lateral movement of the anchoring bracket along the brick support. Having anchoring brackets of opposing orientation mounted adjacent to each other further restricts the entire brick anchor system from shifting positions relative to the wall once the bolts are tightened.

The relative location of the anchoring brackets remains adjustable as the brick support is mounted thereon for accommodating irregularities in the wall or misalignment between adjacent anchoring brackets. Once the brick support is securely fastened to the wall further vertical displacement of the anchoring brackets is inhibited by the resistance of lateral movement of the anchoring brackets relative to the brick support due to the arrangement of the fastener slot. A shim plate which is substantially similar in size to the anchoring bracket, mounts between each anchoring bracket and the outer face of the wall for evenly engaging the concrete surface and for spacing each anchoring bracket from the wall as desired to accommodate for irregularities in the outer face of the wall.

Various embodiments of the invention have been described in detail. Since changes in and or additions to the above-described best mode may be made without departing from the nature, spirit or scope of the invention, the invention is not to be limited to those details but only by the appended claims.

I claim:

1. A masonry veneer support assembly for mounting masonry veneer to supporting wall structure that includes a floor slab, said support assembly comprising:

a first shelf angle, a second shelf angle, a first shelf angle mounting bracket, and a second shelf angle mounting bracket;

each of said first and second shelf angles having a first leg and a second leg that meet at a square corner, said first leg being a vertical leg, said second leg being a horizontal leg, said vertical leg defining a rearwardmost portion of said respective shelf angle and said horizontal leg defining a forwardmost portion of said respective shelf angle;

said first and second shelf angle mounting brackets being spaced apart horizontally;

said first and second shelf angle mounting brackets each having an upwardly extending back that has a mounting fitting that is secured to the floor slab of the supporting wall structure, and a web extending forwardly away from the wall structure;

said first and second shelf angle mounting brackets each having a vertical length extending between a first end and a second end, said vertical length of said respective shelf angle mounting brackets being greater than the floor slab is thick;

said web having first and second shelf angle mounting seats formed therein, said first shelf angle mounting seat being located at said first end of said respective shelf angle mounting bracket and said second shelf angle mounting seat being mounted at said second end of said respective shelf angle mounting bracket;

said first shelf angle mounting seat being vertically spaced from said second shelf angle mounting seat;

said first shelf angle mounting seat being at a first height;

said second shelf angle mounting seat being at a second height; and said height of said second shelf angle mounting seat being more distant from the floor slab than is said first shelf angle mounting seat.

2. The masonry veneer support assembly of claim 1 wherein said first shelf angle mounting seat is rearwardly recessed relative to said second shelf angle mounting seat.

3. The masonry veneer support assembly of claim 1 wherein said first shelf angle mounting seat is vertically inverted relative to said second shelf angle mounting seat.

4. The masonry veneer support assembly of claim 1 wherein said assembly includes mortar netting mounted to at least one of said first and second shelf angles.

5. The masonry veneer support assembly of claim 1 wherein said second shelf angle seat includes a protruding toe, and said second shelf angle has a back having an aperture formed therein, said toe seating in said aperture when said second shelf angle is mounted to said second shelf angle seat.

6. An external facing support assembly for supporting masonry veneer, and that mounts to a supporting load-bearing wall structure that includes a floor slab, said assembly comprising:

at least a mounting bracket, a first shelf angle and a second shelf angle;

each said shelf-angle having a first leg and a second leg that meet at a square corner, said first leg extending vertically and said second leg extending horizontally;

each said shelf angle being engageable with said mounting bracket for support thereby;

said mounting bracket having a first portion with a mounting fitting by which said assembly is secured to the floor slab of the load-bearing wall structure;

said mounting bracket having a second portion defining a leg standing outwardly from said first portion, said leg including a first seat and a second seat, each said seat being located horizontally distant from said mounting fitting, whereby, as installed, each said seat being spaced horizontally away from the load-bearing wall structure;

said first seat being vertically spaced apart from said second seat;

each said seat including a vertical reaction interface, and a moment restraint;

said moment restraint including a vertically extending slot;

each said horizontal leg of said shelf angle defining an external facing carrier and each said vertical leg of said shelf angle defining a seat engagement, said carrier being connected to said seat engagement;

said external facing carrier including a horizontally extending foot upon which to mount at least one masonry veneer member forwardly of said mounting bracket;

said seat engagement including a vertically extending web to which said foot is joined; and as installed, said seat engagement of said first shelf angle engaging said first seat with said web of said first shelf angle seated in said slot of said first seat and said seat engagement of said second shelf angle engaging said second seat with said web of said second shelf angle seated in said slot of said second seat.

7. The external facing support assembly of claim 6, wherein said first seat includes a first protruding toe of said leg; and said web of said first shelf angle has a first accommodation formed therein in which to admit said first protruding toe of said leg.

8. The external facing support assembly of claim 7, wherein said web of said second shelf angle is a continuous web.

9. The external facing support assembly of claim 7, wherein said leg extends downwardly of said first protruding toe.

10. The external facing support assembly of claim 9, wherein, on assembly, said carrier of said first shelf angle is flush with a lowermost portion of said leg.

11. The external facing support assembly of claim 9, wherein said assembly includes a plurality of said mounting brackets spaced apart along said first shelf angle and said second shelf angle.

12. The external facing support assembly of claim 6, wherein:

said moment restraint of said second seat includes a first retainer, and when said second shelf angle is mounted to said second seat, said first retainer is located forwardly of said web of said second shelf angle.

13. The external facing support assembly of claim 12, wherein said moment restraint of said first seat includes a second retainer, and when said first shelf angle is mounted to said first seat, said second retainer is located forwardly of said web of said first shelf angle.

14. The external facing support assembly of claim 6, wherein:

said first seat includes a first protruding toe of said leg of said mounting bracket;

said web of said first shelf angle has a first accommodation formed therein, in which to admit said first protruding toe of said leg of said mounting bracket;

said moment restraint of said second seat includes a first retainer, and when said second shelf angle is mounted to said second seat, said first retainer is located forwardly of said web of said second shelf angle;

said moment restraint of said first seat includes a second retainer, and when said first shelf angle is mounted to said first seat, said second retainer is located forwardly of said web of said first shelf angle; and said web of said second shelf angle is a continuous web.

15. The external facing support assembly of claim 6, wherein said leg of said mounting bracket has a first section including said first seat, said first section being a first end of said leg of said mounting bracket, a second section including said second seat, said second section being a second end of said leg of said mounting bracket, and an intermediate section of said leg of said mounting bracket including a web extending vertically between said first and second sections, said web of said leg mounting bracket extending vertically between said first and second sections not having a seat, and, as installed, said first seat being at a height corresponding the floor slab, and the second seat being more distant in height from the floor slab than is said first seat.

16. The external facing support assembly of claim 15, wherein:

said first section has a first peripheral edge spaced outwardly from the load-bearing structure;

said second section has a second peripheral edge spaced outwardly from the load-bearing structure; and said web defines an intermediate peripheral edge that extends between said first section and said second section, said intermediate peripheral edge being aligned with said first peripheral edge and said second peripheral edge.

17. The external facing support assembly of claim 15, wherein said first end section has a first vertical extent; said second section has a second vertical extent; and said intermediate section has an intermediate vertical extent; said intermediate vertical extent being at least twice as great as said first vertical extent of said first section and at least twice as great as said second vertical extent of said second section.

18. The external facing support assembly of claim 6, wherein:

said mounting bracket is a channel member having a web and a pair of first and second legs extending away from said web;

said first portion of said mounting bracket includes said web of said channel member;

said first leg of said channel member defines one said second portion of said mounting bracket;

said second leg of said channel defines another said second portion of said mounting bracket; and as installed, each said shelf angle engages said first leg and said second leg of said mounting bracket.

19. The external facing support assembly of claim 6, wherein said seat engagement of said second seat extends rearwardly and downwardly of said carrier of said second seat.

20. The external facing support assembly of claim 19, wherein said seat engagement of said first seat extends rearwardly and upwardly of said carrier of said first seat.

21. The external facing support assembly of claim 19, wherein said moment restraint of said second seat includes a retainer, and when said second shelf angle is mounted to said second seat, said retainer is located forwardly of said web of said second shelf angle; and said retainer has an upper edge, and said carrier of said second seat is upwardly of said upper edge.

22. The external facing support assembly of claim 6, wherein said carrier of said first seat extends forwardly of said carrier of said second seat whereby, on assembly, an external face of a first masonry veneer member mounted on said carrier of said first seat is located forwardly of an external face of a second masonry veneer member mounted on said carrier of said second seat.

23. The external facing support assembly of claim 6, wherein:

said mounting bracket has a first section including said first seat, a second section including said second seat, and an intermediate section;

said first section is above said second section, and said intermediate section is between said first section and said second section;

said intermediate section including a web extending vertically between said first section and said second section;

said vertical first section includes said mounting fitting, and is mounted to the floor slab; and said intermediate section and said second section hang downwardly lower than said floor slab.

24. The external facing support assembly of claim 6, wherein:

said mounting fitting includes a first mounting fitting and a second mounting fitting that attach to said floor slab; and said second seat hangs downwardly lower than said floor slab.

25. The external facing support assembly of claim 24, wherein:

said mounting bracket has a first section including said first seat, a second section including said second seat, and an intermediate section including a web extending vertically between said first section and said second section; and said first section includes said first mounting fitting and said second mounting fitting.

26. The external facing support assembly of claim 6, wherein:

on assembly, said at least one masonry veneer member is mounted on said foot forwardly of said mounting bracket defining a cavity between said at least one masonry veneer member and said mounting bracket; and said assembly further comprises a mortar netting positioned in said cavity.

* * * * *